US011168879B2

(12) United States Patent
Conrad

(10) Patent No.: US 11,168,879 B2
(45) Date of Patent: Nov. 9, 2021

(54) LIGHT SOURCE

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

(21) Appl. No.: 16/805,222

(22) Filed: Feb. 28, 2020

(65) Prior Publication Data

US 2021/0270454 A1 Sep. 2, 2021

(51) Int. Cl.

| | |
|---|---|
| ***F21V 29/77*** | (2015.01) |
| ***F21V 3/02*** | (2006.01) |
| ***F21S 8/02*** | (2006.01) |
| ***F21V 23/06*** | (2006.01) |
| ***F21Y 115/10*** | (2016.01) |
| ***F21K 9/232*** | (2016.01) |
| ***F21V 19/00*** | (2006.01) |

(52) U.S. Cl.

CPC ..... *F21V 29/777* (2015.01); *F21S 8/026* (2013.01); *F21V 3/02* (2013.01); *F21V 23/06* (2013.01); *F21K 9/232* (2016.08); *F21V 19/003* (2013.01); *F21V 19/0045* (2013.01); *F21Y 2115/10* (2016.08)

(58) Field of Classification Search

CPC .. F21V 19/003; F21V 19/0035; F21V 19/004; F21V 19/0045; F21V 23/06; F21V 21/34; F21V 21/35; F21V 19/0025; F21V 29/503; F21K 9/23; F21K 9/232; F21K 9/235; F21K 9/20; F21K 9/237; F21K 9/238; F21Y 2107/90

See application file for complete search history.

(56) References Cited

U.S. PATENT DOCUMENTS

| | | | | |
|---|---|---|---|---|
| 5,432,684 | A | 7/1995 | Fye | |
| 5,796,450 | A | 8/1998 | Kanda | |
| 6,727,652 | B2 * | 4/2004 | Sivacumarran | F21V 19/0025 315/185 S |

(Continued)

FOREIGN PATENT DOCUMENTS

| | | | |
|---|---|---|---|
| CN | 205806990 | U | 12/2016 |
| CN | 106382514 | A | 2/2017 |

(Continued)

OTHER PUBLICATIONS

English machine translation of CN205806990, published on Dec. 14, 2016.

(Continued)

*Primary Examiner* — Jong-Suk (James) Lee
*Assistant Examiner* — James M Endo
(74) *Attorney, Agent, or Firm* — Philip C. Mendes da Costa; Bereskin & Parr LLP/S.E.N.C.R.L., s.r.l.

(57) ABSTRACT

A light bulb including a substrate having a light emitting member provided thereon; and a main body in which the substrate is removably received, the main body having a heat sink and electrical contact members. The electrical contact members include an electrically conductive body portion that is mounted to the main body and the electrically conductive body portion mechanically secures the substrate in position in the main body.

21 Claims, 69 Drawing Sheets

(56) References Cited

U.S. PATENT DOCUMENTS

| | | | | |
|---|---|---|---|---|
| 7,140,743 | B2 | 11/2006 | Yang | |
| 8,177,409 | B2 | 5/2012 | Ohta et al. | |
| 8,997,387 | B2 | 4/2015 | Oki | |
| 2008/0106892 | A1 | 5/2008 | Griffiths et al. | |
| 2009/0075519 | A1* | 3/2009 | Daily | H01R 33/225 439/620.02 |
| 2009/0294782 | A1* | 12/2009 | Peng | F21V 19/0025 257/89 |
| 2010/0265710 | A1* | 10/2010 | Xiao | F21V 29/777 362/249.02 |
| 2011/0051430 | A1* | 3/2011 | Chen | F21V 19/004 362/373 |
| 2011/0133652 | A1* | 6/2011 | Chen | F21K 9/23 315/112 |
| 2011/0141723 | A1* | 6/2011 | Lai | F21K 9/272 362/218 |
| 2012/0182757 | A1* | 7/2012 | Liang | F21K 9/232 362/555 |
| 2012/0262089 | A1 | 10/2012 | Lo et al. | |
| 2013/0077344 | A1 | 3/2013 | Kokubu et al. | |
| 2013/0148341 | A1* | 6/2013 | Williams | F21V 29/67 362/184 |
| 2014/0001956 | A1 | 1/2014 | Ter Weeme et al. | |
| 2014/0268874 | A1 | 9/2014 | Clements | |
| 2014/0301067 | A1* | 10/2014 | Morgan | F21V 19/02 362/184 |
| 2014/0362568 | A1* | 12/2014 | Su | F21K 9/232 362/235 |
| 2014/0376267 | A1 | 12/2014 | Myers et al. | |
| 2015/0117018 | A1* | 4/2015 | Chen | F21V 29/70 362/294 |
| 2015/0219328 | A1* | 8/2015 | Lee | F21K 9/233 362/235 |
| 2015/0247612 | A1 | 9/2015 | Zhang et al. | |
| 2015/0300619 | A1* | 10/2015 | Reier | F21K 9/232 362/249.02 |
| 2016/0245462 | A1* | 8/2016 | Demuynck | F21K 9/232 |
| 2016/0356428 | A1* | 12/2016 | Edmond | H05K 1/00 |
| 2017/0138541 | A1* | 5/2017 | Tousain | F21K 9/238 |
| 2018/0350584 | A1* | 12/2018 | Fu | F21K 9/237 |
| 2018/0363857 | A1* | 12/2018 | Ren | F21V 17/04 |
| 2018/0372278 | A1* | 12/2018 | Zhang | F21K 9/232 |
| 2019/0032862 | A1* | 1/2019 | Hollaender | F21K 9/238 |

FOREIGN PATENT DOCUMENTS

| | | | |
|---|---|---|---|
| JP | 08-160892 | B2 | 6/1996 |
| JP | 2009047909 | A | 3/2009 |
| JP | 2013068718 | A | 4/2013 |
| JP | 2015118899 | A | 6/2015 |
| JP | 5752893 | B2 | 7/2015 |
| KR | 101759051 | B1 | 7/2017 |

OTHER PUBLICATIONS

English machine translation of CN106382514, published on Feb. 8, 2017.

English machine translation of KR101759051, published on Jul. 18, 2017.

English machine translation of the Abstract of JP2015118899A, published on Jun. 25, 2015.

English machine translation of the Abstract of JP5752893B2, published on Jul. 22, 2020.

English machine translation of the Abstract of JP08160892A, published on Jun. 21, 1996.

English machine translation of the Abstract of JP2009047909A, published on Mar. 5, 2009.

English machine translation of the Abstract of JP2013068718A, published on Apr. 18, 2013.

* cited by examiner

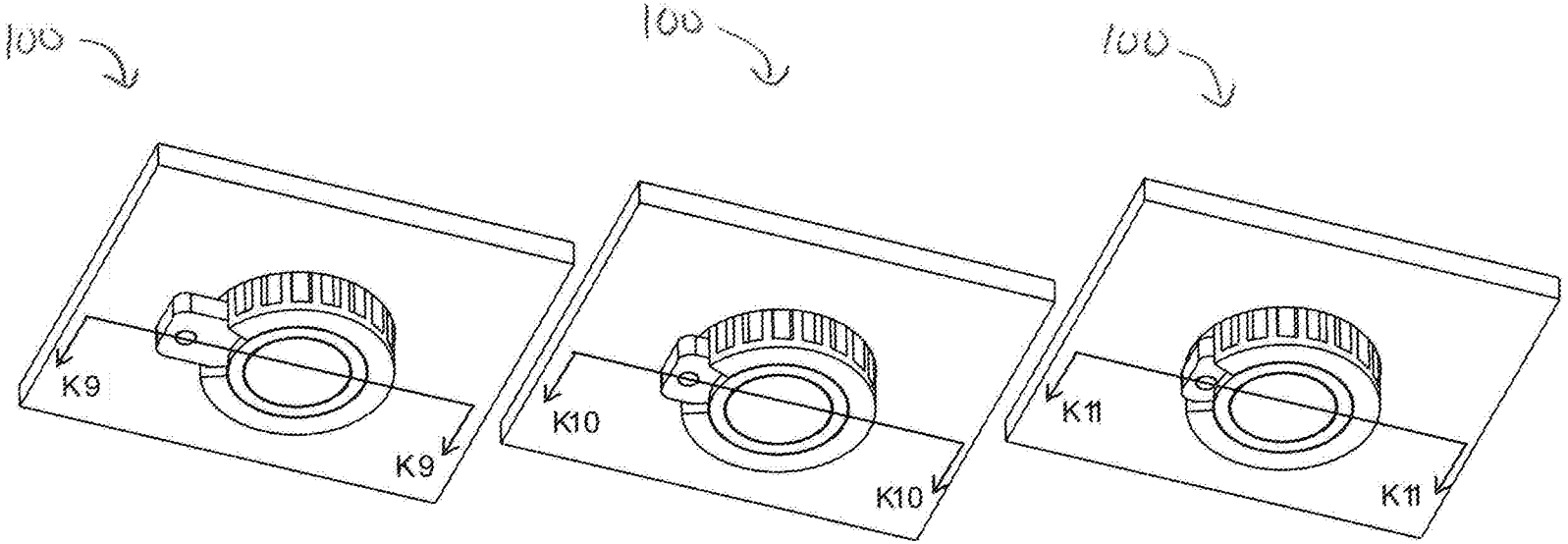
FIG. 24E
FIG. 24F
FIG. 24G
FIG. 24H
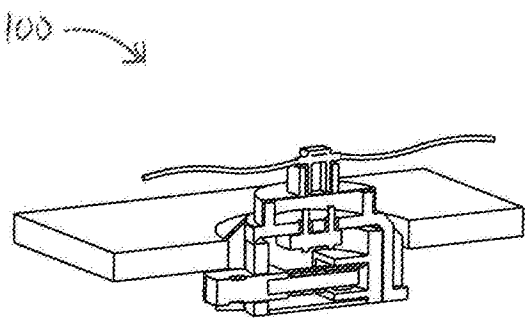
FIG. 24I
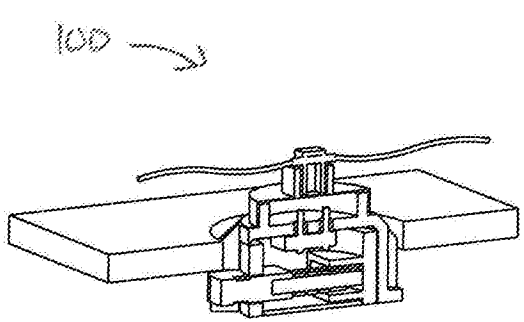
FIG. 24J

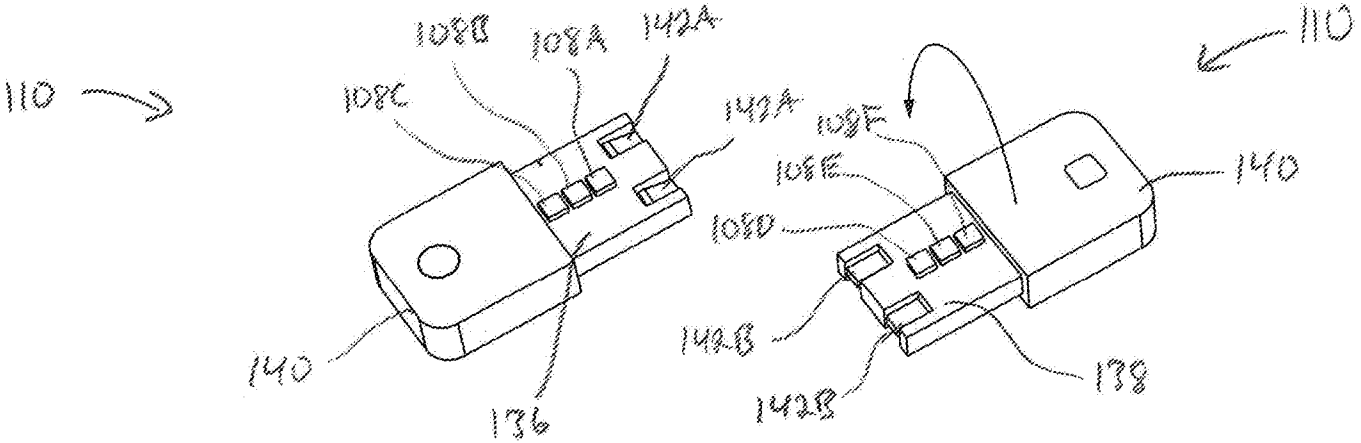
FIG. 24L
FIG. 24K
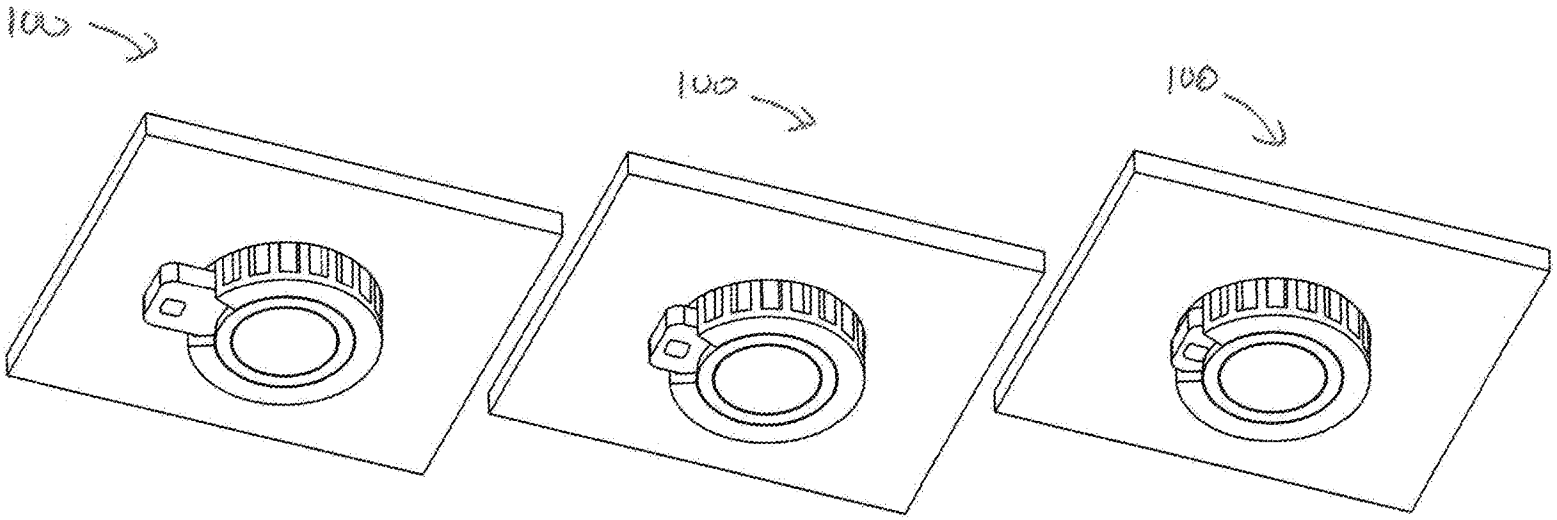
FIG. 24O
FIG. 24N
FIG. 24M

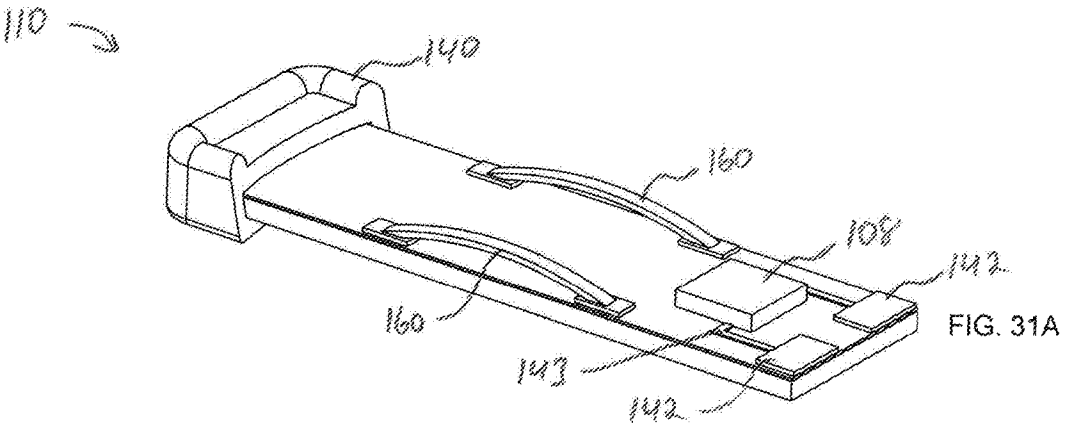
FIG. 31A
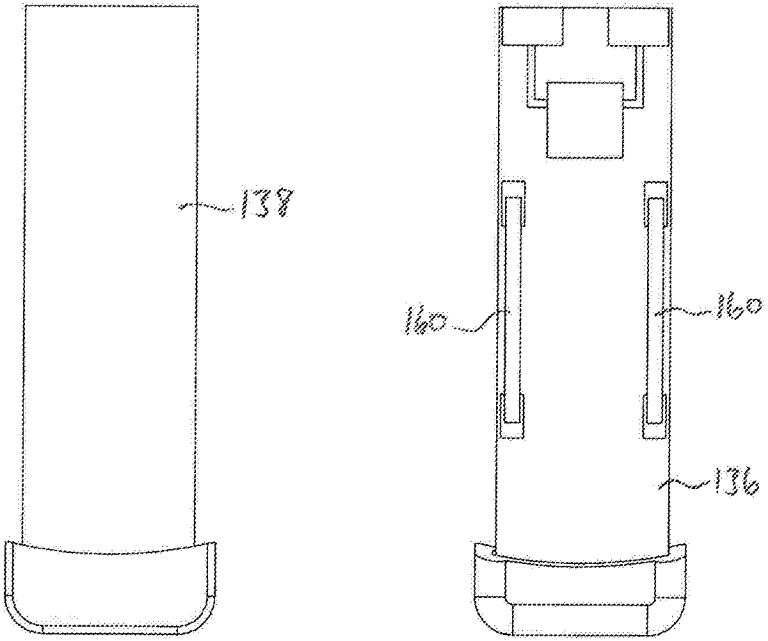
FIG. 31B
FIG. 31C
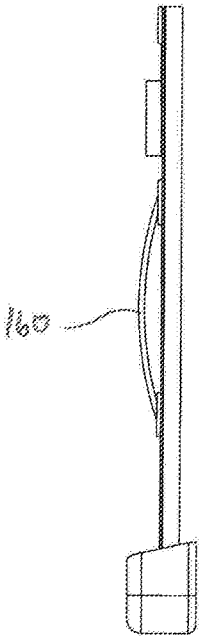
FIG. 31D

LIGHT SOURCE

FIELD

This application relates to the field of light sources and apparatus including the same.

INTRODUCTION

The following is not an admission that anything discussed below is part of the prior art or part of the common general knowledge of a person skilled in the art.

A light-emitting diode (LED) is a semiconductor light source that emits light when activated. Generally, LEDs have lower energy consumption and longer lifespans as compared with traditional light sources, such as incandescent and halogen lights.

Various types of LED lights and light fixtures are known. For example, a light source may be provided wherein a substrate having one or more LEDs thereon is positioned so as to direct light into a light guide. See for example U.S. Pat. No. 10,353,142.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with one aspect of this disclosure, which may be used alone or in combination with any other aspect, there is provided a light bulb in which a substrate is removably received, e.g., it may be slidingly receivable in an opening or recess provided in any portion of the light bulb, such as a main body or a diffuser. The substrate has one or more light emitting members provided thereon. By providing a removable substrate, a user may easily replace the light emitting member of the light bulb if the light emitting member burns out or malfunctions. The removable substrate may also provide the advantage of allowing the light bulb to be reused by simply replacing the substrate. Accordingly, the lifetime of the light bulb may be increased. The light bulb has electrical contact members. Accordingly, when the substrate is placed in the light bulb, the electrical contact members are in contact with a conductive part of the substrate (e.g., the LED or a contact electrically connected to the LED).

In accordance with this aspect, the electrical contact members secure the substrate in position in the light bulb. Alternately, or in addition, the electrical contact members may thermally connect the substrate with a heat sink provided in the light bulb. Accordingly, the electrical contact members may function to connect the substrate with a source of current and also to retain the substrate in an operating position in the light bulb and/or to thermally connect the substrate with a heat sink.

In accordance with this broad aspect, there is provided a light bulb comprising:

(a) a substrate having a light emitting member provided thereon; and, (b) a main body in which the substrate is removably received, the main body comprising a heat sink and electrical contact members;

wherein the electrical contact members comprise an electrically conductive body portion that is mounted to the main body and the electrically conductive body portion mechanically secures the substrate in position in the main body.

In any embodiment, the electrically conductive body portion may have a biasing member which engages the substrate.

In any embodiment, the electrical contact members may comprise a first electrical contact member which contacts a first side of the substrate and a second electrical contact member that contacts an opposed side of the substrate.

In any embodiment, the electrical contact members may comprise first and second electrical contact members, the first electrical contact member may exert a force in a first direction on the substrate and the second electrical contact member may exert a force in a direction opposite to the first direction on the substrate.

In any embodiment, the substrate may comprise an insertion end which is a lead end when the substrate is inserted into the main body and the electrical contact members may comprise a cam surface engageable by the insertion end upon insertion of the substrate into the main body.

In any embodiment, the main body may comprise a recess in which the substrate is removably received and at least a portion of the electrical contact members may be provided in the recess.

In any embodiment, the recess may be provided in the heat sink.

In any embodiment, the electrical contact members may comprise a guide surface which guides the substrate into the recess.

In any embodiment, the heat sink may comprise a recess in which the substrate is removably received.

In any embodiment, the substrate may comprise an insertion end, a longitudinally opposed outer end and a body portion extending longitudinally between the insertion end and the outer end, and the heat sink may comprise an opening in which the body portion of the substrate is positioned when the substrate is mounted in the main body.

In any embodiment, the main body may comprise a recess in which the insertion end of the substrate is removably received.

In any embodiment, the electrical contact members may thermally connect the substrate with the heat sink.

In any embodiment, the substrate may be made of a non-conductive material and may be coated with a thermal conducting layer.

In any embodiment the substrate may comprise a printed circuit board.

In any embodiment, the main body may comprise a housing having a base connectable to a source of current, a diffuser and a slot in which the substrate is removably insertable.

In any embodiment, the substrate may comprise an insertion end, a longitudinally opposed outer end and a body portion extending longitudinally between the insertion end and the outer end, the body portion may comprise first and second longitudinally extending surfaces on different sides of the body portion and a light emitting member may be provided on each of the first and second longitudinally extending surfaces.

In accordance with this broad aspect, there is also provided a light bulb comprising:

(a) a substrate having a light emitting member provided thereon; and, (b) a main body in which the substrate is removably received, the main body comprising a heat sink and electrical contact members;

wherein the electrical contact members mechanically secure the substrate in position in the main body, and wherein the electrical contact members thermally connect the substrate with the heat sink.

In any embodiment, the electrical contact members may comprise a first electrical contact member which contacts a first side of the substrate and a second electrical contact member that contacts an opposed side of the substrate.

In any embodiment, the electrical contact members may comprise first and second electrical contact members, the first electrical contact member may exert a force in a first direction on the substrate and the second electrical contact member may exert a force in a direction opposite to the first direction on the substrate.

In any embodiment, the first and second contact members that exert the force may be made of a conductive material.

It will be appreciated by a person skilled in the art that an apparatus or method disclosed herein may embody any one or more of the features contained herein and that the features may be used in any particular combination or sub-combination.

In accordance with another aspect of this disclosure, which may be used alone or in combination with any other aspect, there is provided a light bulb in which a substrate is removably received. The substrate has one or more light emitting members, such as LEDs, thereon. The light bulb has a heat sink provided therein. Electrical leads (e.g., wires) may extend through the heat sink. An advantage of this aspect is that the construction of the light bulb may be simplified. For example, if the light bulb has an electrical contact end (e.g., a base end that may be screwed into a socket) and an axially opposed light emitting end (e.g., a diffuser for emitting light produced by one or more LEDs, the heat sink may extend across the entire cross-sectional area (in a direction transverse to the axis) of the light bulb so as to provide a larger heat sink. In such a case, one or more passages may be provided through the heat sink through which electrical leads that comprise part, or all, of the electrical conduit from the base to the LEDs may extend.

In accordance with this aspect, there is provided a light bulb comprising:

(a) a substrate having a light emitting member provided thereon; and, (b) a main body in which the substrate is positioned, the main body comprising a heat sink, a power supply, electrical contact members electrically connecting the substrate to the power supply and electrical leads extending from the power supply to the electrical contact members, wherein the electrical leads extend through the heat sink.

In any embodiment, the substrate may be removably receivable in the main body.

In any embodiment, the substrate may be mounted to the heat sink.

In any embodiment, the heat sink may have a recess in which the substrate is mounted.

In any embodiment, the heat sink may have a recess in which the substrate is removably received.

In any embodiment, the substrate may be seated on the heat sink.

In any embodiment, the main body may comprise a housing having a base connectable to a source of current, and the power supply may be positioned between the base and the heat sink.

In any embodiment, the heat sink may be removably mounted to the main body.

In any embodiment, the main body may comprise a diffuser and the diffuser and the heat sink may be removably mounted to the main body. Optionally, the diffuser and the heat sink may be separately removably mounted to the main body.

In any embodiment, the main body may comprise a slot in which the substrate is removably insertable.

In any embodiment, the main body may comprise a diffuser and the diffuser may comprise a slot through which the substrate is removably insertable.

In any embodiment, the main body may comprise an insertion end comprising a base that is connectable to a source of current and an axially spaced light emitting end having a diffuser and the diffuser may comprise slot through which the substrate is axially insertable.

In any embodiment, the diffuser may be removably mounted to the heat sink.

In any embodiment, the electrical contact members may be provided on the heat sink.

In any embodiment, the heat sink may have first and second opposed sides and at least one opening through which the electrical leads extend, the power supply may be provided on the first opposed side of the heat sink and the substrate may be provided on the second opposed side of the heat sink. Optionally, the electrical contact members may be provided on the second opposed side of the heat sink. Optionally, the electrical contact members may thermally connect the substrate with the heat sink.

In any embodiment, the main body may comprise a housing having a base connectable to a source of current, the heat sink may be mounted to the housing and may form part of an exterior surface of the light bulb. Optionally, the main body may further comprise a diffuser that is mounted to the heat sink.

In accordance with another aspect of this disclosure, which may be used alone or in combination with any other aspect, there is provided a light bulb in which a substrate is removably received. The substrate has one or more light emitting members, such as LEDs, thereon and the light bulb has a heat sink provided therein. The substrate is made of a non-conductive material, which may be any material used for a printed circuit board. In accordance with this aspect, the substrate is provided with a thermal conductive layer on one or more surfaces thereon. The thermal conductive layer may be a coating applied to the substrate. An advantage of this design is that the electrical contact members that electrically connect the substrate to the light bulb may also thermally connect the substrate with the heat sink.

In accordance with this aspect, there is provided a light bulb comprising:

(a) a light emitting body comprising a non-conductive substrate having a light emitting member provided thereon and a thermal conducting layer on an outer surface thereof; and, (b) a main body in which the substrate is removably received, the main body comprising a heat sink and electrical contact members;

wherein the electrical contact members comprise an electrically conductive body portion that electrically connects the light emitting body to the main body and, wherein the electrical contact members are thermally conductive and thermally connect the light emitting body to the heat sink.

In any embodiment, the electrical contact members may comprise a first electrical contact member which contacts a first side of the light emitting body and a second electrical contact member that contacts an opposed side of the light emitting body.

In any embodiment, the electrical contact members may be provided on the heat sink.

In any embodiment, the thermal conducting layer may be provided on two opposed surfaces of the substrate.

In any embodiment, the light emitting body may have an insertion end, a longitudinally opposed outer end and a body portion extending longitudinally between the insertion end and the outer end, the body portion having first and second longitudinally extending surfaces on different sides of the body portion and the thermal conducting layer may be provided on each of the first and second longitudinally extending surfaces.

In any embodiment, the electrical contact members may comprise a first electrical contact member which contacts the first longitudinally extending surface of the light emitting body and a second electrical contact member that contacts the second longitudinally extending surface of the light emitting body.

In any embodiment, the thermal conducting layer may be an electrical conductive member.

In any embodiment, the electrical contact members may be provided on the heat sink.

In any embodiment, the light emitting body may comprise a printed circuit board.

In any embodiment, the electrical contact members may comprise a guide surface which guides the substrate into a mounted position in the main body. For example, the electrical contact members may comprise a cam surface.

In any embodiment, the thermal conducting layer comprises at least one of aluminum and copper.

In accordance with this aspect, there is also provided a light emitting body for a light bulb, the light emitting body comprising a non-conductive substrate having a light emitting member provided thereon and a thermal conducting layer on an outer surface thereof.

In any embodiment, the light emitting body may comprise a printed circuit board.

In any embodiment, the thermal conducting layer may be provided on two opposed surfaces of the substrate.

In any embodiment, the thermal conducting layer may be an electrical conductive member.

In any embodiment, the thermal conducting layer may comprise at least one of aluminum and copper.

In any embodiment, a gold coating may be provided on an outer surface of the thermal conducting layer.

In any embodiment, the light emitting member may be electroluminescent.

In accordance with another aspect of this disclosure, which may be used alone or in combination with any other aspect, there is provided a longitudinally extending light bulb in which a substrate is provided and is optionally removably receivable therein. The substrate has one or more light emitting members, such as LEDs, thereon. The LEDs are oriented at an angle to the longitudinal axis such that, when installed, the LEDs emit light in a direction that is between the downward and the lateral outward directions. A diffuser may be provided on the light emitting side of the lightbulb. An advantage of this design is that the light may be more evenly distributed.

In accordance with this aspect there is provided a light bulb comprising:

(a) a substrate having a light emitting member provided thereon; and, (b) a main body in which the substrate is positioned, the main body comprising a base end connectable to a source of current, an opposed light emitting end and a central axis extending between the base end and the opposed end;

wherein a portion of the substrate has a first inward end and a second outward end, the inward end is positioned closer to the base end than the second outward end of the portion, the inward end is also positioned further from the central axis than the second outward end of the portion and the light emitting member is provided on the portion.

In any embodiment, the portion of the substrate may be generally planar.

In any embodiment, an included angle measured from the portion of the substrate having the first inward end and the second outward end outwardly towards the central axis may be from about 110° to about 160°.

In any embodiment, the electrical contact members may comprise a first electrical contact member which contacts a first side of the substrate and a second electrical contact member that contacts an opposed side of the substrate.

In any embodiment, the electrical contact members may comprise first and second electrical contact members, the first electrical contact member may exert a force in a first direction on the substrate and the second electrical contact member may exert a force in a direction opposite to the first direction on the substrate.

In any embodiment, the substrate may have an insertion end which is a lead end when the substrate is inserted into the main body and the electrical contact members may comprise a cam surface engageable by the insertion end upon insertion of the substrate into the main body.

In any embodiment, the main body may have a recess in which the substrate is removably received and at least a portion of the electrical contact members may be provided in the recess. Optionally, the recess may be provided in the heat sink.

In any embodiment, the electrical contact members may comprise a guide surface which guides the substrate into the recess.

In any embodiment, the heat sink may have a recess in which the substrate is removably received.

In any embodiment, the substrate may have an insertion end, a longitudinally opposed outer end and a body portion extending longitudinally between the insertion end and the outer end, and the heat sink may have an opening in which the body portion of the substrate is positioned when the substrate is mounted in the main body.

In any embodiment, the electrical contact members may thermally connect the substrate with the heat sink.

In any embodiment, the substrate may be made of a non-conductive material and may be coated with a thermal conducting layer.

In any embodiment, the substrate may comprise a printed circuit board.

In any embodiment, the main body may comprise a housing having a base connectable to a source of current, a diffuser and a slot in which the substrate is removably insertable.

In any embodiment, the substrate may have an insertion end, a longitudinally opposed outer end and a body portion extending longitudinally between the insertion end and the outer end, the body portion may have first and second longitudinally extending surfaces on different sides of the body portion and a light emitting member may be provided on each of the first and second longitudinally extending surfaces.

In accordance with this aspect, there is also provided a light bulb comprising:

(a) a substrate having a light emitting member provided thereon; and, (b) a main body in which the substrate is removably received, the main body comprising a heat sink and electrical contact members;

wherein the electrical contact members mechanically secure the substrate in position in the main body, and wherein the electrical contact members thermally connect the substrate with the heat sink.

In any embodiment, the electrical contact members may comprise a first electrical contact member which contacts a first side of the substrate and a second electrical contact member that contacts an opposed side of the substrate.

In any embodiment, the electrical contact members may comprise first and second electrical contact members, the first electrical contact member may exert a force in a first direction on the substrate and the second electrical contact member may exert a force in a direction opposite to the first direction on the substrate.

In any embodiment, the body portion that exerts the force may be made of a conductive material.

In accordance with another aspect of this disclosure, which may be used alone or in combination with any other aspect, there is provided a longitudinally extending light bulb in which a substrate is provided and is optionally removably receivable therein. The substrate has one or more light emitting members, such as LEDs, thereon. The light bulb also has a power supply that is removable. An advantage of this design is that, should the power supply fail, a consumer may remove the power supply and insert a replacement power supply. Accordingly, instead of throwing away the entire lightbulb, which adds to environmental waste, only the power supply need be replaced. The light bulb may be disassembleable, such as by one portion being unscrewed from another and the power supply then pulled out.

In accordance with this aspect, there is provided a light bulb comprising:

(a) a substrate having a light emitting member provided thereon; and, (b) a main body in which the substrate is positioned, the main body comprising a heat sink and a power supply, wherein when the substrate is positioned in the main body, the substrate is thermally connected to the heat sink and electrically connected to the power supply, wherein the power supply is removably receivable in the main body, whereby the power supply is replaceable without replacing the heat sink.

In any embodiment, the main body may comprise a housing having a base connectable to a source of current, and the power supply may be positioned between the base and the heat sink.

In any embodiment, electrical contact members may electrically connect the substrate to the power supply and first electrical leads, which extend from the power supply to the electrical contact members, may extend through the heat sink.

In any embodiment, the heat sink may be removably mounted to the main body.

In any embodiment, the heat sink and power supply may be concurrently removable from the main body and, subsequently to the heat sink and power supply being removed from the main body, the power supply may be removable from the heat sink.

In any embodiment, the power supply may be removably mounted to the heat sink.

In any embodiment, the heat sink may be removable from the light bulb and, subsequently the power supply may be removable.

In any embodiment, the main body may comprise a diffuser and the diffuser and the heat sink may be removably mounted in position as part of the light bulb. Optionally, the diffuser and the heat sink may be sequentially removable from a mounted position in which the diffuser and the heat sink are part of the light bulb. Alternately, the diffuser and the heat sink may be concurrently removable from a mounted position in which the diffuser and the heat sink are part of the light bulb.

In any embodiment, the main body may comprise a housing having a base connectable to a source of current, the heat sink may be provided between the housing and the diffuser and the diffuser may be releasably lockably securable to the housing.

In any embodiment, the main body may comprise a housing having a base connectable to a source of current, the heat sink may be provided between the housing and the diffuser and, when mounted as part of the light bulb, the diffuser may be positioned on the heat sink and may be releasably lockably securable in position.

In any embodiment, the main body may comprise a housing having a base connectable to a source of current, and the housing may have locking members that lockingly engage the diffuser.

In any embodiment, the main body may comprise a housing having a base connectable to a source of current, and the power supply may be removably positionable on the housing.

In any embodiment, the housing may comprise a wall that seats over the base,

In any embodiment, electrical contact members may electrically connect the substrate to the power supply and first electrical leads, which extend from the power supply to the electrical contact members, may extend through the heat sink and second electrical leads, which extend from the base to the power supply, may extend through the wall.

In any embodiment, the substrate may be removably receivable in the main body.

In any embodiment, the light emitting member may be electroluminescent or one or more LEDs.

In accordance with another aspect of this disclosure, which may be used alone or in combination with any other aspect, there is provided a light bulb in which a substrate is provided and is optionally removably receivable therein. The substrate has one or more light emitting members, such as LEDs, thereon which are operable on a low voltage current. A remote power supply is provided to which a plurality of lightbulbs is connected, e.g., in series or parallel. An advantage of this design is that, since a single power supply is provided, once the power supply is installed, such as by an electrician, an electrician is not required to run the low voltage wires and install the light bulbs or their housings.

In accordance with this aspect, there is provided a kit for a low voltage lighting system comprising:

(a) a plurality of light bulbs, at least some of the light bulbs removably receive a substrate having a light emitting member thereon; and, (b) a central power supply connectable to a source of AC current, wherein each light bulb is connectable to the remote central power source by low voltage wires.

In any embodiment, the light bulbs may be configured to be connectable in parallel.

In any embodiment, the light bulbs may be pot lights.

In any embodiment, at least some of the light bulbs may have a rechargeable back up power source. Optionally, the rechargeable back up power source may comprise a rechargeable battery provided inside the light bulb In any embodiment, the substrate may be slideably receivable in the light bulb. Optionally, the substrate may be slideably receivable in the light bulb while the light bulb is secured in an electrical fixture. Optionally, the fixture may comprise a pot light housing.

In any embodiment, the light bulb may comprise push-in wire connectors.

In any embodiment, the light emitting member may be electroluminescent or one or more LEDs.

In accordance with this aspect, there is also provided a low voltage lighting system comprising:

(a) a plurality of light bulbs; and, (b) a remote central power supply connectable to a source of AC current, wherein each light bulb is removably connectable to the remote central power source by low voltage wires, and wherein at least some of the light bulbs removably receive a substrate having a light emitting member thereon.

In any embodiment, the light bulbs may be configured to be connectable in parallel.

In any embodiment, the light bulbs may be pot lights.

The low voltage lighting system of clause 10 wherein at least some of the light bulbs have a rechargeable back up power source.

In any embodiment, the rechargeable back up power source may comprise a rechargeable battery provided inside the light bulb.

In any embodiment, the substrate may be slideably receivable in the light bulb. Optionally, the substrate may be slideably receivable in the light bulb while the light bulb is secured in an electrical fixture. Optionally, the fixture may comprise a pot light housing.

In any embodiment, the light bulb may comprise push-in wire connectors.

In any embodiment, the light emitting member may be electroluminescent or one or more LEDs.

In accordance with another aspect of this disclosure, which may be used alone or in combination with any other aspect, there is provided a light bulb in which a substrate is provided and is optionally removably receivable therein. The substrate has at least first and second light emitting members, such as LEDs, thereon. The light emitting members are not all electrically connected at the same time. For example, the first light emitting members may be electrically connected so as to emit light when the light bulb is actuated while the second light emitting members may not be electrically connected when the first is electrically connected. Accordingly, if the first light emitting member fails, the second may then be used to produce light. Accordingly, a substrate may be provided which has one or more reserve light emitting members that are used sequentially or collectively when the first light emitting member or members fail.

In accordance with this aspect, there is a light bulb comprising:

(a) a substrate having at least first and second light emitting members provided thereon; and, (b) a main body in which the substrate is positionable in first and second operable positions, in the first operable position the first light emitting member is operable to provide illumination and the second light emitting member is inoperable and in the second operable position the second light emitting member is operable to provide illumination.

In any embodiment, in the second operable position, the first light emitting member may be inoperable.

In any embodiment, the substrate may be rotatably mounted in the main body whereby the substrate may be rotatable from the first operable position to the second operable position.

In any embodiment, the substrate may be slideably mounted in the main body whereby the substrate may be slideable from the first operable position to the second operable position.

In any embodiment, the substrate may comprise first and second opposed sides, the first light emitting member may be provided on the first side and second light emitting member may be provided on the second opposed side, the substrate may be positionable in a first orientation in the main body in which the first light emitting member is operable and the substrate may be positionable in a second orientation in the main body in which the second light emitting member is operable.

In any embodiment, the substrate may comprise first and second opposed sides, the first light emitting member may be provided on the first side and second light emitting may be is provided on the second opposed side and the main body may have a light emitting end, wherein the substrate may be positionable in the main body in a first orientation in which the first light emitting member faces the light emitting end and the substrate may be positionable in a second orientation in the main body in which the second light emitting member faces the light emitting end.

In any embodiment, the substrate may be removably receivable in the main body.

In any embodiment, the first light emitting member may emit a first colour of light and the second light emitting member may emit a second colour of light.

In any embodiment, the first light emitting member may emit a first level of illumination and the second light emitting member may emit a second level of illumination wherein the second level of illumination is greater than the first level of illumination. For example, the first level of illumination may be from 3 to 6 Watts and the second level of illumination may be from 6 to 10 Watts.

In any embodiment, the light emitting member may be electroluminescent or one or more LEDs.

In accordance with this aspect, there is also provided a light bulb comprising:

(a) a first substrate having a first light emitting member provided thereon;

(b) a second substrate having a second light emitting member provided thereon; and, (c) a main body having the first and second substrates wherein, in a first configuration the first light emitting member is operable and in a second configuration the second light emitting member is operable.

In any embodiment, in the first configuration, the first light emitting member may be positioned in an operable position in the main body and the second substrate may be positioned in a storage position and, in the second configuration, the second light emitting member may be positioned in an operable position in the main body.

In any embodiment, in the first configuration, the second substrate may be positioned on an exterior surface of the main body.

In any embodiment, the substrate may be slidably receivable in the main body and the first and second substrates may be moved from the first configuration to the second configuration by slidably removing the first substrate from the main body and slidably inserting the second substrate in the main body.

In any embodiment, the light bulb may comprise a switch operable between two positions, in the first position, the first light emitting member may be operable and, in the second position, the second light emitting member may be operable.

In any embodiment, the light emitting member may be electroluminescent or one or more LEDs.

In accordance with this aspect, there is also provided a light bulb comprising:

(a) a substrate having at least first and second light emitting members provided thereon;

(b) a main body in which the substrate is positioned; and, (c) a switch operable between two positions, in the first position, the first light emitting member is operable and, in the second position, the second light emitting member is operable.

In any embodiment, the switch may be manually operable.

In any embodiment, the substrate may have a third light emitting member and the substrate may be positionable in the main body in first and second operable positions, in the first operable position the first light emitting member and second light emitting member may be selectively operable to provide illumination and the third light emitting member may be inoperable, and in the second operable position the third light emitting member may be operable to provide illumination.

In any embodiment, the light emitting member may be electroluminescent or one or more LEDs.

In accordance with another aspect, a street light or the like may be provided wherein a head having a light emitting portion is provided at an elevation above a sidewalk, road or the like and a substrate having one or more light emitting members, such as LEDs, may be removably receivable in a lower portion of the street light, e.g., accessible to a person while standing on the ground. A light pipe, or light guide, may conduct the light from the substrate to the light emitting portion (e.g., the outlet end of the light pipe). An advantage of this design is that a cherry picker or the like is not required to replace a light bulb. Instead, if a light emitting member fails, a worker may replace the substrate while standing on the ground.

In accordance with this aspect, there is provided a street light fixture comprising:

(a) a pole having a base end and an upper end;

(b) a head attached to the upper end of the pole, the head having a light emitting portion;

(c) a substrate having a light emitting member provided thereon, the substrate being removably receivable in the base end of the pole; and, (d) a light guide provided in the pole and extending between the substrate and the head.

In any embodiment, the substrate may be removably receivable in an openable housing and the openable housing may be at an elevation openable by a person while standing on the ground.

In any embodiment, when the substrate is positioned in the pole, a lower end of the light guide may abut the light emitting member.

In any embodiment, the substrate may have a plurality of light emitting members.

In any embodiment, the light guide may extend into the head.

In any embodiment, the light guide may have a lower portion that extends axially in the pole and an upper portion that extends away from the pole. Optionally, the upper portion of the light guide is curved.

In any embodiment, the light guide may be a longitudinally extending member, the light guide may have a longitudinally extending outer surface and the outer surface may be non-light emitting.

In any embodiment, the light emitting member may be electroluminescent or one or more LEDs.

In accordance with this aspect, there is also provided a light fixture comprising:

(a) a light emitting portion;

(b) a housing which removably receives a substrate, the substrate having a light emitting member provided thereon; and, (c) a light guide extending between the housing and the light emitting portion.

In any embodiment, the housing may be at an elevation whereby the substrate is replaceable by a person while standing on the ground.

In any embodiment, when the substrate is positioned in the housing, a lower end of the light guide may abut the light emitting member.

In any embodiment, the substrate may have a plurality of light emitting members.

In any embodiment, the light guide may be curved.

In any embodiment, the light guide may be a longitudinally extending member, the light guide may have a longitudinally extending outer surface and the outer surface may be non-light emitting.

In any embodiment, the light guide may be a longitudinally extending member, the light guide may have a longitudinally extending outer surface and at least a portion of the outer surface may be a light emitting surface.

In any embodiment, the light guide may be a longitudinally extending member, the light guide may have a longitudinally extending outer surface and the outer surface may have a light emitting surface.

In any embodiment, the light emitting member may be electroluminescent or one or more LEDs.

In accordance with another aspect of this disclosure, which may be used alone or in combination with any other aspect, there is provided a light bulb in which a substrate is provided and is optionally removably receivable therein. The substrate has at least one light emitting member, such as LEDs, thereon. The substrate has a biasing member, which may be a spring biased electrical contact, which retains the substrate in the light bulb.

In accordance with this aspect, there is provided a light bulb comprising:

(a) a substrate having a light emitting member provided thereon; and, (b) a main body in which the substrate is removably received, the main body comprising electrical contact members, wherein the substrate has a biasing member which secures the substrate in position in the main body.

In any embodiment, the biasing member may comprise an electrically conductive body portion which engages the electrical contact members when the substrate is positioned in the main body.

In any embodiment, the main body may further comprise a heat sink and the biasing member may bias the substrate into thermal contact with the heat sink when the substrate is positioned in the main body.

In any embodiment, the main body may comprise a slot in which the substrate is slideably receivable, and wherein the substrate may have an insertion end, a longitudinally opposed outer end and a body portion extending longitudinally between the insertion end and the outer end and the biasing member may bias the body portion to abut the heat sink when the substrate is positioned in the main body.

In any embodiment, the light emitting member and the biasing member may be provided on a common side of the substrate.

In any embodiment, the substrate may comprise a longitudinally extending body portion, the body portion has first and second opposed longitudinally extending sides, the light emitting member and the biasing member may be provided on the first longitudinally extending side and the second longitudinally extending side may be a thermally conductive. Optionally, the main body may further comprise a heat sink and the biasing member may bias the second longitudinally extending side into thermal contact with the heat sink when the substrate is positioned in the main body.

In any embodiment, the substrate may be made of a non-conductive material and may be coated with a thermal conducting layer.

In any embodiment, the substrate may be a printed circuit board.

In any embodiment, the substrate may comprise electrical contacts and the electrical contact members may contact the electrical contacts when the substrate is positioned in the main body.

In any embodiment, the biasing member may be made of an electrical insulation material.

In any embodiment, the main body may further comprise a heat sink and the biasing member may be thermally conductive.

In any embodiment, the light emitting member is electroluminescent.

In any embodiment, the light emitting member may be electroluminescent or one or more LEDs.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which:

FIG. 24E-24G show perspective views of the light source of FIG. 24A with the cartridge at various operable positions;

FIG. 24H shows a cross-sectional view of the light source of FIG. 24E along the line K9-K9 in FIG. 24E;

FIG. 24I shows a cross-sectional view of the light source of FIG. 24F along the line K10-K10 in FIG. 24F;

FIG. 24J shows a cross-sectional view of the light source of FIG. 24G along the line K11-K11 in FIG. 24G;

FIG. 24K-24L show perspective views of the cartridge of FIG. 24A;

FIG. 24M-24O show perspective views of the light source of FIG. 24A with the cartridge at various operable positions;

FIG. 25G shows a cross-sectional view of the light source of FIG. 25A along the line L2-L2 in FIG. 25A with the second cartridge removed;

FIG. 25I shows a perspective view of the light source of FIG. 25A with the second cartridge removed;

FIG. 25J shows a cross-sectional view of the light source of FIG. 25I along the line L2-L2 in FIG. 25A;

FIG. 26A shows a perspective view of another light source;

FIG. 26B shows a cross-sectional view of the light source of FIG. 26A along the line M-M in FIG. 26A;

FIG. 26C shows a perspective view of the light source of FIG. 26A with the cartridge removed;

FIG. 26D shows a cross-sectional view of the light source of FIG. 26C along the line M-M in FIG. 26A;

FIG. 26E shows an exploded view of the light source of FIG. 26A;

FIG. 26F shows a perspective view of the light source of FIG. 26A with the cartridge, housing, heat sink, and diffuser removed;

FIG. 27A shows a perspective view of another light source, which may be used as a street light or a table or floor lamp;

FIG. 27B shows a cross-sectional view of the light source of FIG. 27A along the line N-N in FIG. 27A;

FIG. 27C shows a perspective view of the light source of FIG. 27A with the cartridge removed;

Figure 28B:
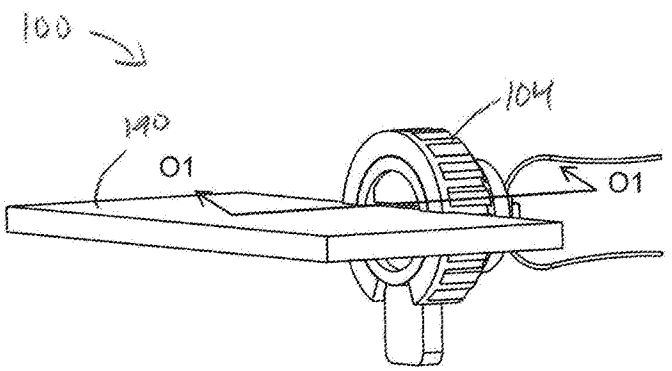
Figure 28A:
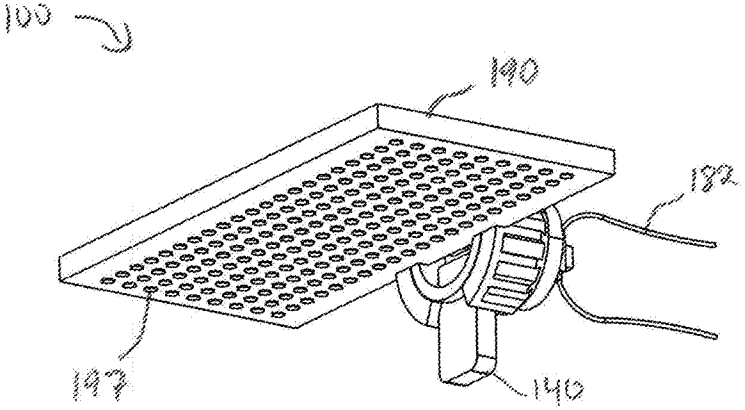
Figure 28C:
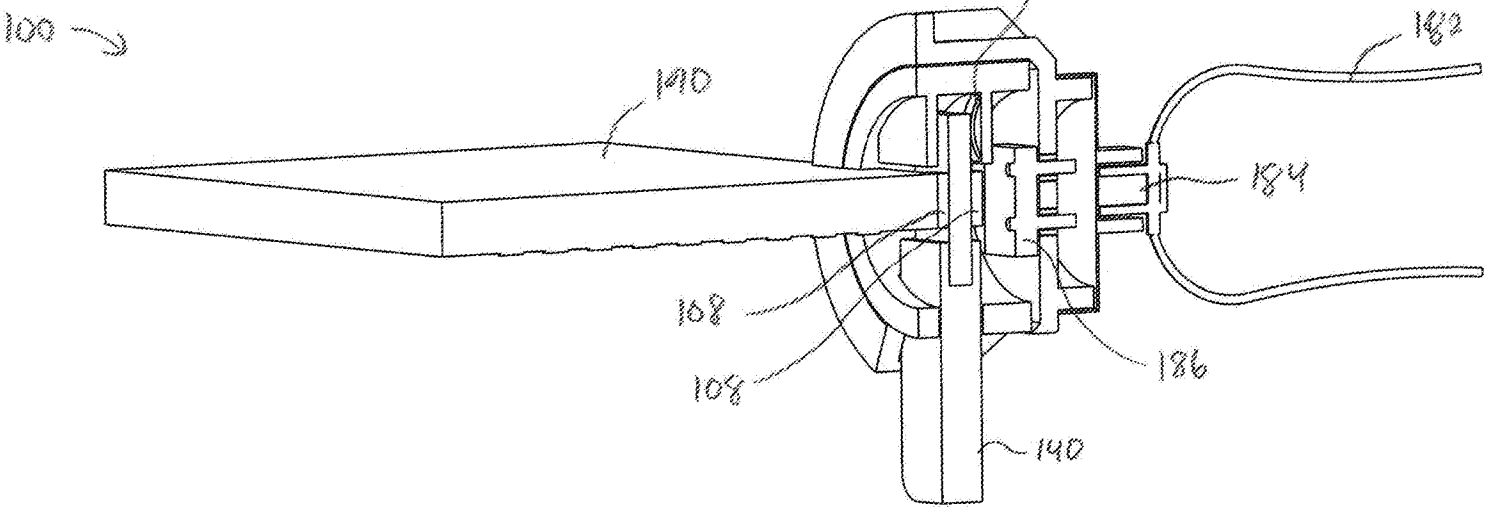
Figure 28D:
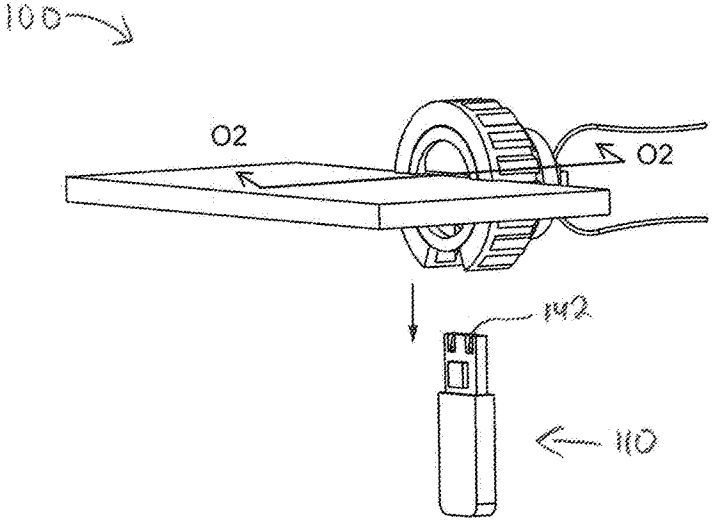
Figure 28E:
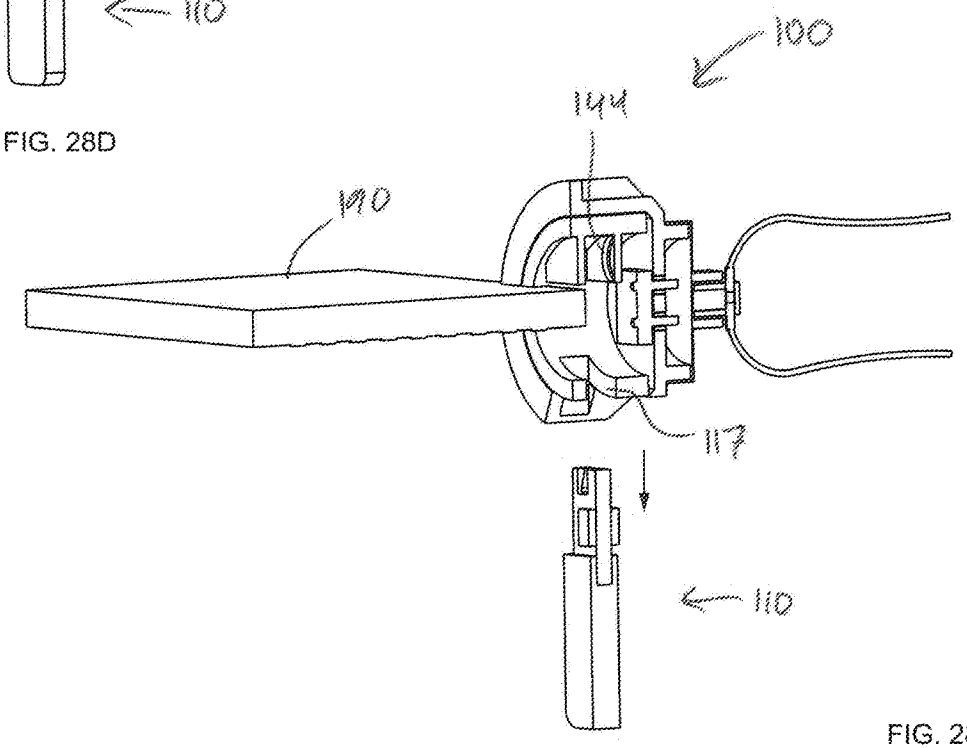
Figure 29A:
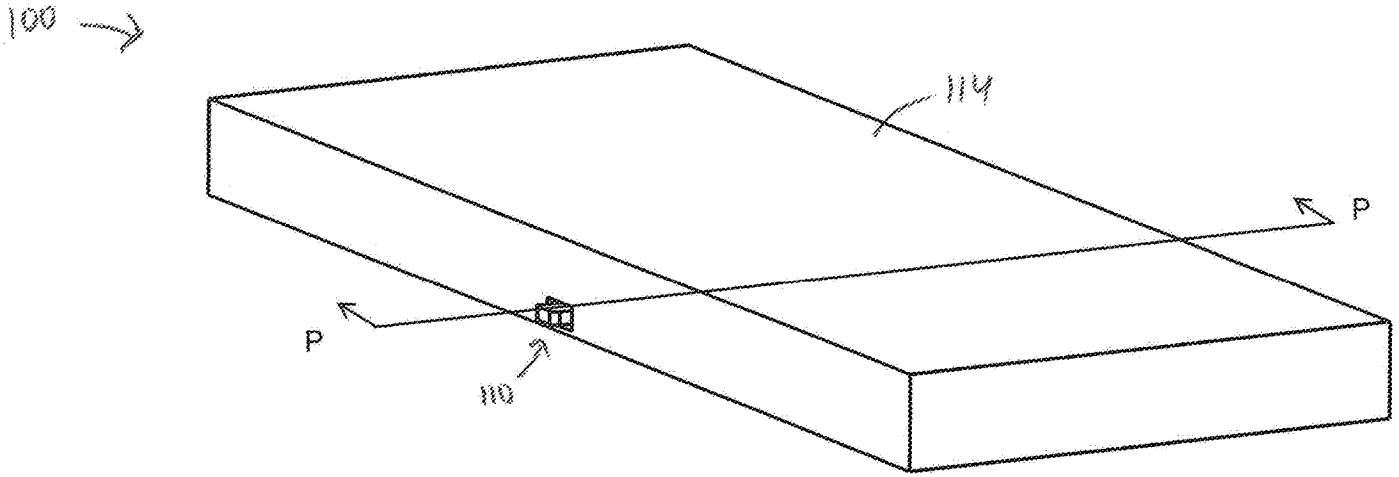
Figure 29B:
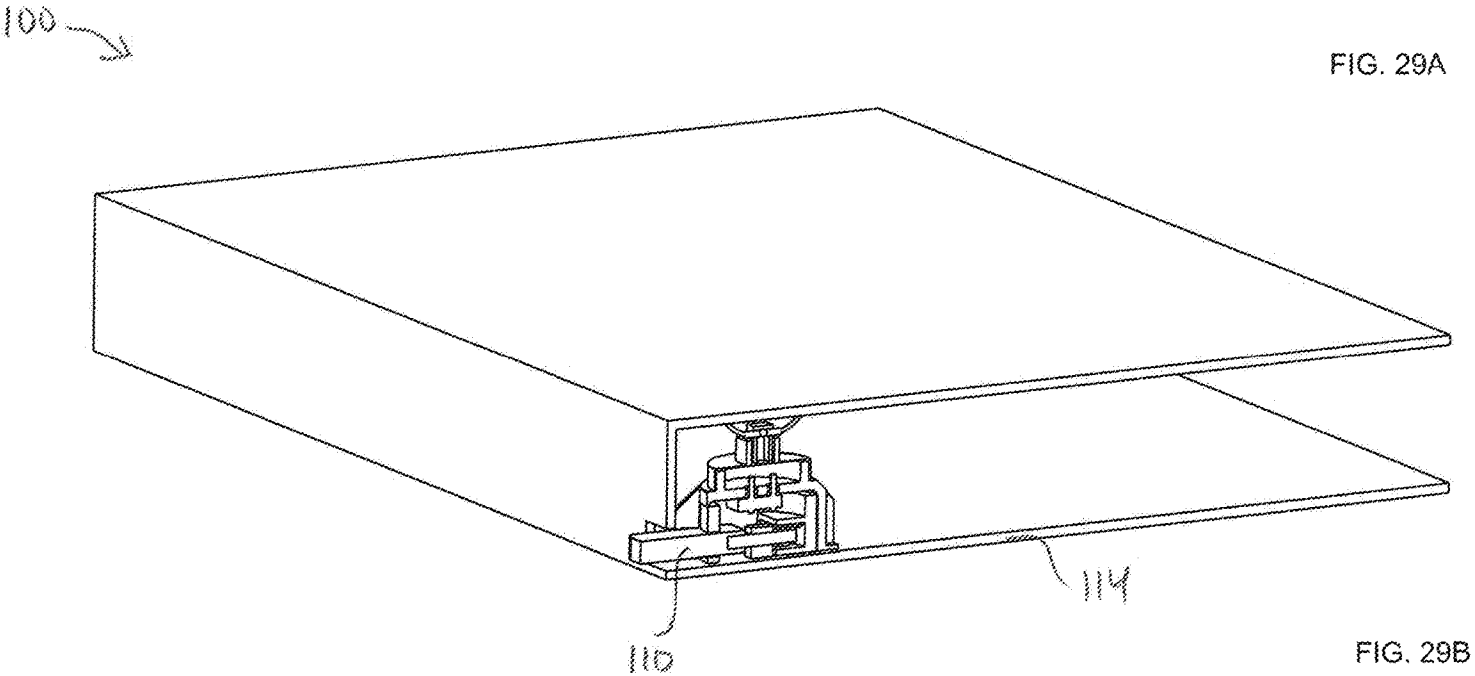
Figure 29C:
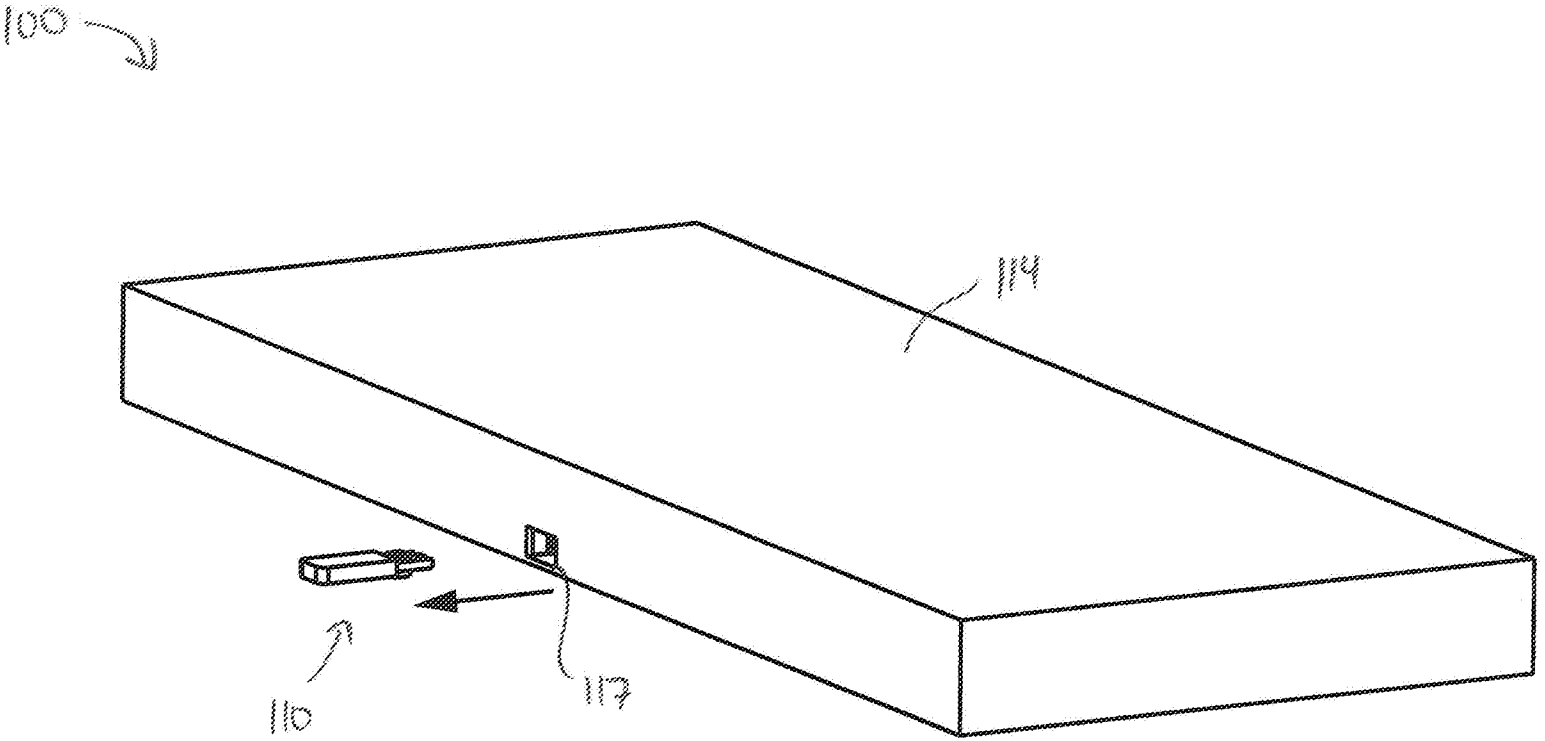
Figure 30A:
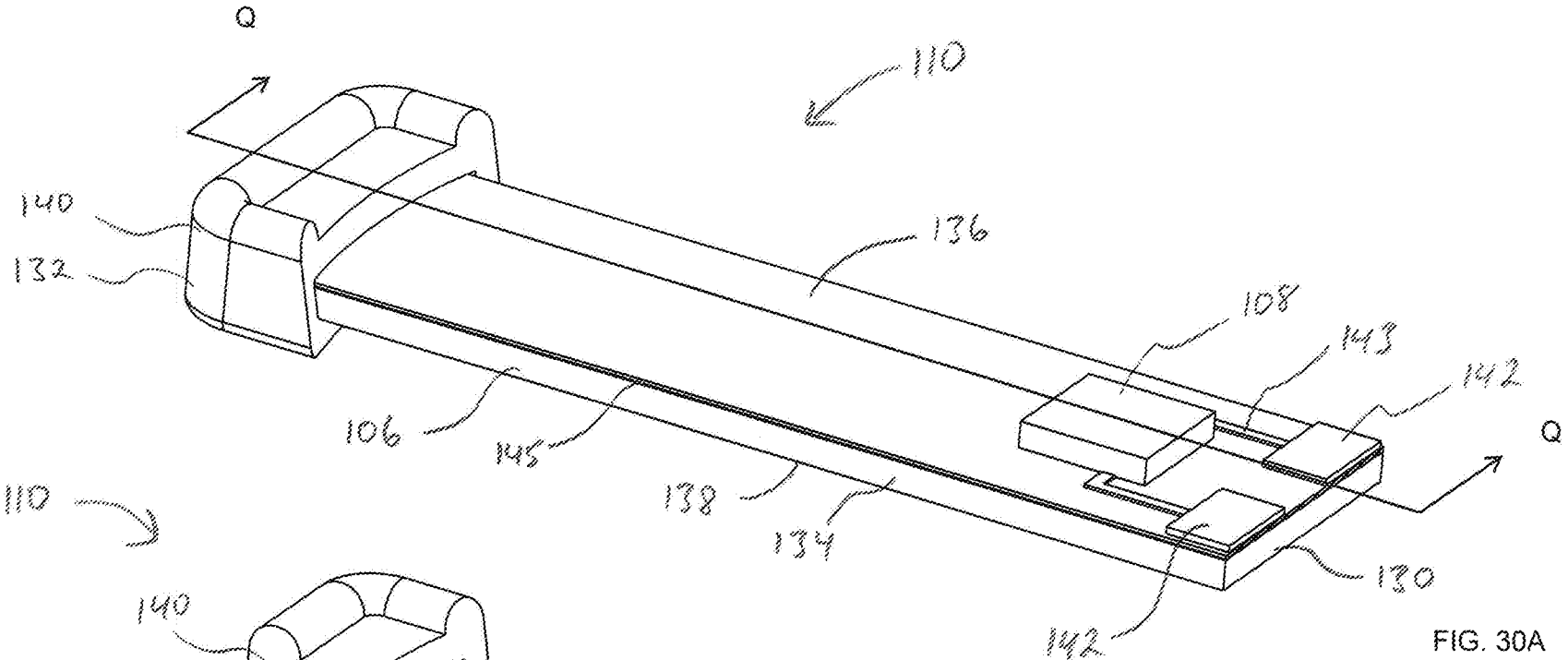
Figure 30B:
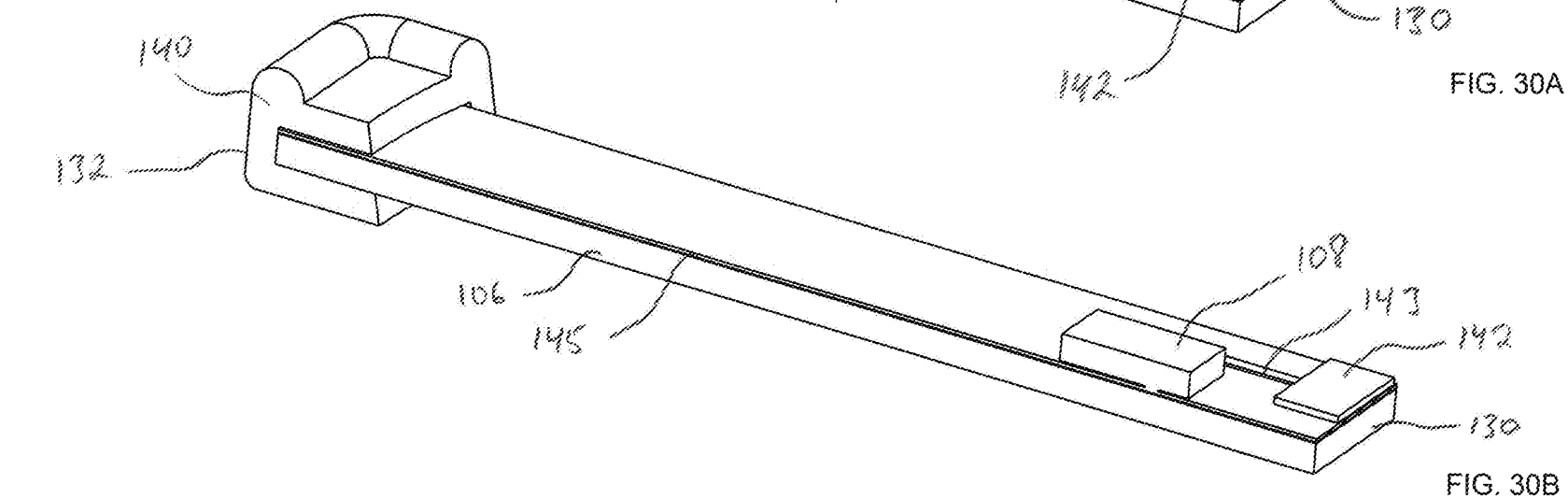
Figure 30E:
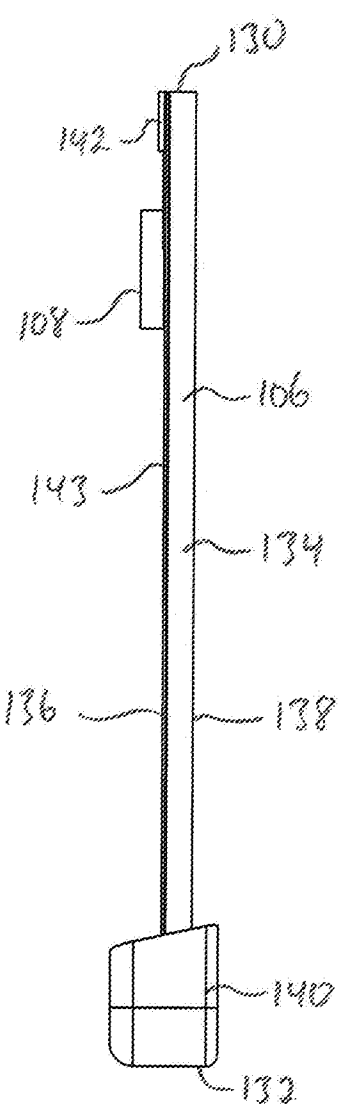
Figure 30D:
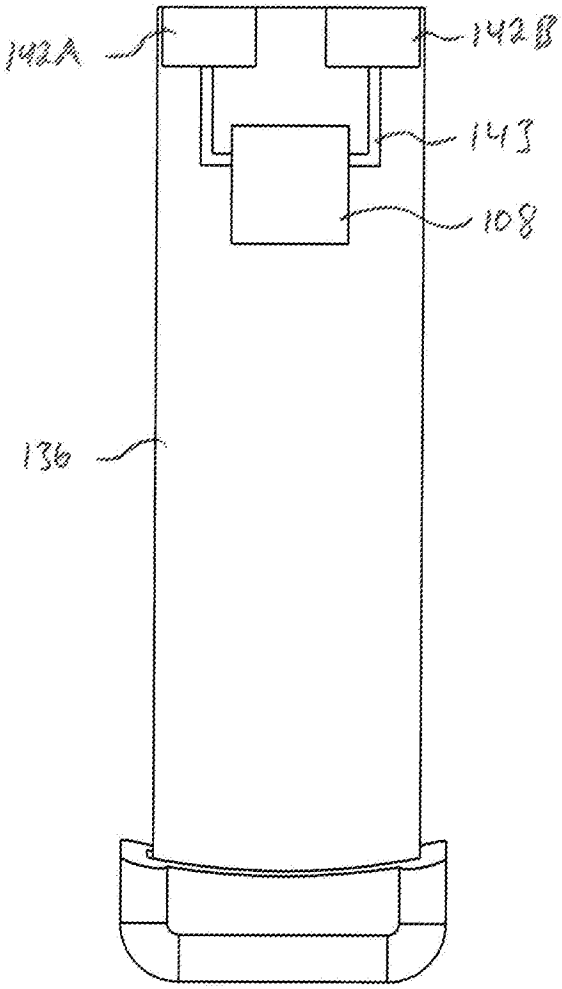
Figure 30C:
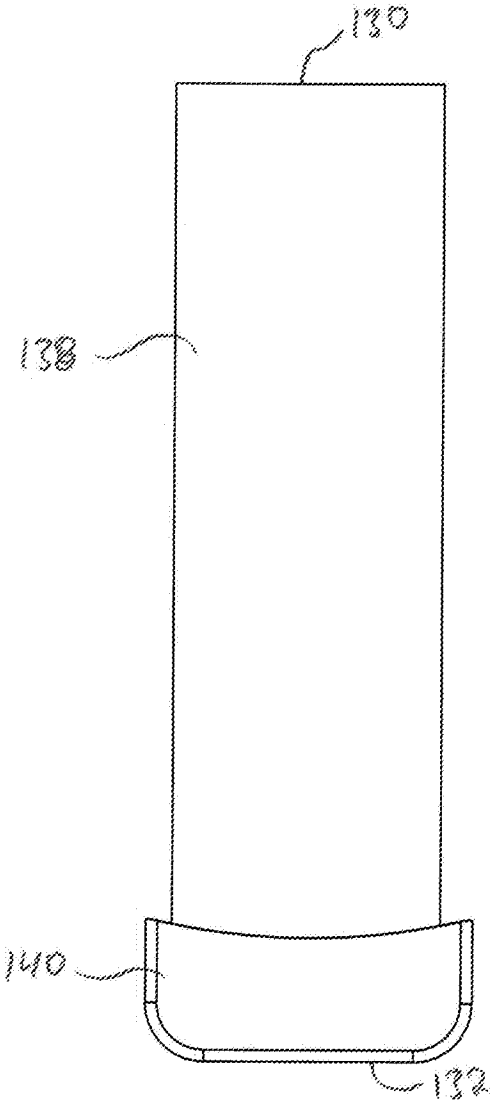
Figures 32A, 32B, 32C, 32D:
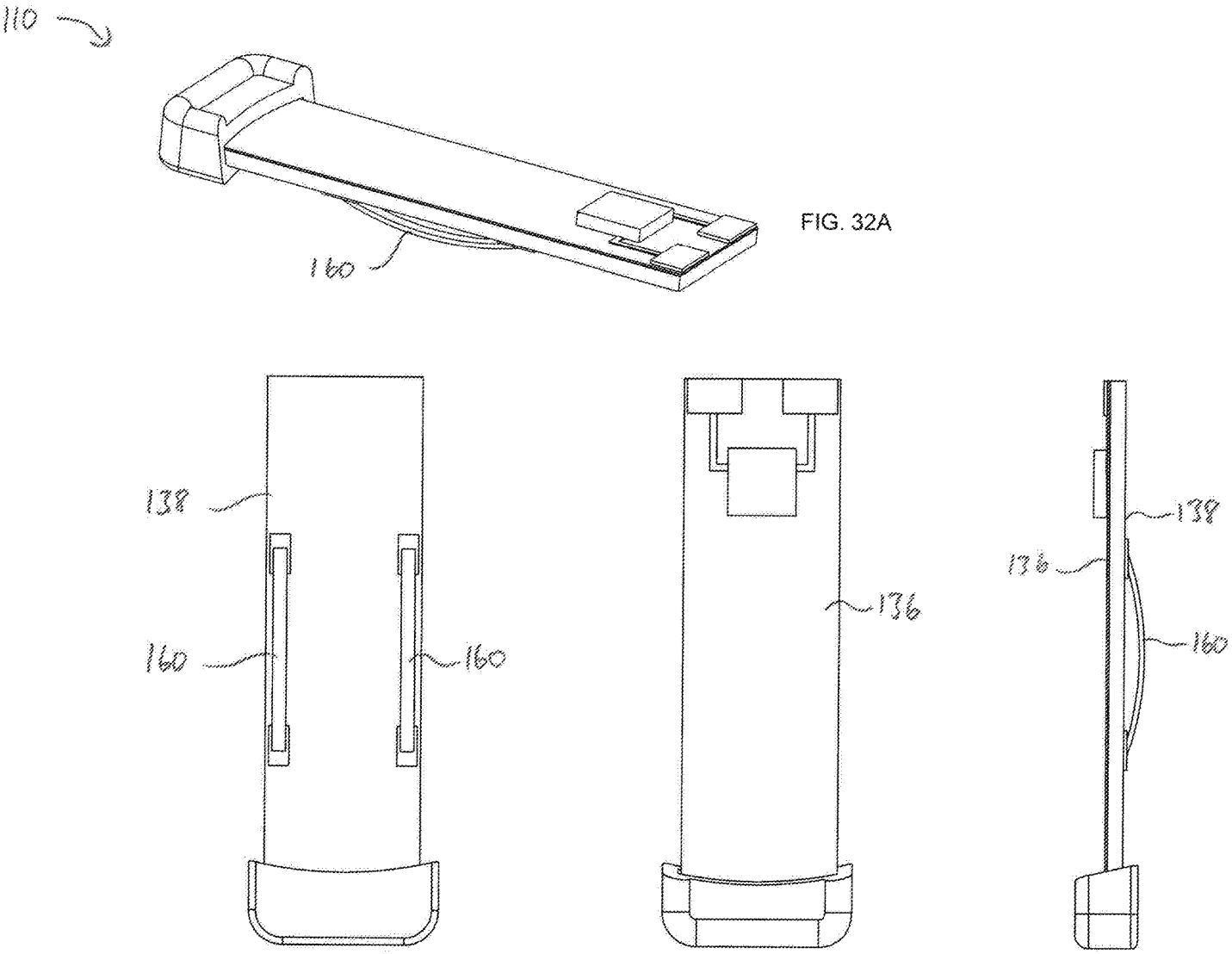
Figures 33A, 33B, 33C, 33D:
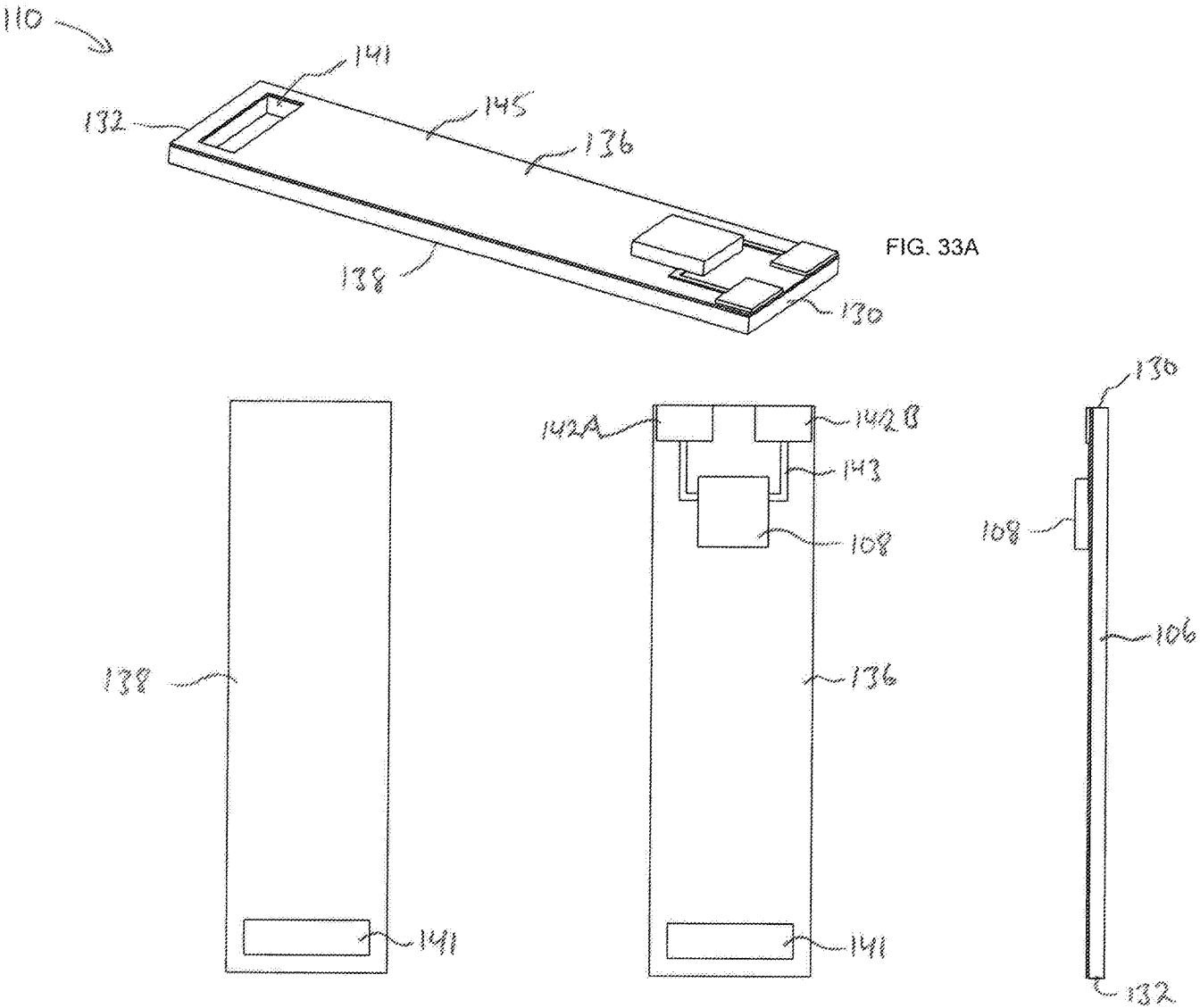
Figures 34A, 34B, 34C, 34D:
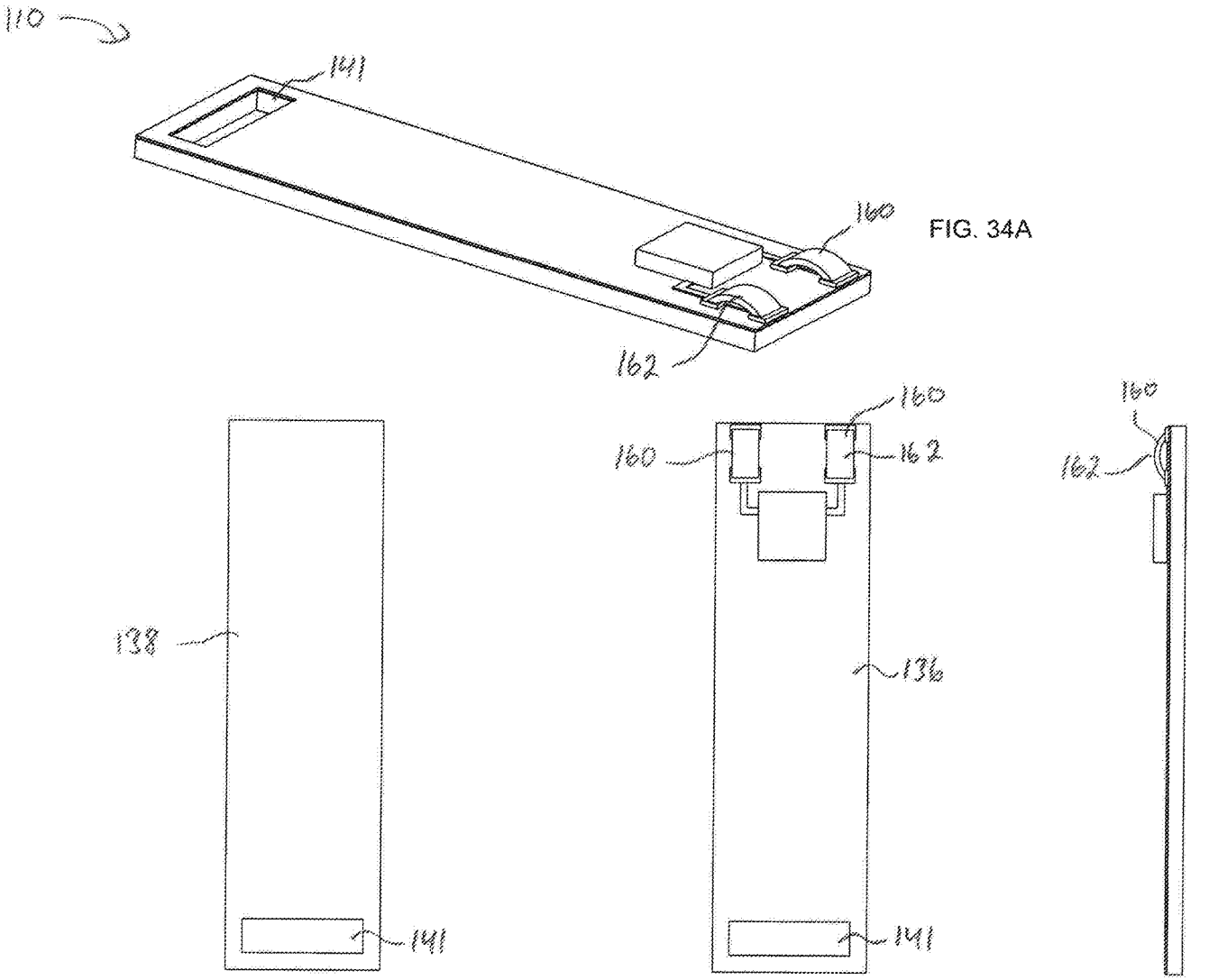

FIG. 28A shows a perspective view of another light source;

FIG. 28B shows a perspective view of the light source of FIG. 28A;

FIG. 28C shows a cross-sectional view of the light source of FIG. 28B along the line O1-O1 in FIG. 28B;

FIG. 28D shows a perspective view of the light source of FIG. 28A with the cartridge removed;

FIG. 28E a cross-sectional view of the light source of FIG. 28D along the line O2-O2 in FIG. 28D;

FIG. 29A shows a perspective view of another light source, which may function as a shelf or table top;

FIG. 29B shows a cross-sectional view of the light source of FIG. 29A along the line P-P in FIG. 29A;

FIG. 29C shows a perspective view of the light source of FIG. 29A with the cartridge removed;

FIG. 30A shows a perspective view of a cartridge;

FIG. 30B shows a cross-sectional view of the cartridge of FIG. 30A along the line Q-Q in FIG. 30A;

FIGS. 30C-30E show bottom, top, and side views respectively of the cartridge of FIG. 30A;

FIG. 31A shows a perspective view of another cartridge;

FIGS. 31B-31D show bottom, top, and side views respectively of the cartridge of FIG. 31A;

FIG. 32A shows a perspective view of another cartridge;

FIGS. 32B-32D show bottom, top, and side views respectively of the cartridge of FIG. 32A;

FIG. 33A shows a perspective view of another cartridge;

FIGS. 33B-33D show bottom, top, and side views respectively of the cartridge of FIG. 33A;

FIG. 34A shows a perspective view of another cartridge; and,

FIGS. 34B-34D show bottom, top, and side views respectively of the cartridge of FIG. 34A.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

General Light Source Features

Figure 1B:
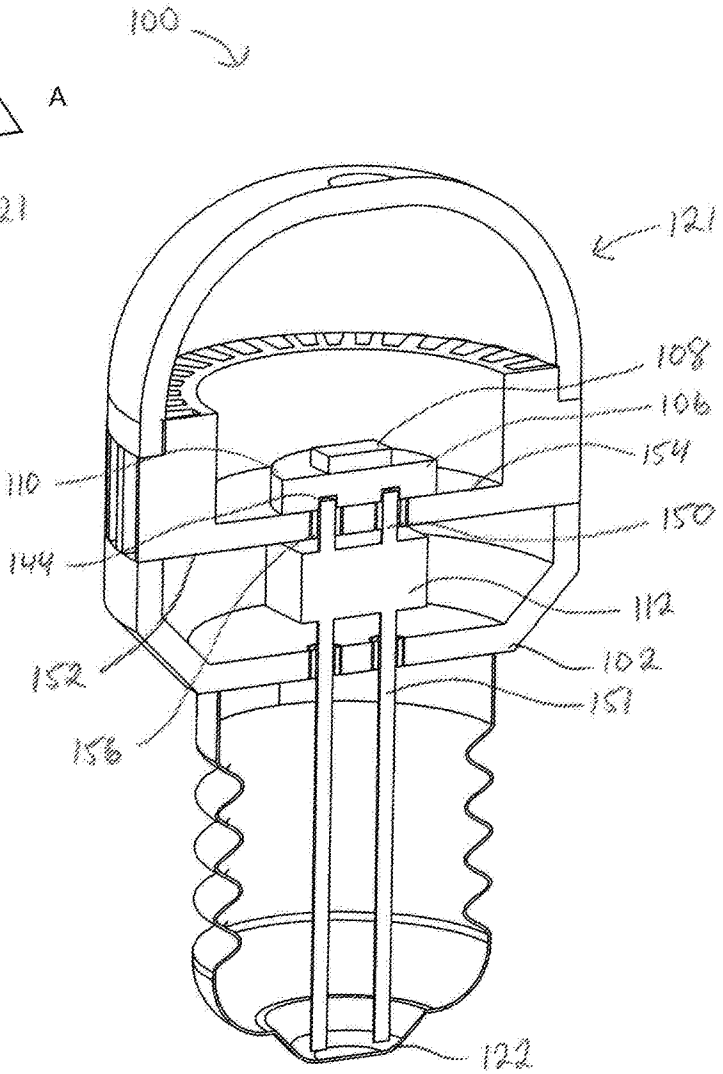
FIG. 1B shows a cross-sectional view of the light source of FIG. 1A along the line A-A in FIG. 1A.
Figure 1A:
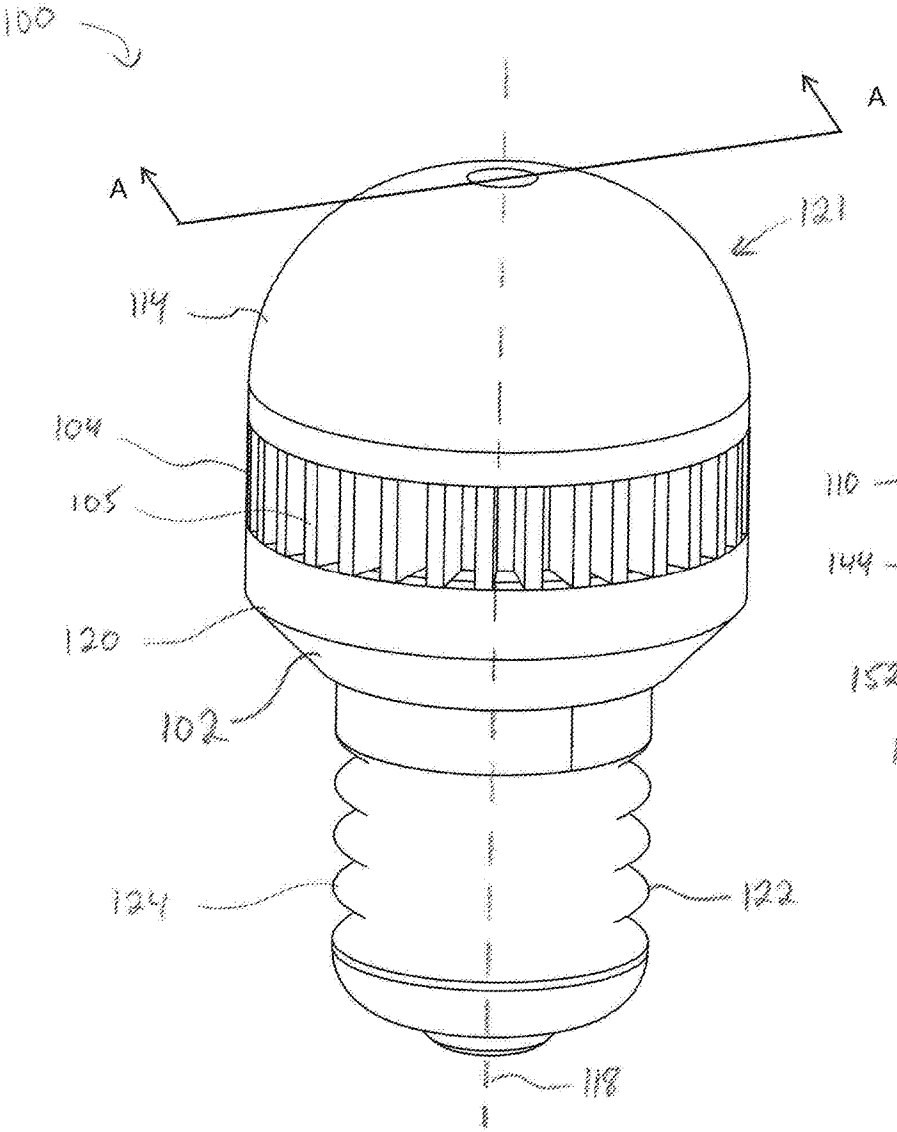
FIG. 1A shows a perspective view of a light source, which may be referred to as a light bulb.
Figure 1D:
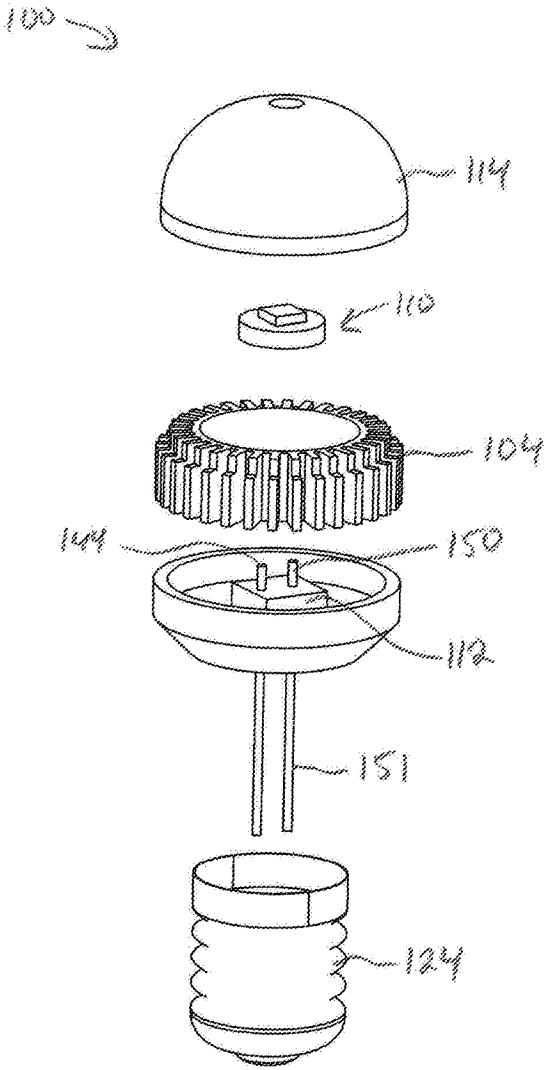
FIG. 1D shows an exploded view of the light source of FIG. 1A.
Figure 1C:
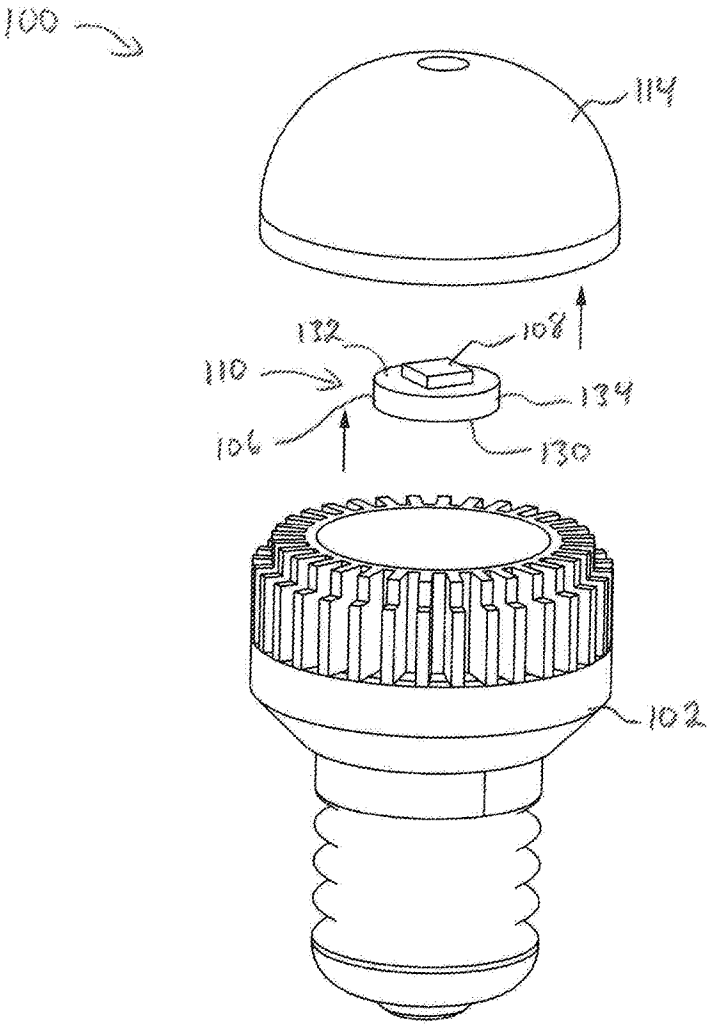
FIG. 1C shows a perspective view of the light source of FIG. 1A with the cartridge removed.
Figure 2B:
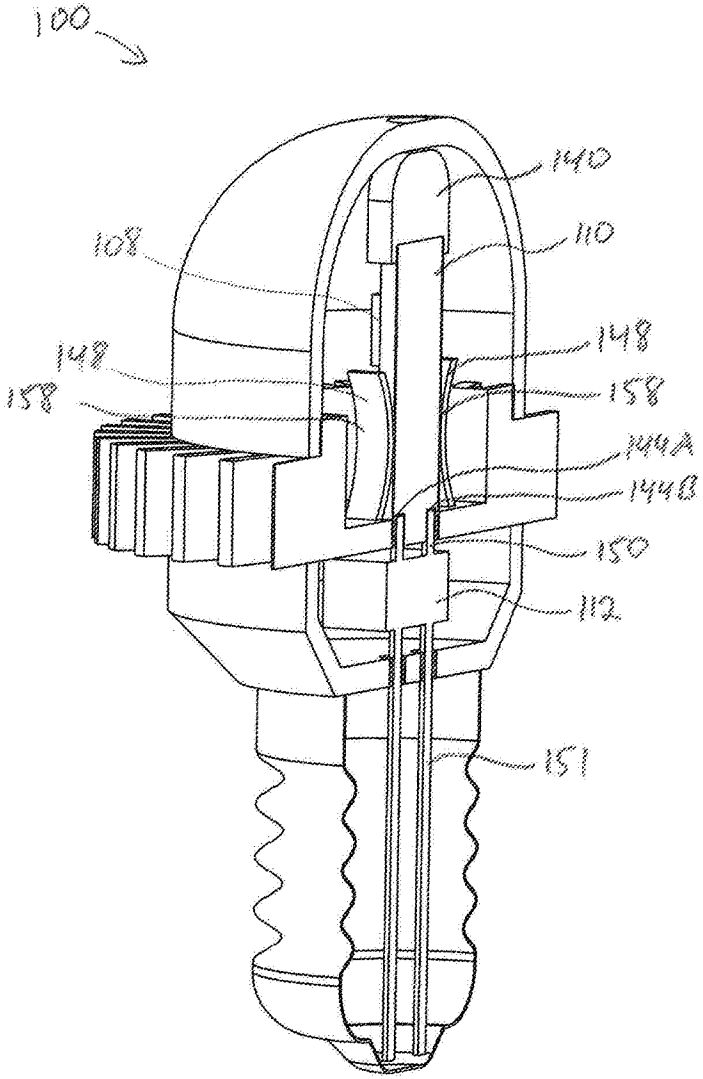
FIG. 2B shows a cross-sectional view of the light source of FIG. 2A along the line B-B in FIG. 2A.
Figure 2A:
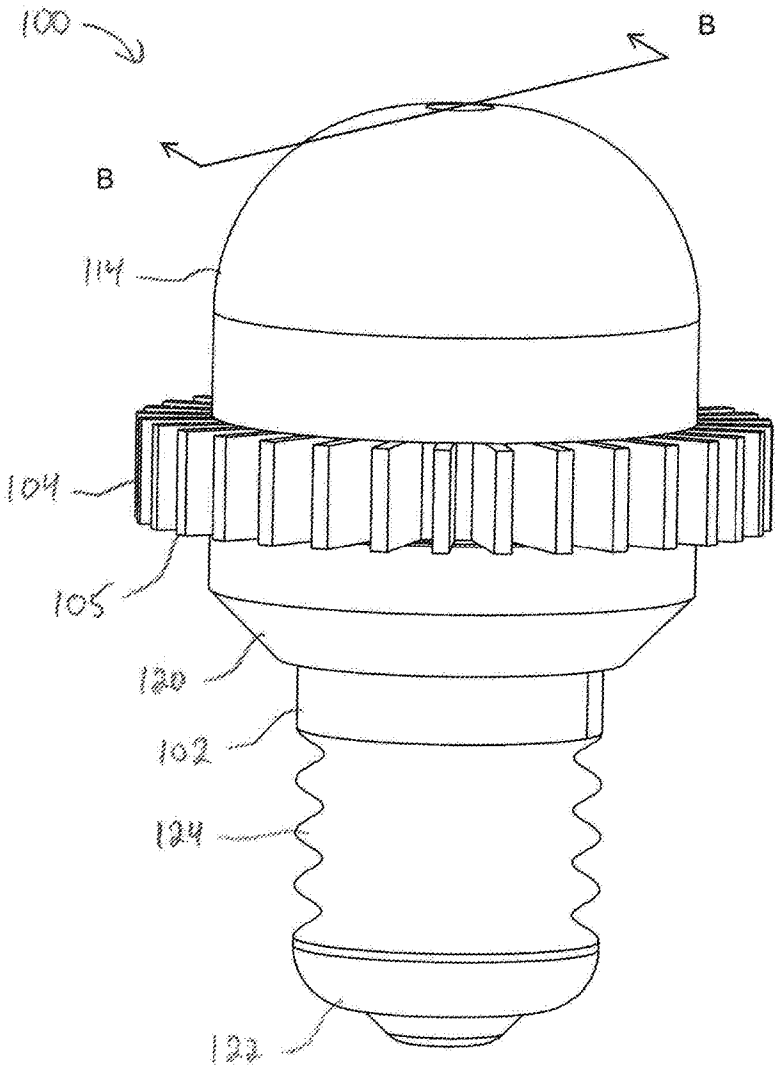
FIG. 2A shows a perspective view of another light source.
Figure 2D:
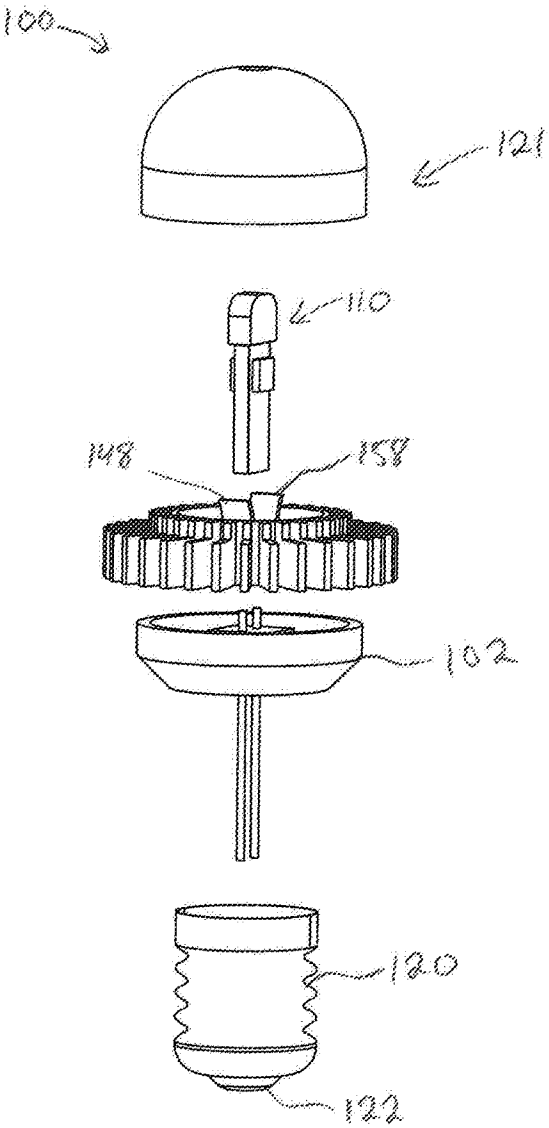
FIG. 2D shows an exploded view of the light source of FIG. 2A.
Figure 2C:
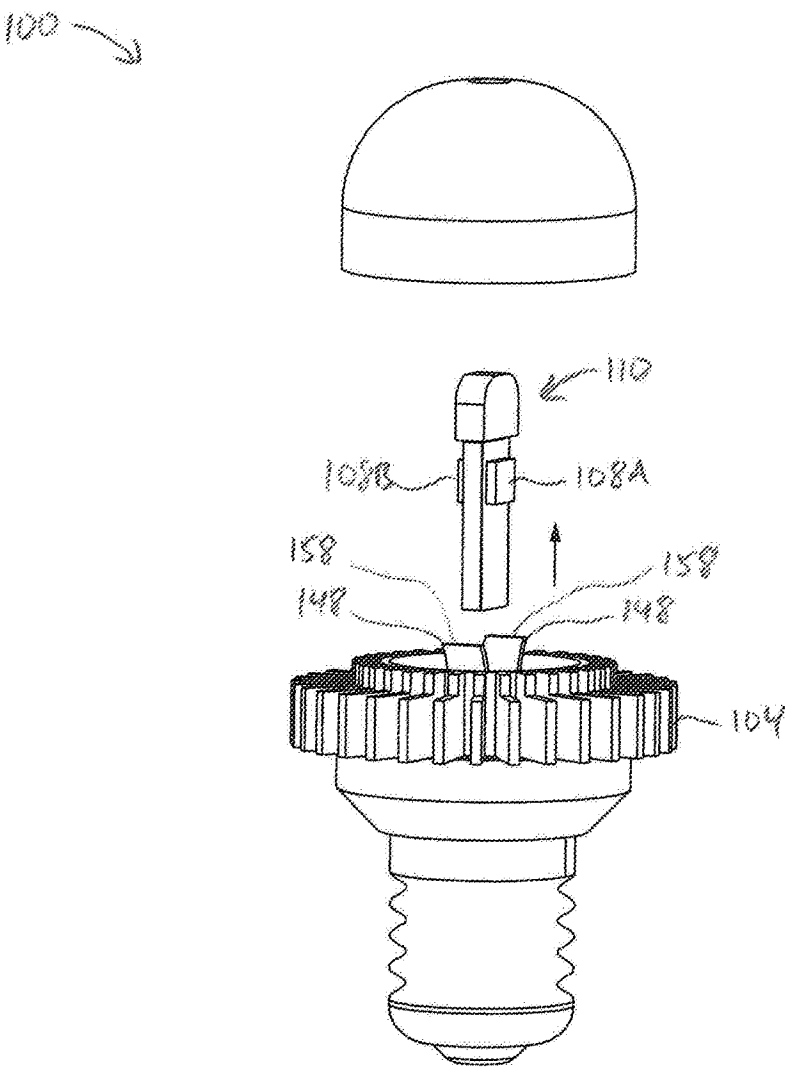
FIG. 2C shows a perspective view of the light source of FIG. 2A with the cartridge removed.

Referring to FIG. 1A, an exemplary embodiment of a light source 100 is shown. As exemplified in FIGS. 1A-29C, the light source 100 has a main body 102. The main body 102 has a heat sink 104. The light source 100 has a removable substrate 106. The substrate 106 has at least one light emitting member 108. Together, the substrate 106 and the at least one light emitting member 108 may be referred to as a cartridge 110, as exemplified in FIGS. 30A-34D.

The heat sink 104 may be of any design suitable for dissipating heat generated by cartridge 110, and, in particular, heat generated by the light emitting member 108. As illustrated, the heat sink 104 may have a plurality of fins 105, which may extend radially from the light source 100. In some embodiments, the heat sink 104 may be mounted to the main body 102 such that the heat sink 104 forms part of an exterior surface of the light source 100.

Accordingly, the cartridge 110 may be in thermal communication with the heat sink 104 such that heat generated by the cartridge 110 may be dissipated. For example, the light source 100 may have thermal contacts for connecting the heat sink 104 to the cartridge 110. Alternatively, or in addition, a surface of the cartridge 110 may make direct thermal contact with the heat sink 104 to facilitate heat transfer from the cartridge 110 to the heat sink 104.

In some embodiments, as shown in FIGS. 1A-27C and 29A-29C, the light source 100 may have a diffuser 114. The diffuser 114 may be used to soften the point effect of light emitted from the light emitting member 108, thereby providing a more even distribution of light. Diffuser 114 is at least translucent (i.e. at least semi-transparent). In other words, diffuser 114 is not completely opaque. In the illustrated examples, at least a portion of diffuser 114 is formed as a cover that is spaced apart from the light emitting member 108. The distance may allow the diffuser 114 to be relatively larger in area than the light emitting member 108, which can thereby enhance the light diffusion capability of diffuser 114.

The diffuser 114 may be made of any material suitable for diffusing light emitted by the light emitting member 108. For example, diffuser 114 may be made of at least one of acrylic, polypropylene, and polycarbonate. In some embodiments, the diffuser 114 may be white in color. This can reduce or eliminate the effect the diffuser 114 has on the color of the diffused light. In other embodiments, diffuser 114 may be intentionally non-white (e.g., blue, red, green, etc.) to provide a desired color effect.

The main body 102 may house a power supply 112. The power supply 112 is couplable to the cartridge 110 such that when the power supply 112 is connected to a source of power, the light emitting member 108 emits light.

Accordingly, the light source 100 may have at least one electrical contact member 144 for providing an electrical connection between the cartridge 110 and the power supply 112. In some embodiments, the light source 100 may have a plurality of electrical contact members 144. To complete the circuit from the power source to the light emitting member 108, when the substrate 106 is placed in the light source 100, the electrical contact members 144 may be in contact with a conductive part of the substrate 106. For example, the electrical contact members 144 may electrically connect with at least one substrate contact 142 located on or within the cartridge 110. When the power supply 112 is connected to a power source, electrical current may pass from the power supply 112, through the electrical contact members 144, to the at least one light emitting member 108 such that the at least one light emitting member 108 emits light.

It will be appreciated that the cartridge 110 may be secured within the light source 100 by any securing means capable of facilitating the electrical and/or thermal connection between the at least one light emitting member 108 and the power supply 112 and/or the heat sink 104. For example, the light source 100 may be shaped to receive the cartridge 110, such that the cartridge 110 is secured in place. Alternately, or in addition, the light source 100 may have at least one mechanical securing member to secure the cartridge 110 into position within the light source 100.

Exemplary Uses of the Light Source

It will be appreciated that the light source 100 may be used in any number of applications. For example, the light source may be used as a replacement for an existing incandescent light bulb, a pot light bulb, or any other light bulb or light source in common use. It will therefore be appreciated that the light source 100 may be designed to be removably receivable in an existing light housing or socket. Accordingly, as exemplified in FIGS. 1A-17C and FIGS. 25A-26F, the light source 100 may be configured similar to any typical incandescent light bulb, and may have a screw base so that it may be inserted into a standard light housing, such as a lamp. As exemplified in FIGS. 18A-24O, the light source 100 may be configured similar to any typical pot light. As exemplified in FIGS. 17A-27C, the light source 100 may be a street light. As exemplified in FIGS. 28A-29C, the light source 100 may be a shelf light. It will therefore be appreciated that, in various embodiments, the light source 100 may be used in a flashlight, table lamp, desk lamp, wall light, ceiling mounted fixture, or any other lighting application.

In some embodiments, the main body 102 of the light source 100 may have a light emitting end 121 and a base end 122 connectable to a source of current. The light emitting end 121 may be opposed to the base end 122 with a central axis 118 extending between the base end 122 and the opposed light emitting end 121, such as in the case of incandescent and pot light bulbs.

In some embodiments, the main body 102 of the light source 100 may include a housing 120. The housing 120 may include the base end 122 that is connectable to a source of current. The base end 122 may be referred to as a power connector 122 for coupling the light source 100 to a power source. It will be appreciated that the power connector 122 may be any coupling capable of providing power to the light source 100. For example, the power connector 122 may be a socket 124, as exemplified in FIGS. 1A-8B, 10A-10E, 14A-17C, and 25A-26F or pins 126 as exemplified in FIGS. 9A-9E and 11A-13E. The socket 124 and/or the pins 126 may be any size and shape such that the light source 100 can be coupled to an existing light housing or fixture.

General Cartridge Structure

The following is a general description of a cartridge, which may be used by itself or in combination with any one or more other aspects discussed herein. The cartridge 110 may also be referred to as a light emitting body 110. As described previously, the cartridge 110 includes the substrate 106 and at least one light emitting member 108, as exemplified in FIGS. 30A-34D. The cartridge is a replaceable element and, accordingly, if one or more light emitting members 108 fail, then only the cartridge may be replaced. Accordingly, the remainder of the light source 100 may continue to be used by placing a new cartridge therein.

It will be appreciated that the substrate 106 may be made of any material capable of supporting a light emitting member 108. For example, the substrate 106 may be may of one or more of aluminum, epoxy, plastic, glass-reinforced epoxy laminate, etc. The substrate 106 may be made of any material used for the manufacture of a printed circuit board.

The substrate 106 may be any shape capable of being situated on or within the light source 100. For example, the substrate 106 may be thin and generally planar, which may enable the cartridge to be slideably receivable in the light source 100. Alternately, as exemplified in FIGS. 1A-1D, 12A-12D, and 18A-18D, the substrate 106 may be cylindrical. In some embodiments, the substrate 106 may have a thickness between 0.01 inches to 0.05 inches.

While the light emitting member 108 may be referred to herein as a single light emitting member 108, it will be appreciated that in any embodiment the cartridge 110 may have a plurality of light emitting members 108.

It will be appreciated that the light emitting member 108 may be any source of light. For example, the light emitting member 108 may be electroluminescent. In some embodiments, the light emitting member 108 may be one or more light emitting diodes (LEDs).

Disassembly of the Light Source

The following is a description of a light source using at least one removable component, which may be used by itself or in combination with any one or more other aspects discussed herein. In other words, the light source may be disassembleable, such as one portion being detachable from another. An advantage of this aspect is that, should a component of the light source need replacement, the light source may be at least partially disassembled to allow for the replacement of a single component and reuse of other components rather than replacement of the entire light source.

For example, one or more of the heat sink 104, the diffuser 114, the power supply 112 and the power connector 122 may be removable or separately removable from the main body 102. A user may then fix or replace a component of the light source 100 without replacing the entire light source 100.

In some embodiments, components of the main body 102 may be sequentially removable. For example, the diffuser 114 may be removably mounted to the heat sink 104. To access the interior of the light source 100, the diffuser 114 may be removed from the light source 100. The heat sink 104 may then be subsequently removed from the light source 100.

In some embodiments, two or more of the components of the main body 102 may be concurrently removable from the light source 100. For example, the diffuser 114 may be removably mounted to the heat sink 104, and the heat sink 104 may be removably mounted to the light source 100. The heat sink 104 and the diffuser 114 may be removed concurrently from the light source 100. Upon their joint removal, the diffuser 114 may then be separated from the heat sink 104.

If the light source is disassembleable (openable), then the light source 100 may include a locking mechanism 210 operable between a locked position and an unlocked position. When in the locked position, the light source is not disassembleable and, if a portion of the light source must be removed to remove the cartridge, then the cartridge 110 may not be removable from the light source 100. When in the unlocked position, a portion of the light source may be removed (e.g., the diffuser), which may then permit the cartridge 110 to be removable from the light source 100.

It will be appreciated that various mechanical locking members may be used. As exemplified in FIGS. 3A-3D and 25A-25J, a pivotable clasp may be used. As exemplified therein, the locking mechanism 210 releasably secures the diffuser 114 to the housing 120. As exemplified in FIGS. 3A-3D and FIGS. 25A-25J, the locking mechanism 210 includes latches 212. The latches 212 have a longitudinally extending planar portion 214 and a clasp portion 216 perpendicularly extending from the planar portion 214. The latches 212 are hingably coupled to the main body 102 by hinges 218. During use, the clasp portion 216 couples with the diffuser 114 by clasping a protrusion 220 on the exterior surface of the diffuser 114, thereby securing the locking mechanism 210 in place. As exemplified, the diffuser 114 is positioned on the heat sink 104. Once the locking mechanism 210 is moved to the unlocked position, the diffuser 114 may be removed to provide access to the cartridge 110. Alternately, a bayonet mount, screw mount, or the like may be used.

Removable Power Supply

The following is a description of a light source using a removable power supply, which may be used by itself or in combination with any one or more other aspects discussed herein. An advantage of this aspect is that, should the power supply fail, the power supply may be removed and replaced without replacing the entire light source. Accordingly, this comprises one embodiment of a disassembleable light source.

For example, the power supply 112 may be removably receivable in the main body 102 of the light source 100. It will be appreciated that the power supply 112 may be removable by any manner from the light source 100. As described above, the power supply 112 may be separately, sequentially, or concurrently removable from the light source 100 and/or components of the main body 102. For example, the heat sink 104 and the power supply 112 may be concurrently removable from the main body 102, and, subsequent to their removal, the power supply 112 may be removable from the heat sink 104.

In some embodiments, the power supply 112 may be replaceable without removing the heat sink 104, as exemplified in FIGS. 6A-6E, 11A-11E, and 15A-17C. As exemplified in FIGS. 6A-6E, socket 124 may be removed (e.g., by being unscrewed) and the power supply 112 may then be removable downwardly from the body of the light source which has the heat sink and diffuser. As exemplified in FIGS. 11A-11E, socket 124 may be removed (e.g., by being unscrewed) and the power supply 112 may then be removable from the socket. As exemplified in FIGS. 15A-15E, the diffuser may be removed (e.g., by being unscrewed) and the power supply 112 may then be removable upwardly from the rest of the light source.

Insertion and Removal of the Cartridge

The following is a description of a light source using a removable cartridge, which may be used by itself or in combination with any one or more other aspects discussed herein. An advantage of this aspect is that, should the light emitting member require replacement due to the light emitting member failing, then only the cartridge may be replaced. The remaining components of the light source 100 need not be replaced.

It will be appreciated that the cartridge 110 may be removably receivable in the light source 100 by any manner that allows cartridge 110 to be powered and positioned to emit light from the light source 100. Additionally, the cartridge 110 may be receivable in the light source 100 by any manner that allows the cartridge 110, once positioned within the light source 100, to be in thermal communication with the heat sink 104. For example, the cartridge 110 may be insertable and/or removable without opening or otherwise disassembling the light source 100. Alternately, or in addition, the cartridge 110 may be insertable and/or removable while the light source 100 is installed in a light housing. Alternatively, or in addition, the cartridge 110 may be insertable and/or removable by opening or otherwise disassembling the light source 100.

The cartridge 110 may be secured in position in the light source by any means. For example, the cartridge may be slideably receivable in a recess 116, which may be provided in any part of the light source 100. For example, the recess 116 may be located in the heat sink 104 or the diffuser 114. Such an embodiment may be used whether cartridge 110 is insertable and/or removable without opening or otherwise disassembling the light source 100, or if the light source requires opening to remove the cartridge. It will be appreciated that, if the light source requires opening to remove the cartridge, then the cartridge may be secured in position in the light source by, e.g., placing the cartridge in an openable compartment or using mechanical securing members.

As exemplified in FIGS. 19A-26F, a slot 117 may be provided on any portion of the exterior surface of the light source 100 and the cartridge 110 may be slideably insertable into the light source (e.g., recess 116) via slot 117. As exemplified in FIGS. 19A-26F, the cartridge 110 is removably receivable in a side of the light source 100 that is accessible when the light source is secured in an electrical fixture. An advantage of this embodiment is that the cartridge 110 may be received by the light source 100 while the light source 100 is secured in an electrical fixture. In other words, the light source 100 need not be removed from a fixture to replace the cartridge 110. For example, as described previously, the light source 100 may be in the shape of a typical incandescent light bulb or a typical pot light, which would enable the light source to be interchangeable with an existing incandescent light bulb or pot light.

It will be appreciated that the slot 117 may be aligned with the recess 116 such that inserting the cartridge into the slot 117 will result in the cartridge being inserted into recess 116. The insertion direction of the cartridge 110 may be along, or generally parallel to, the central axis 118. For example, the cartridge 110 may be axially received in the light source 100 through the slot 117 located in the diffuser 114, as exemplified in FIGS. 7A-11E. In some embodiments, the cartridge 110 may be axially received through the rear end of the main body 102 where the power supply 112 may be located, as exemplified in FIGS. 13A-13E.

As described previously, a portion of the main body 102 may be openable and/or removable from the light source 100 to provide access for replacing a cartridge 110. Whether or not a slot 117 is provided, a portion of the main body 102 may be removable from the light source 100 to permit another component, such as the cartridge 110, heat sink 104, and/or the power supply 112, to be replaced.

FIGS. 1A-4C, 14A-15E, 17A-18D, and 25A-25J exemplify the diffuser 114 being removed to provide access to the cartridge. Alternately, or in addition, as exemplified by the removal of the socket 124 in FIGS. 5A-6E, and 16A-16D, the power connector 122 may be removed to provide access to the cartridge 110.

In some embodiments, the portion of the main body 102 that is removed from the light source 100 may be an openable portion of the housing 120. For example, the slot 117 of the housing 120 may be covered by an openable portion. When the openable portion is opened, the cartridge 110 may be removed through the openable portion. Accordingly, for example, an openable or removable door may be provided. When the door is opened or removed, a recess 116 may be accessible. An advantage of this feature is that the recess may be closed with a cartridge inserted thereby inhibiting dust entering into the interior of the light source.

In some embodiments, the light source 100 may include a seal 127. The seal 127 may provide an air, dust, and/or liquid barrier. The seal may be provided between disassembleable components. As exemplified in FIG. 3B, seal 127 is provided between the removable diffuser and the heat sink. Alternately, the seal 127 may be associated with the slot 117 that receives the cartridge 110. The seal 127 may provide an air, dust, and/or liquid barrier around the inlet to the recess 116. As exemplified in FIGS. 7B and 8B, the seal 127 may be provided on the cartridge 110 itself (e.g., the portion of the cartridge 110 that is in contact with the exterior of the light source 100) such that when the cartridge 110 is received by the light source 100, thereby preventing dust and/or liquid from entering the light source 100. It will be appreciated that the seal 127 may be positioned anywhere on or within the light source 100.

Cartridge Features

The following is a description of a cartridge, which may be used by itself or in combination with any one or more other aspects discussed herein.

As exemplified in FIGS. 30A-34D, the cartridge 110 may have an insertion end 130, a longitudinally opposed outer end 132, and a body portion 134 extending longitudinally between the insertion end 130 and the outer end 132. The body portion 134, may have first and second longitudinally extending surfaces 136, 138 on opposed sides of the body portion 134.

In order to facilitate manipulation of the cartridge, such as slideably inserting the cartridge into a light source 100, a portion of the cartridge 110, e.g., outer end 132, may have a handle 140 to allow for easy removal from and insertion into the light source 100. See for example FIGS. 2A-2D, 5A-11E, 13A-14F, 19A-32D. Alternately, or in addition, as exemplified in FIGS. 33A-34D, the cartridge 110 may have a cartridge slot 141 at or near the outer end 132. The cartridge slot 141 may allow for easy removal from the light source 100 without requiring a handle 140. It will be appreciated that the handle 140 may be removable from the cartridge 110. It will also be appreciated that the cartridge 110 may have both a handle 140 and a cartridge slot 141. As exemplified in FIG. 19A, the handle or slot may be positioned exterior to the light source when the cartridge is inserted into the light source.

It will be appreciated that the at least one light emitting member 108 may be positioned on any portion of the substrate 106. In some embodiments, as exemplified in FIGS. 2A-11E, 13A-14F, 20A-21H, 23A-25J, and 27A-29C, substrate 106 may have a plurality of light emitting members 108. As discussed subsequently, a first light emitting member 108A may be provided on first longitudinally extending surface 136 and a second light emitting member 108B may be provided on second longitudinally extending surface 138 (see for example FIG. 20F). Alternately, as exemplified in FIG. 24E, a plurality of light emitting members may be provided on each of the first and second longitudinally extending surfaces 136, 138. Alternately, as exemplified in FIG. 21D, a plurality of light emitting members may be provided on one of the first and second longitudinally extending surfaces 136, 138.

The substrate 106 may include any manner of providing an electrical connection between the light emitting member 108 and a power supply. For example, the substrate 106 may comprise or consist of a printed circuit board (PCB) 143. The PCB 143 allows the at least one light emitting member 108 to be electrically connected to at least one substrate contact 142, as exemplified in FIGS. 30A-34D. When the at least one substrate contact 142 is electrically connected to a power source, power is provided to the light emitting member 108 such that the light emitting member 108 emits light.

It will be appreciated that the substrate contact 142 may be positioned anywhere on the substrate 106 or on the light emitting member 108. Optionally, the contact(s) 142 are located at the insertion end 130. It will also be appreciated that the substrate contact(s) 142 may be any shape, material, and form capable of electrically coupling the cartridge 110 to the main body 102.

As exemplified in FIGS. 1A-4C, 11A-12D, 14A-14F, 18A-18D, and 25A-25J, there are two substrate contacts 142 located at the insertion end 130 of the substrate 106. In some embodiments, the substrate contact 142 may be located on the surface of the substrate 106, as exemplified in FIGS. 5A-6E, 10A-10E and 13A-13E. For example, substrate contact 142 may be a portion of the electrically conductive outer surface of the substrate that is positioned to engage contacts 144 of the light source (e.g., a portion of the electrically conductive portion of a PCB). Alternately, in some embodiments, the substrate contact 142 may be on a raised portion of the substrate 106, as exemplified in FIGS. 7A-9E, 15A-17C, 19A-24O, and 26A-34D.

As described above, the cartridge 110 may be received by the light source 100 in any manner or position. The substrate contact(s) 142 may be positioned such that, when cartridge 110 is inserted into position, the substrate contact(s) 142 are positioned in electrically communication with mating contact(s) 144 provided in the light source (e.g., the electrical contacts physically contact each other). Accordingly, when the cartridge 110 is inserted into the light source 100, the cartridge 110 may be concurrently electrically connected to the power supply 112 and secured to the light source 100. When cartridge 110 is secured to the light source 100, it may be said to be in a mounted position.

Electrical Contact Members

In some embodiments, as described previously, the main body 102 includes electrical contact members 144. The electrical contact members 144 include an electrically conductive body portion 146 that may electrically connect the cartridge 110 to the main body 102 when the cartridge 110 is received by the light source 100. For example, the electrical contact members 144 may electrically couple with the substrate contacts 142 such that power can be transmitted from the power supply 112 to the light emitting member 108.

It will be appreciated that the electrical contact members 144 may be any shape, material, and form capable of electrically coupling the cartridge 110 (contacts 142) to the main body 102. Electrical contact members 144 may be positioned and shaped to engage substrate contacts 142 when the cartridge is positioned in the light source.

In some embodiments, the electrical contact members 144 may include a first electrical contact member 144A and a second electrical contact member 144B. The electrical contact members 144A, 144B may contact the same side of cartridge 110 or, as exemplified in FIGS. 1A-4C and 10A-12D the electrical contact members 144A, 144B may contact opposed sides of cartridge 110. Accordingly, the first electrical contact member 144A may contact the surface of the first side 136 of the light emitting body 110 and the second electrical contact member 144B may contact the surface of the opposed side 138 of the light emitting body.

As exemplified in FIGS. 1A-4C, 10A-12D, 14A-14F, 18A-20G, 23A-25J, and 27A-29C, the first and second electrical contact members 144A, 144B may contact the insertion end 130 of the cartridge 110. Alternately, they may contact any other portion of cartridge 110 having substrate contacts 142.

Figure 3B:
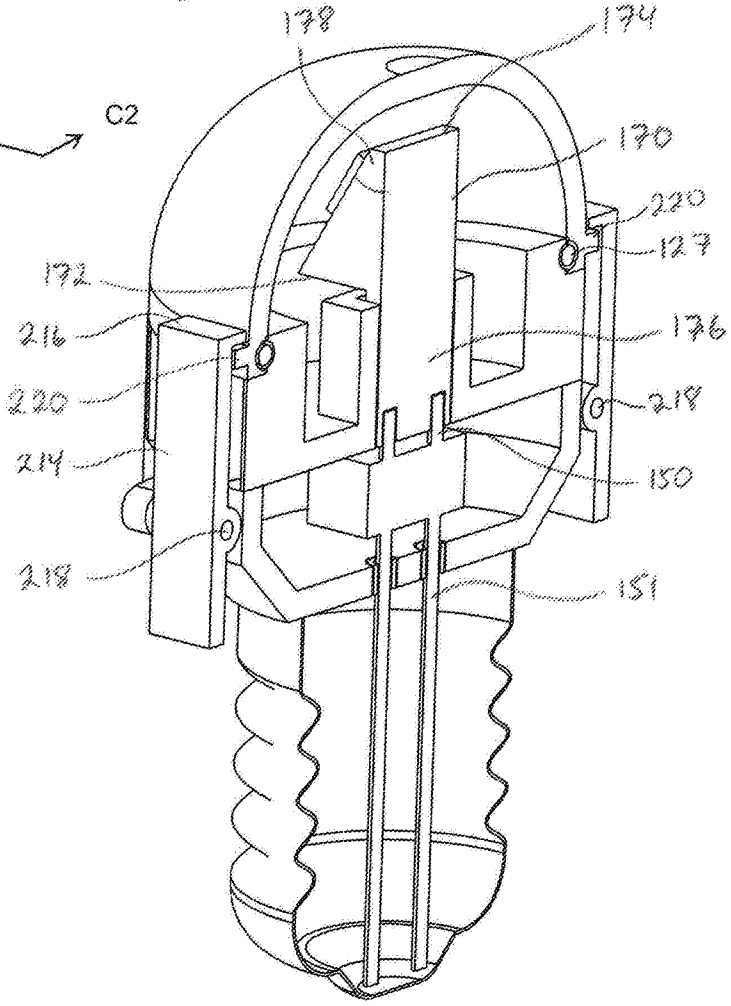
FIG. 3B shows a cross-sectional view of the light source of FIG. 3A along the line C1-C1 in FIG. 3A.
Figure 3A:
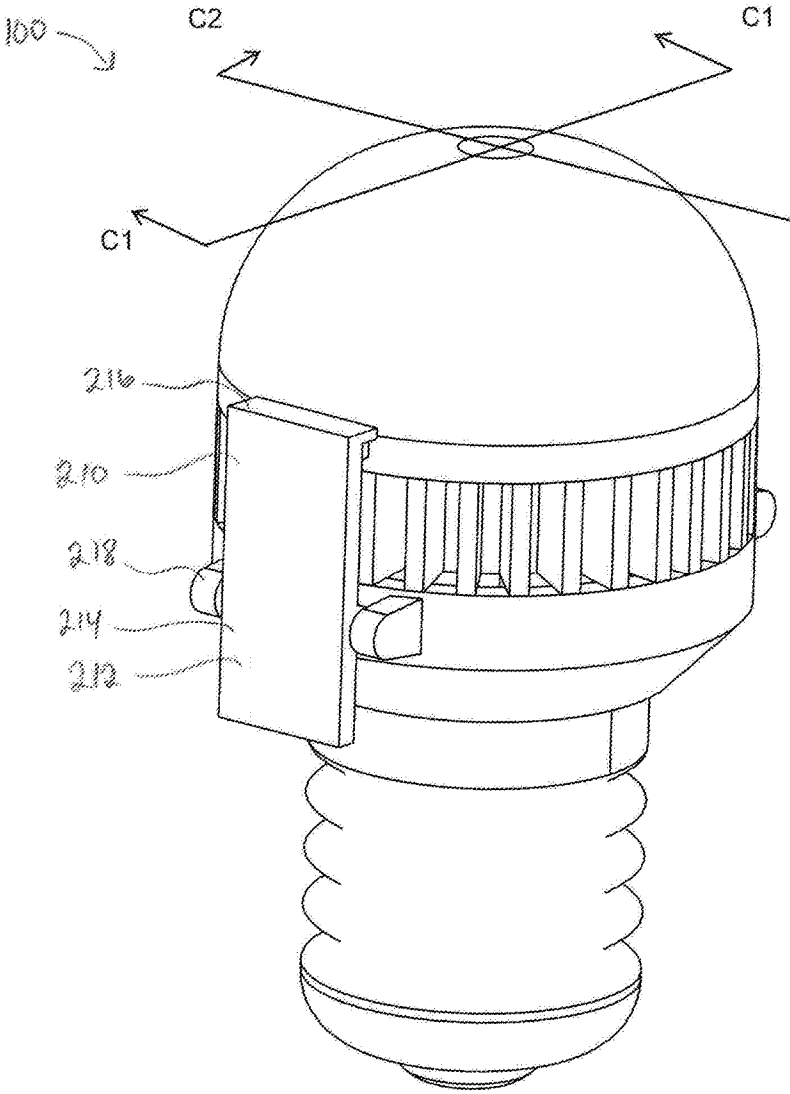
FIG. 3A shows a perspective view of another light source.
Figure 3D:
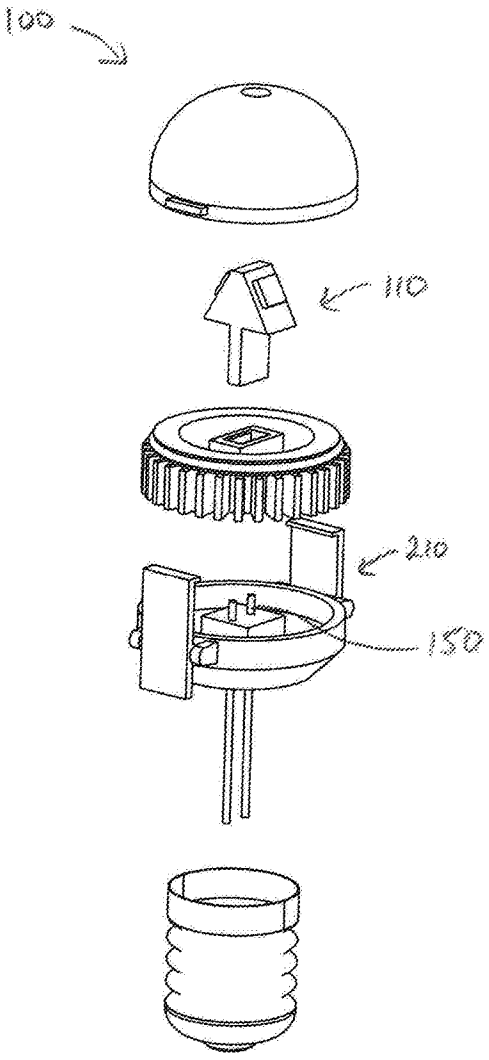
FIG. 3D shows an exploded view of the light source of FIG. 3A.
Figure 3C:
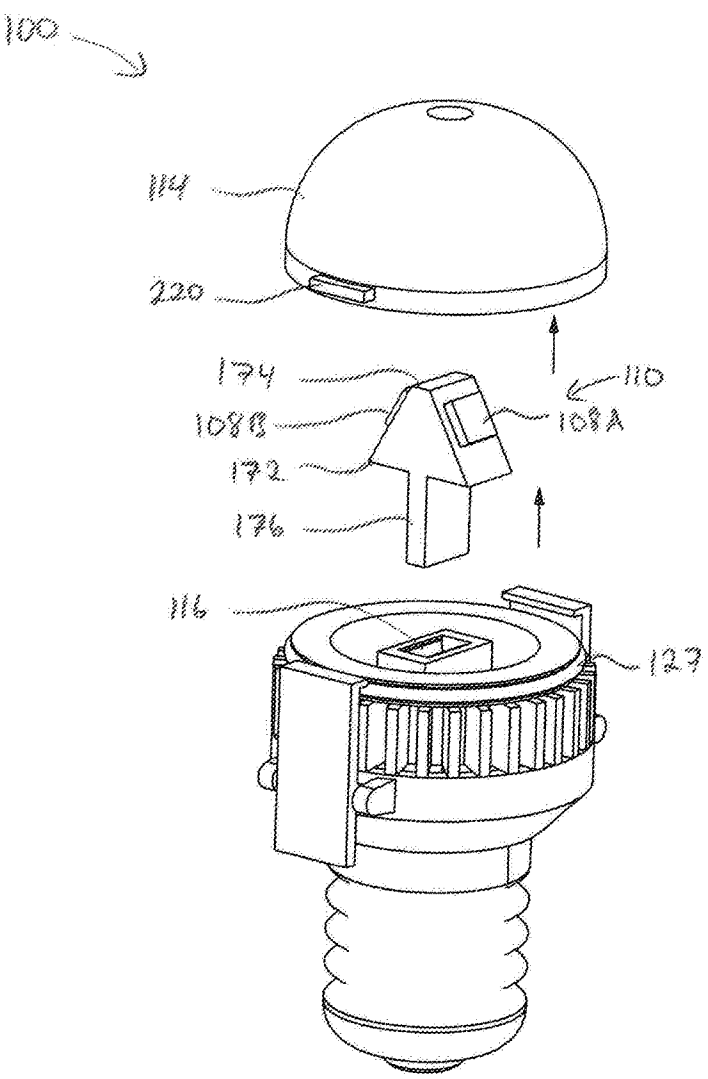
FIG. 3C shows a perspective view of the light source of FIG. 3A with the cartridge removed.
Figure 3F:
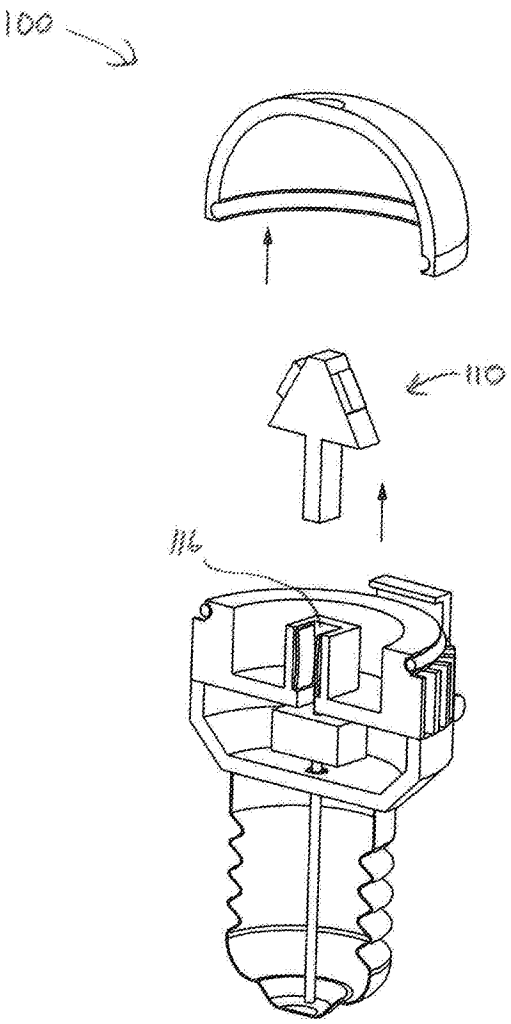
FIG. 3F shows an exploded cross-sectional view of the light source of FIG. 3E along the line C2-C2 in FIG. 3A.
Figure 3E:
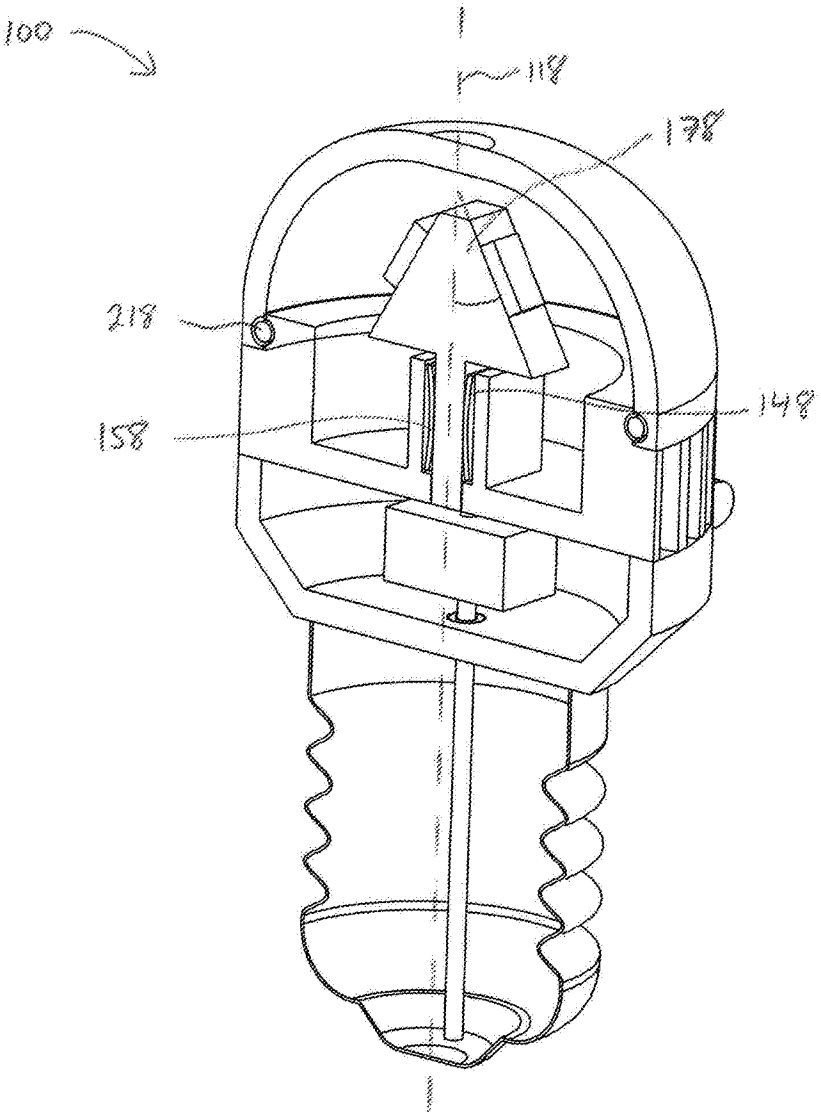
FIG. 3E shows a cross-sectional view of the light source of FIG. 3A along the line C2-C2 in FIG. 3A.
Figure 4C:
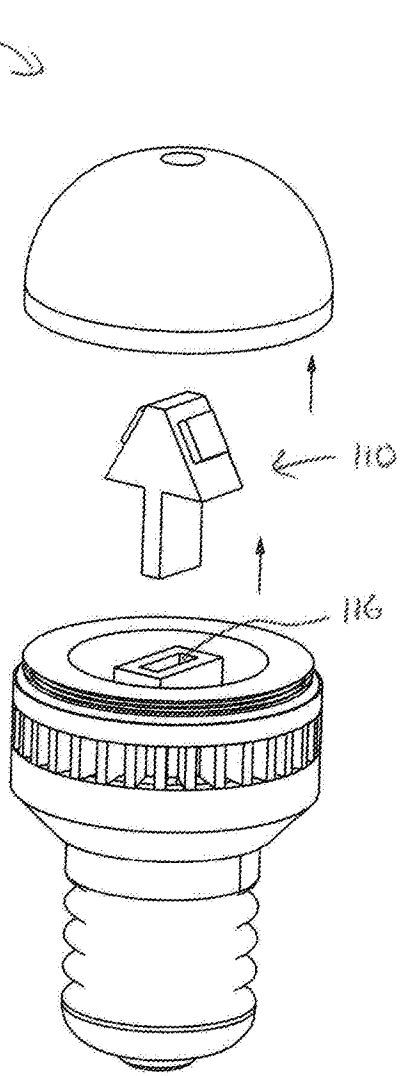
FIG. 4C shows a perspective view of the light source of FIG. 4A with the cartridge removed.
Figure 4B:
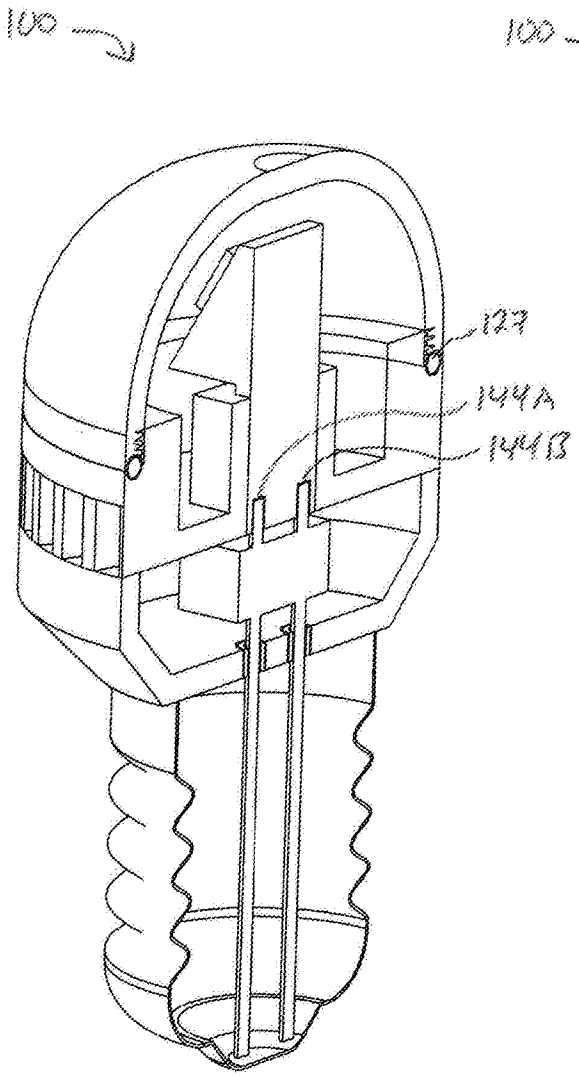
FIG. 4B shows a cross-sectional view of the light source of FIG. 4A along the line C3-C3 in FIG. 4A.
Figure 4A:
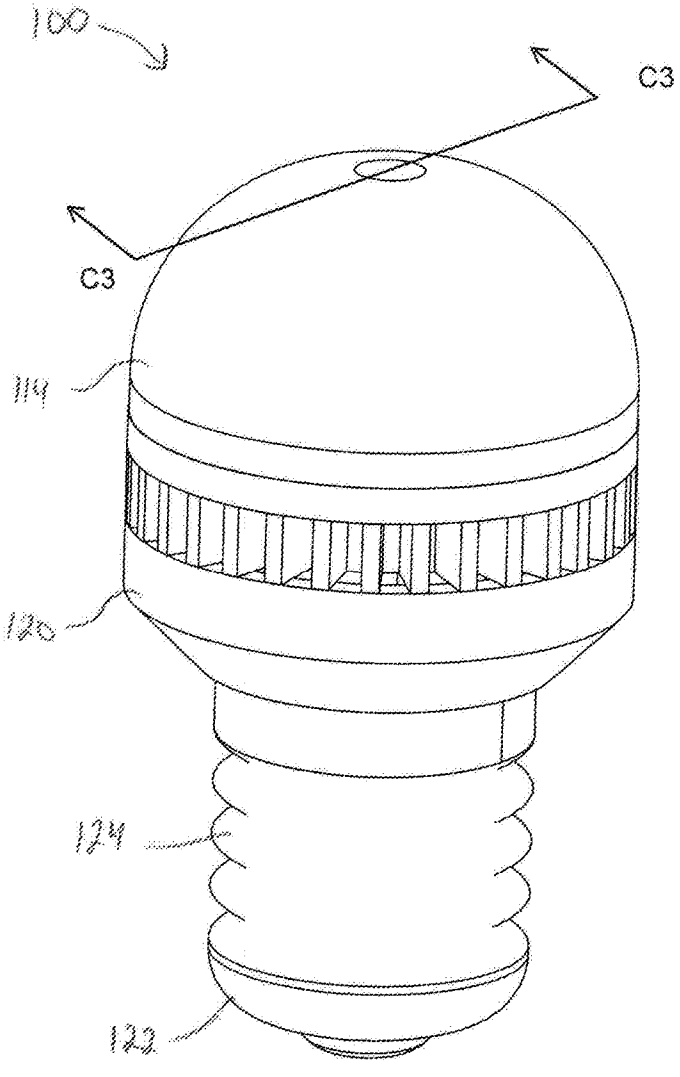
FIG. 4A shows a perspective view of another light source.
Figure 5B:
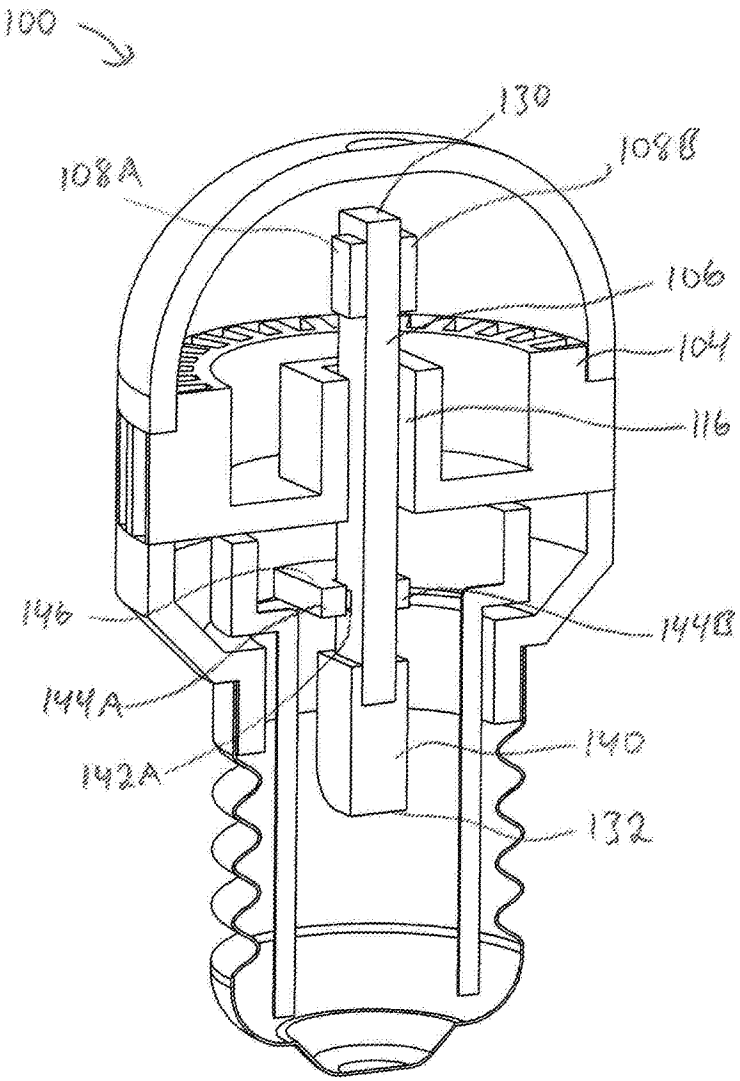
FIG. 5B shows a cross-sectional view of the light source of FIG. 5A along the line D1-D1 in FIG. 5A.
Figure 5A:
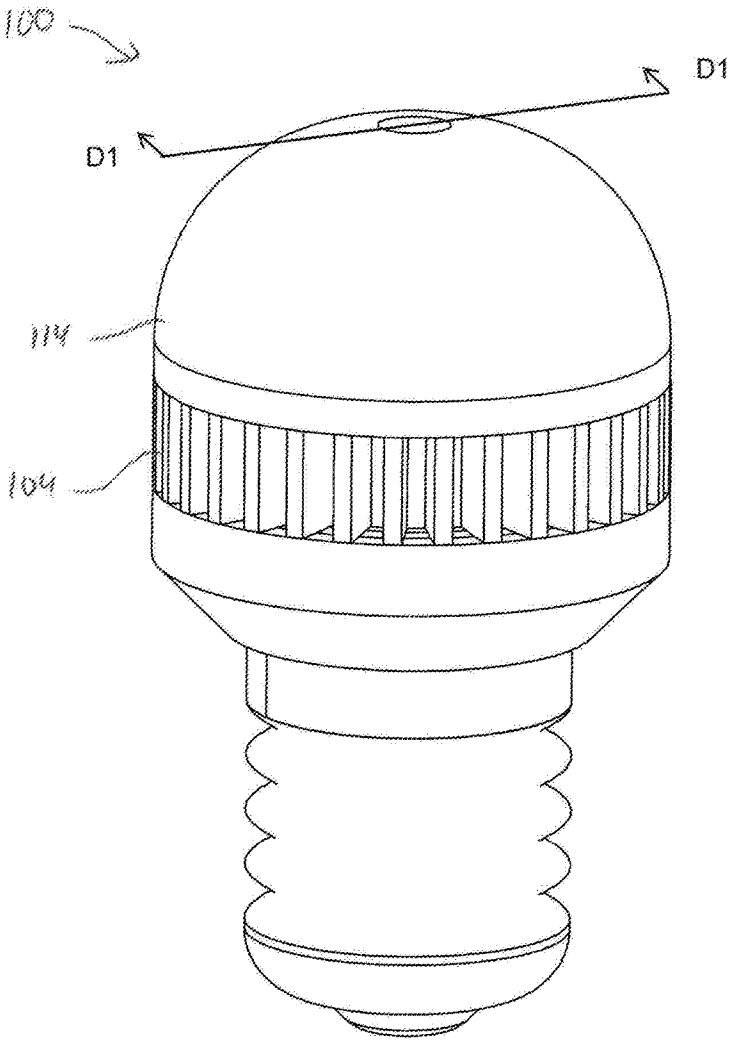
FIG. 5A shows a perspective view of another light source.
Figure 5E:
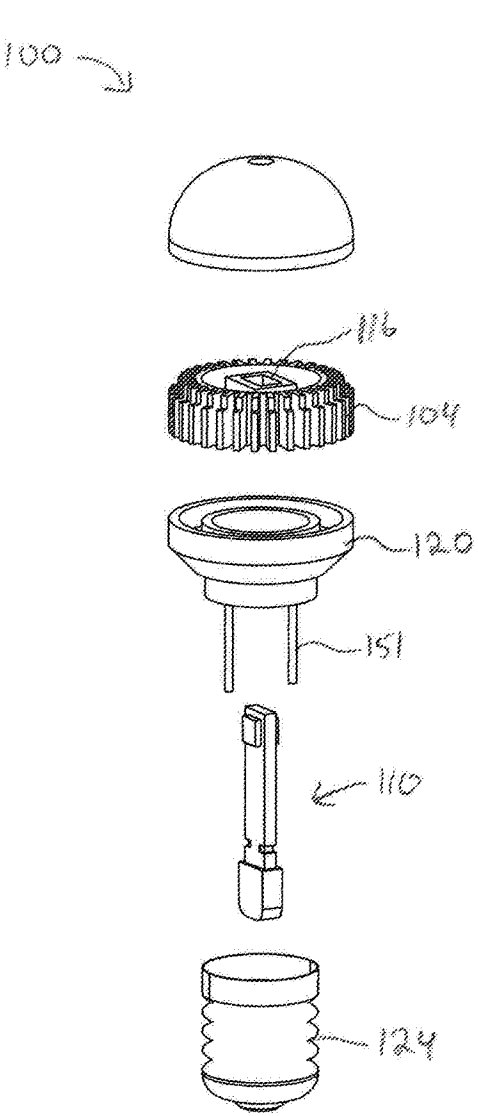
FIG. 5E shows an exploded view of the light source of FIG. 5A.
Figure 5D:
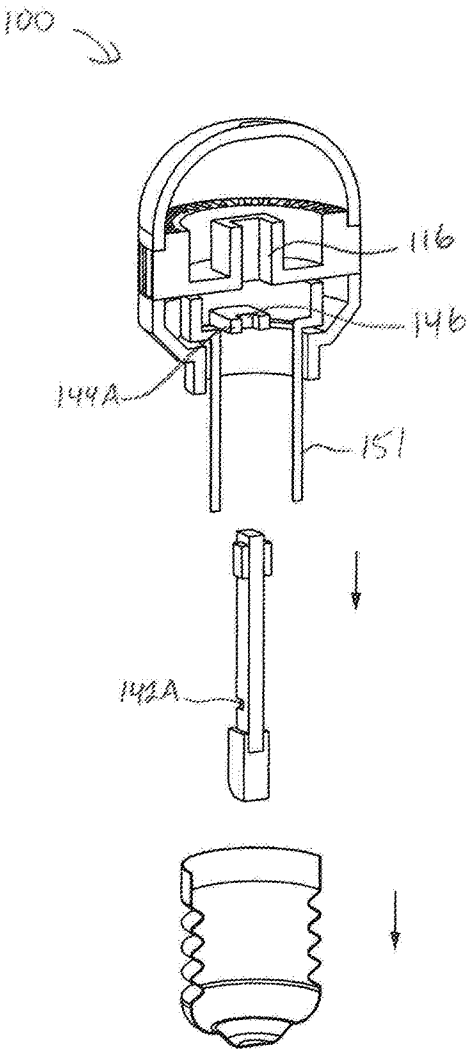
FIG. 5D shows a cross-sectional view of the light source of FIG. 5C along the line D2-D2 in FIG. 5C.
Figure 5C:
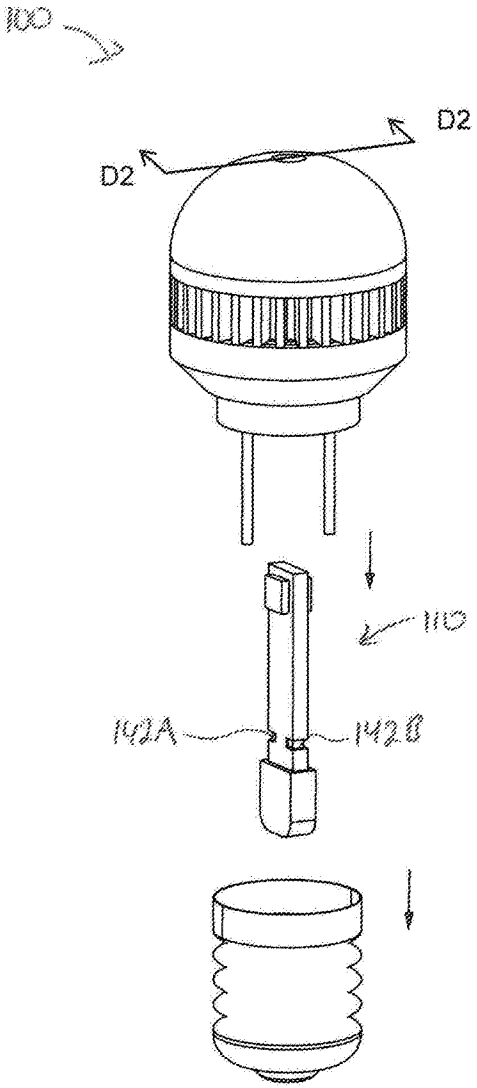
FIG. 5C shows a perspective view of the light source of FIG. 5A with the cartridge removed.
Figure 6B:
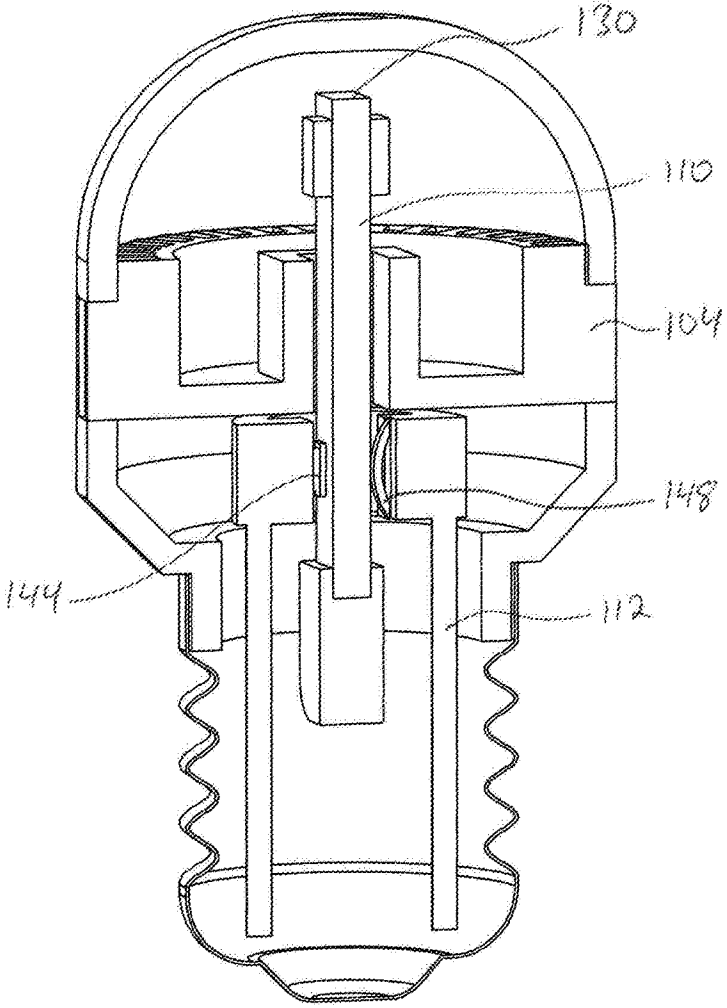
FIG. 6B shows a cross-sectional view of the light source of FIG. 6A along the line D3-D3 in FIG. 6A.
Figure 6A:
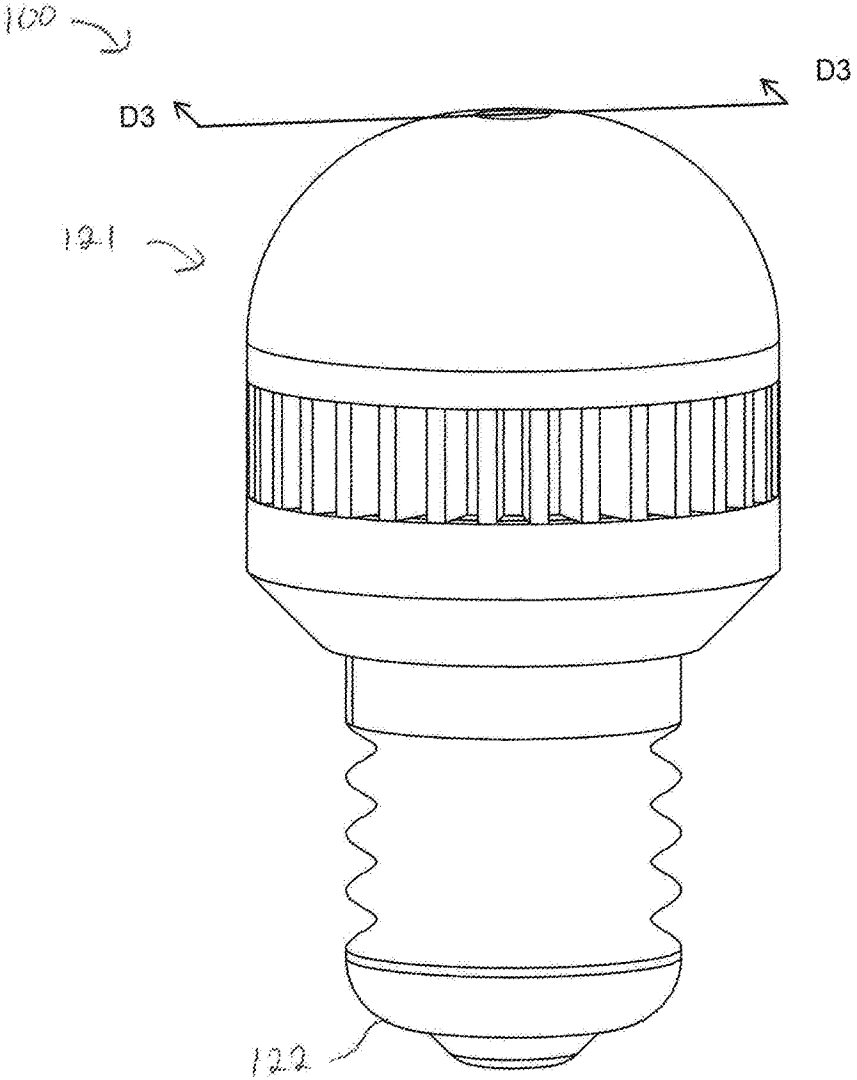
FIG. 6A shows a perspective view of another light source.
Figures 6C, 6D, 6E:
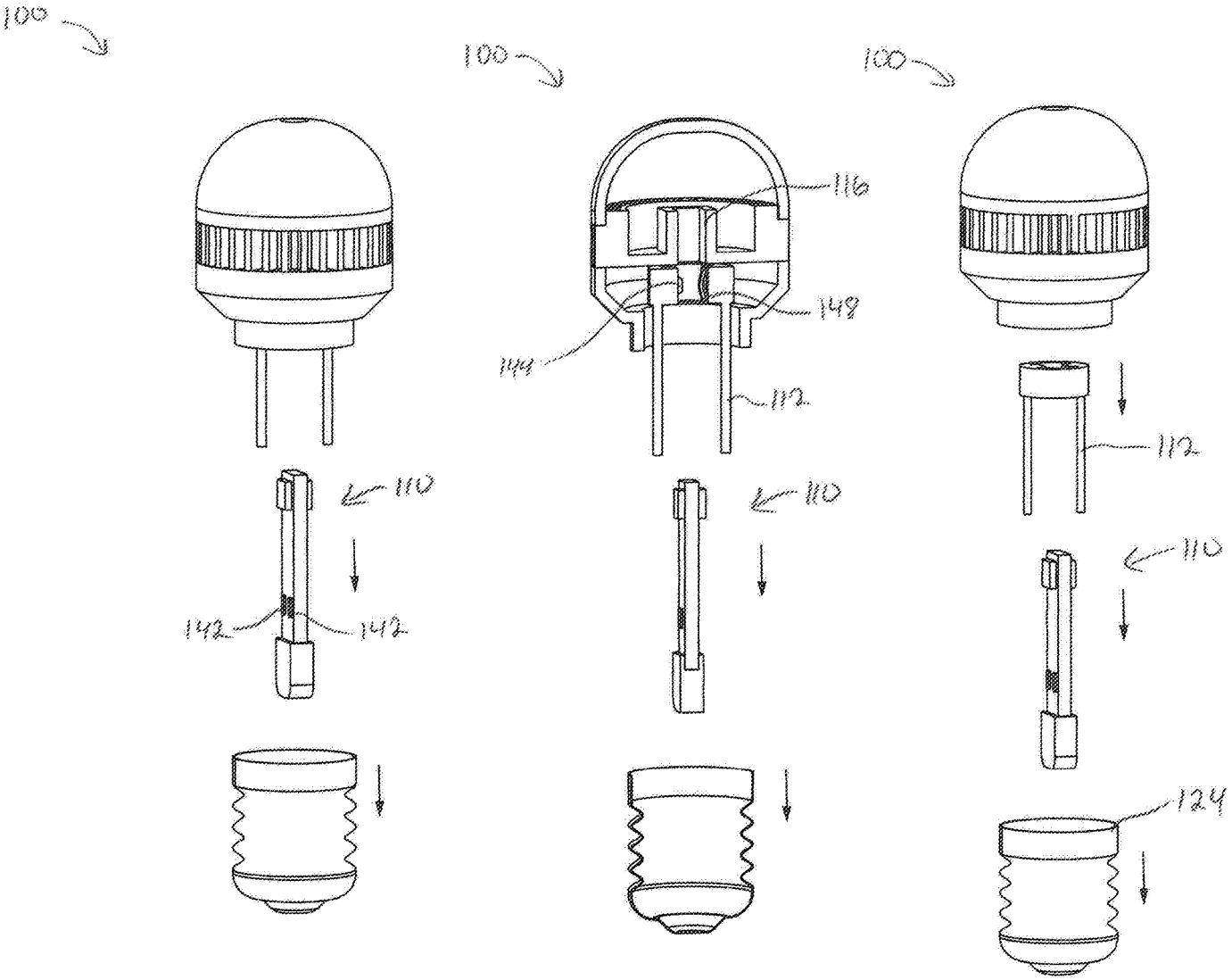
FIG. 6C shows a perspective view of the light source of FIG. 6A with the cartridge removed.
FIG. 6D shows a cross-sectional view of the light source of FIG. 6C along the line D3-D3 in FIG. 6A.
FIG. 6E shows an exploded view of the light source of FIG. 6A.
Figure 7B:
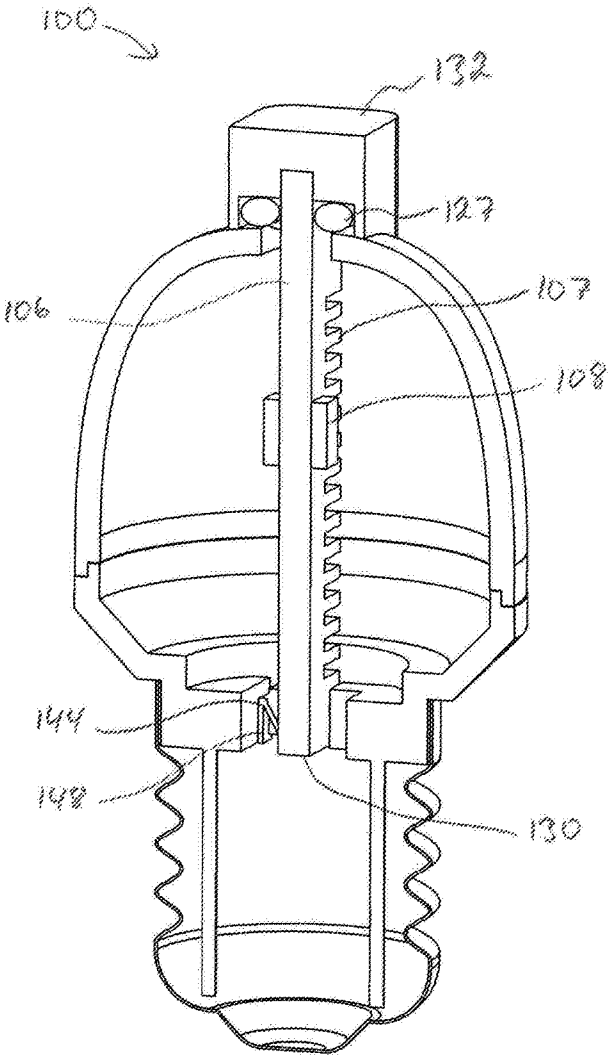
FIG. 7B shows a cross-sectional view of the light source of FIG. 7A along the line E1-E1 in FIG. 7A.
Figure 7A:
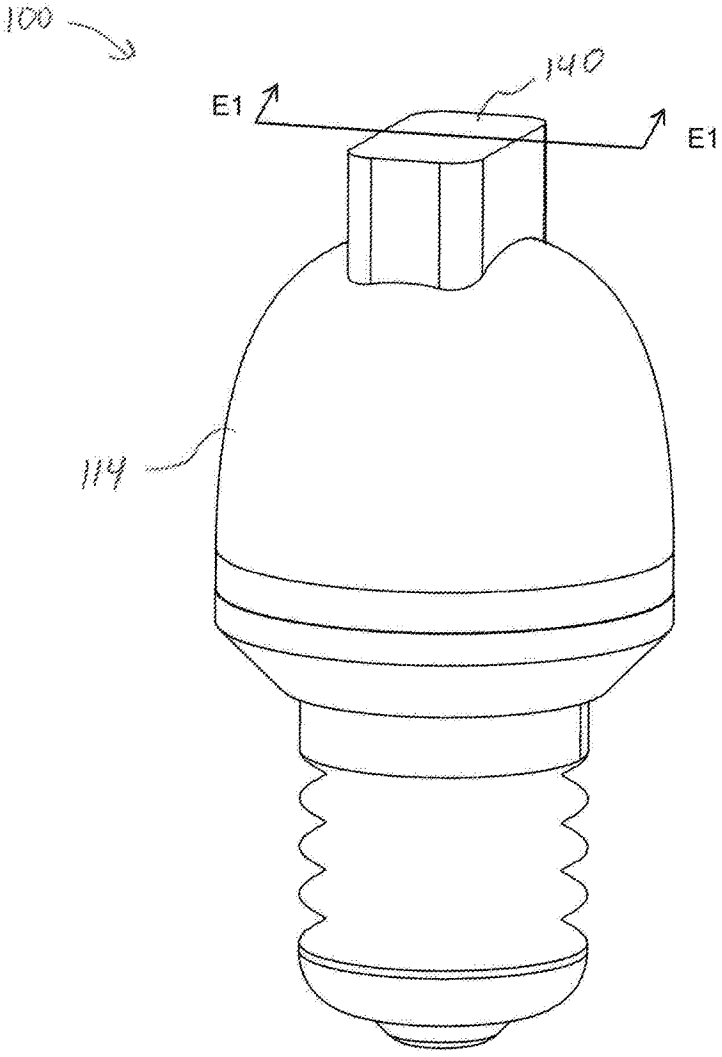
FIG. 7A shows a perspective view of another light source.
Figure 7E:
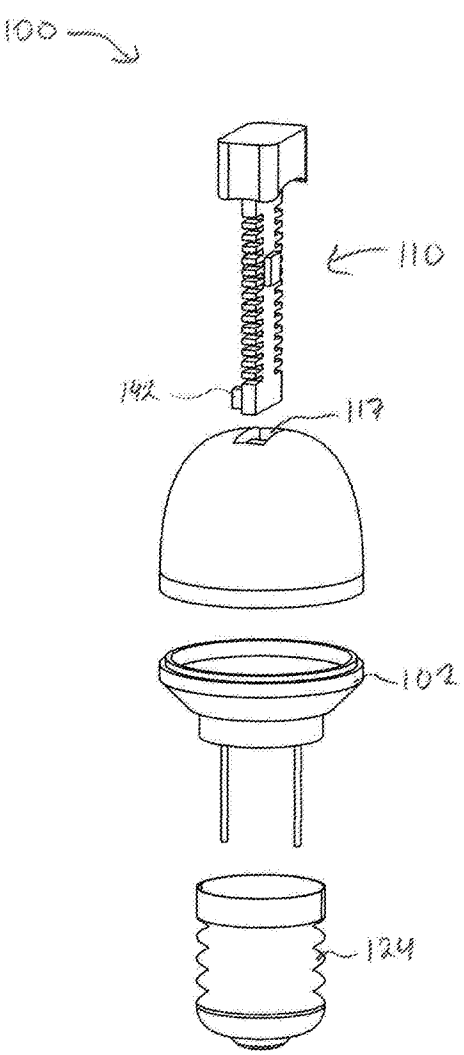
FIG. 7E shows an exploded view of the light source of FIG. 7A.
Figure 7D:
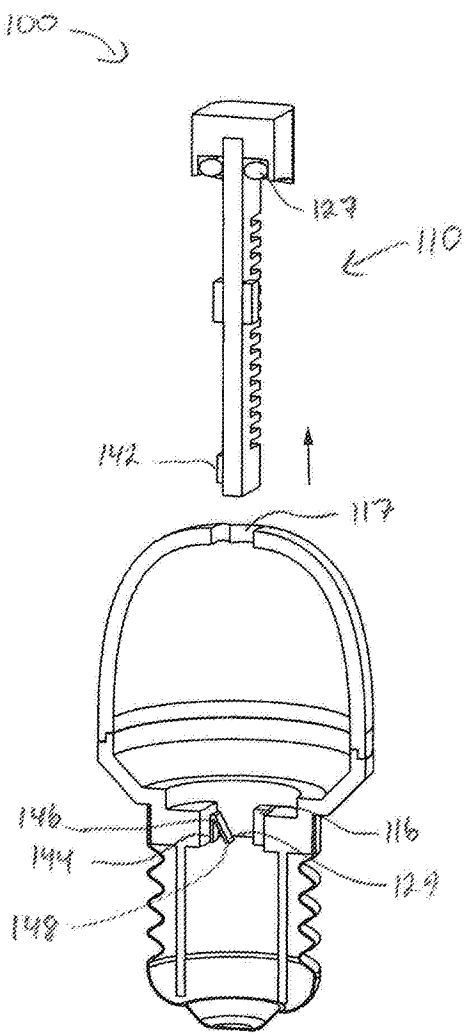
FIG. 7D shows a cross-sectional view of the light source of FIG. 7C along the line E1-E1 in FIG. 7A.
Figure 7C:
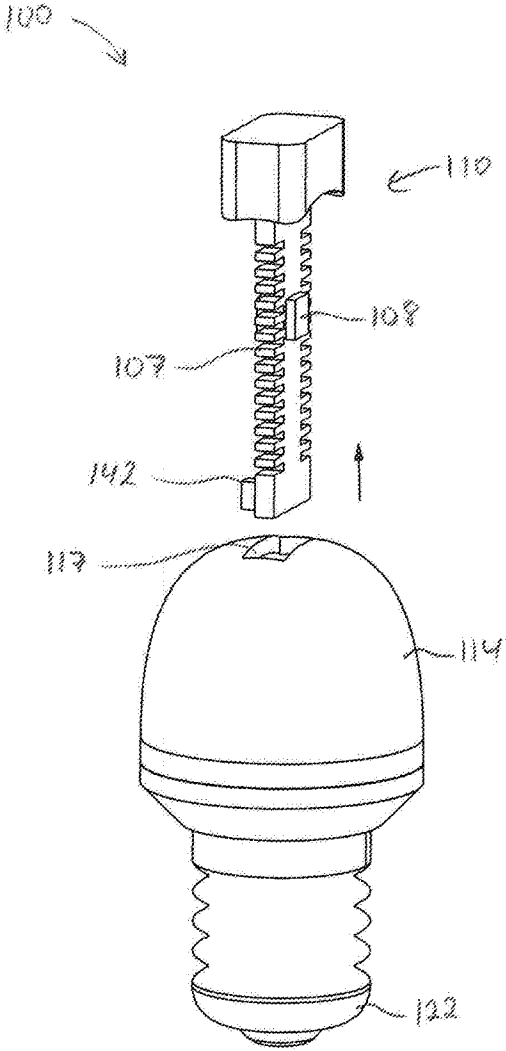
FIG. 7C shows a perspective view of the light source of FIG. 7A with the cartridge removed.
Figure 8B:
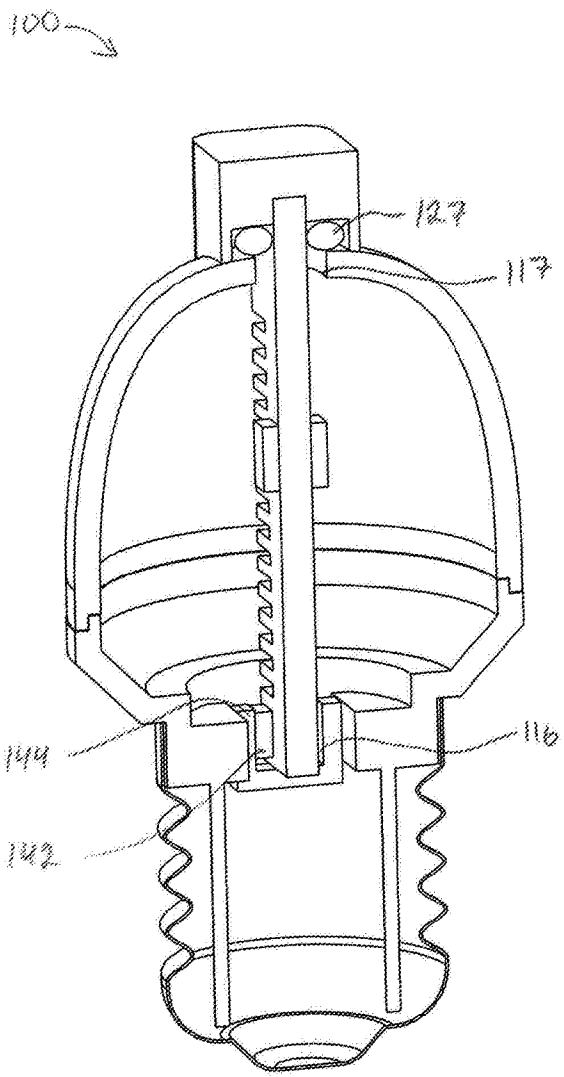
FIG. 8B shows a cross-sectional view of the light source of FIG. 8A along the line E2-E2 in FIG. 8A.
Figure 8A:
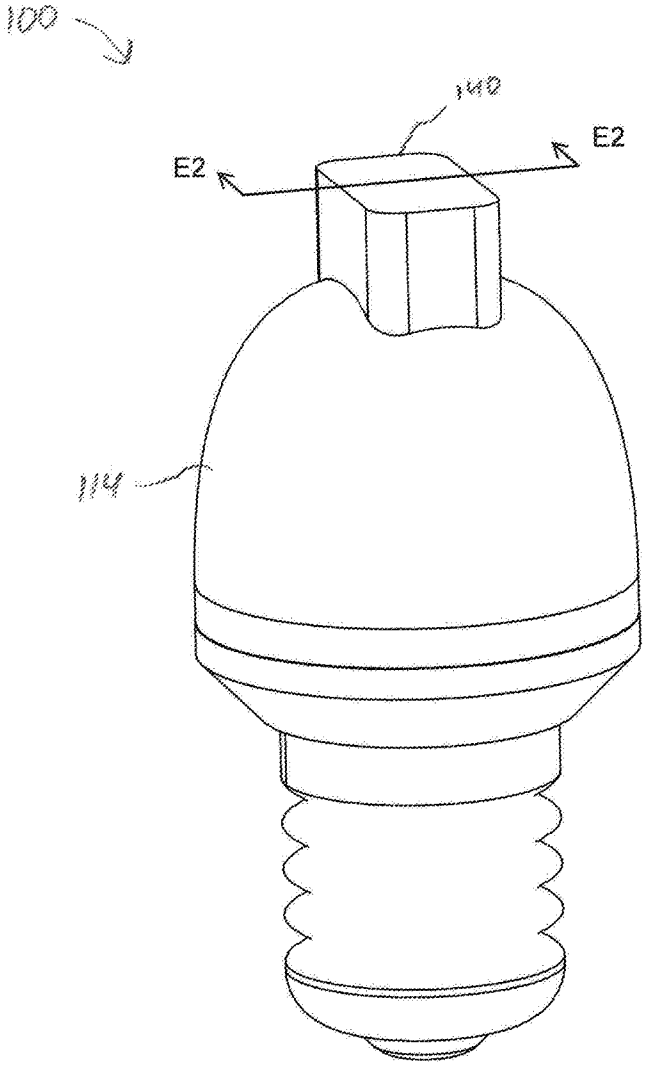
FIG. 8A shows a perspective view of another light source.
Figure 8E:
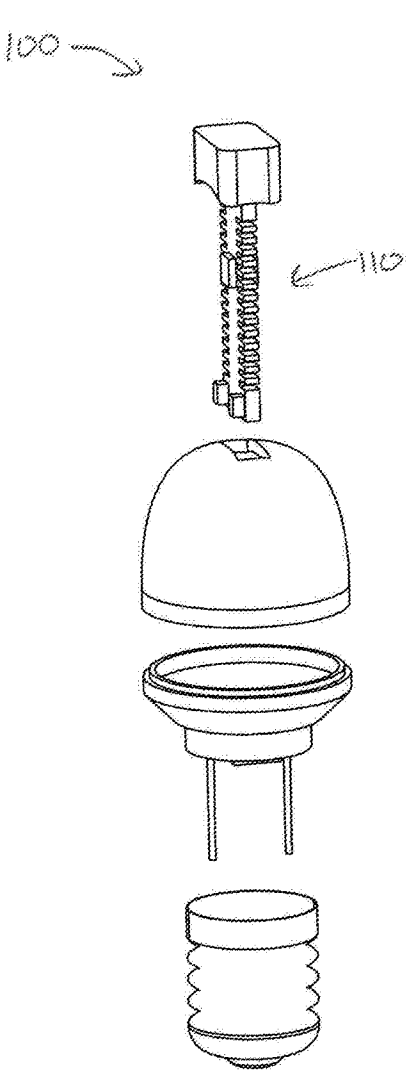
FIG. 8E shows an exploded view of the light source of FIG. 8A.
Figure 8D:
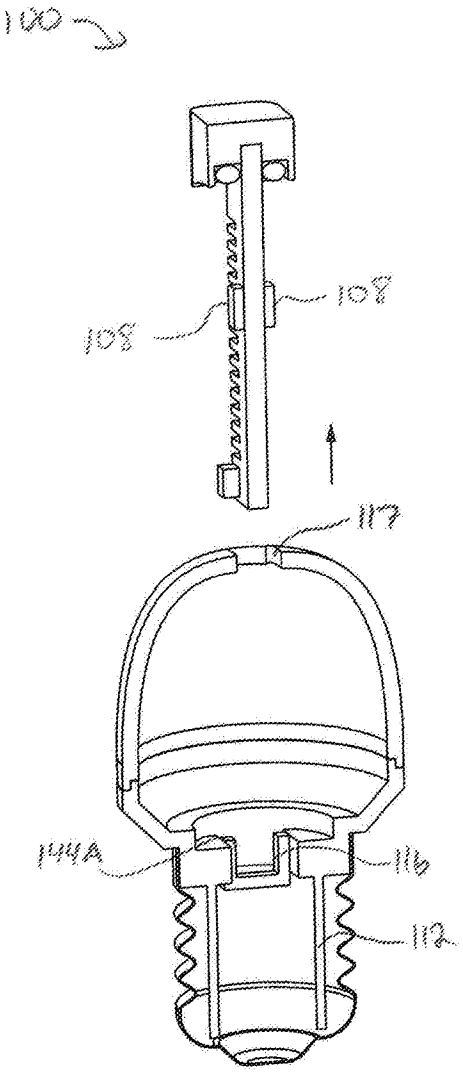
FIG. 8D shows a cross-sectional view of the light source of FIG. 8C along the line E2-E2 in FIG. 8A.
Figure 8C:
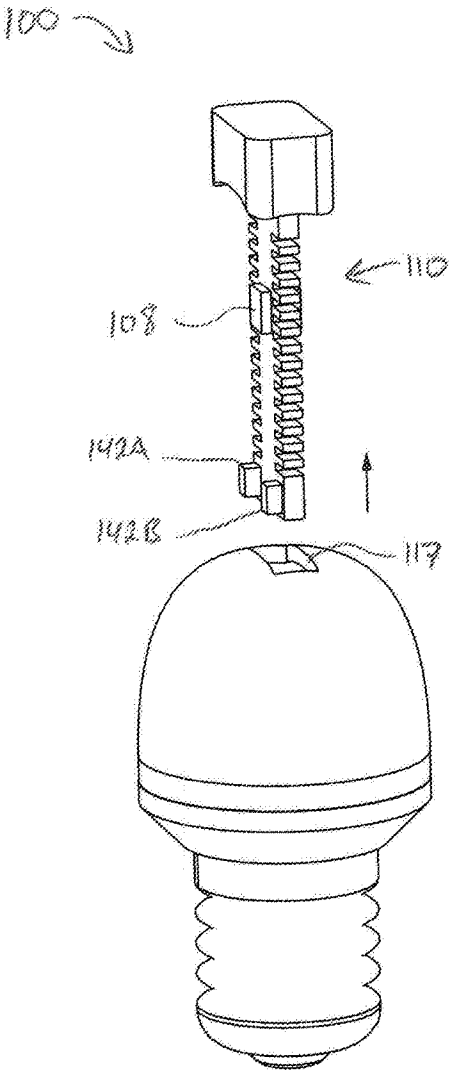
FIG. 8C shows a perspective view of the light source of FIG. 8A with the cartridge removed.
Figure 9B:
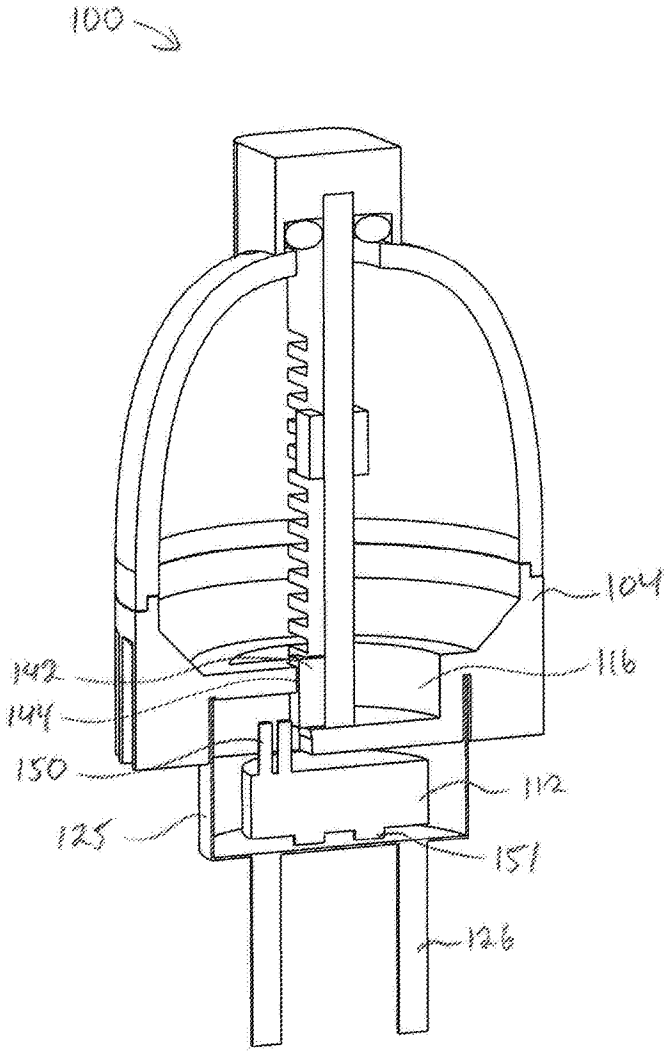
FIG. 9B shows a cross-sectional view of the light source of FIG. 9A along the line E3-E3 in FIG. 9A.
Figure 9A:
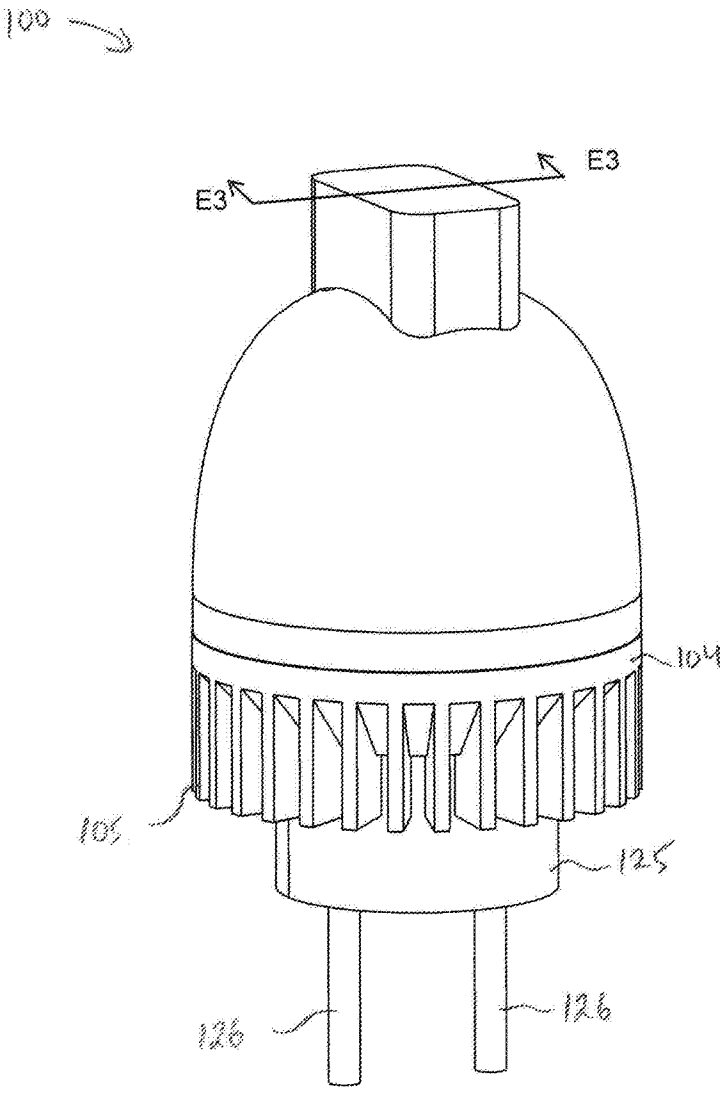
FIG. 9A shows a perspective view of another light source.
Figure 9E:
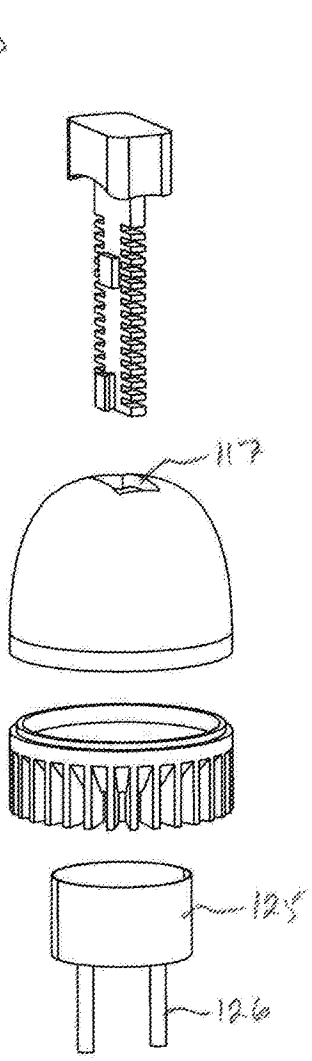
FIG. 9E shows an exploded view of the light source of FIG. 9A.
Figure 9D:
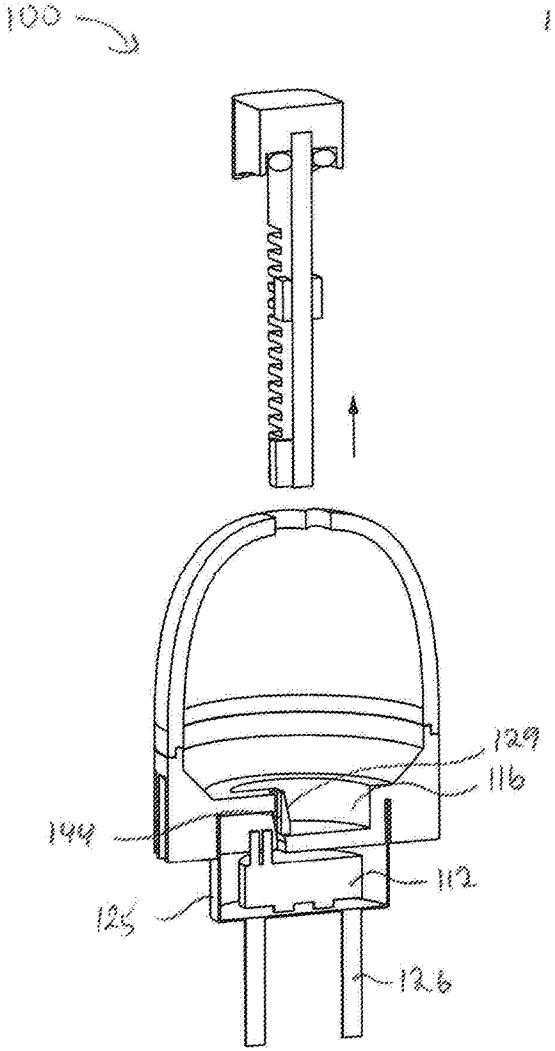
FIG. 9D shows a cross-sectional view of the light source of FIG. 9C along the line E3-E3 in FIG. 9A.
Figure 9C:
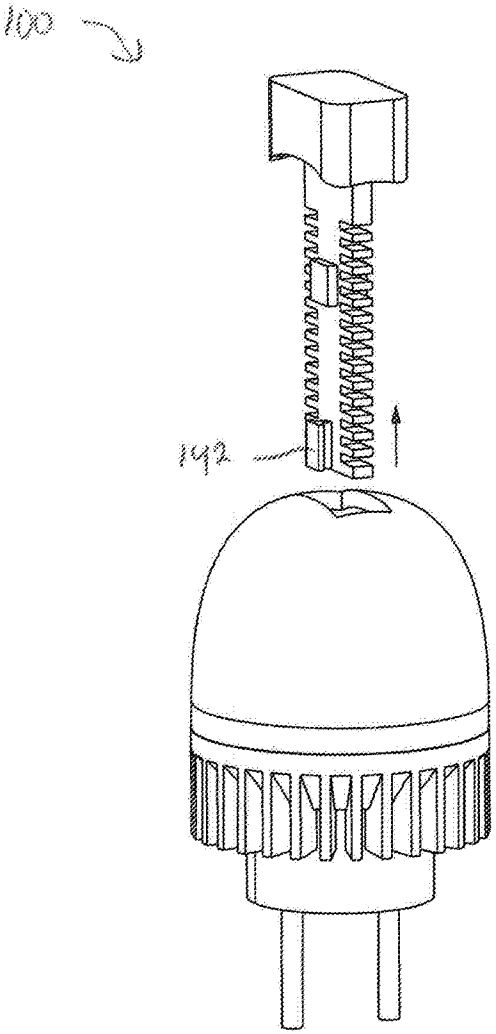
FIG. 9C shows a perspective view of the light source of FIG. 9A with the cartridge removed.
Figure 10B:
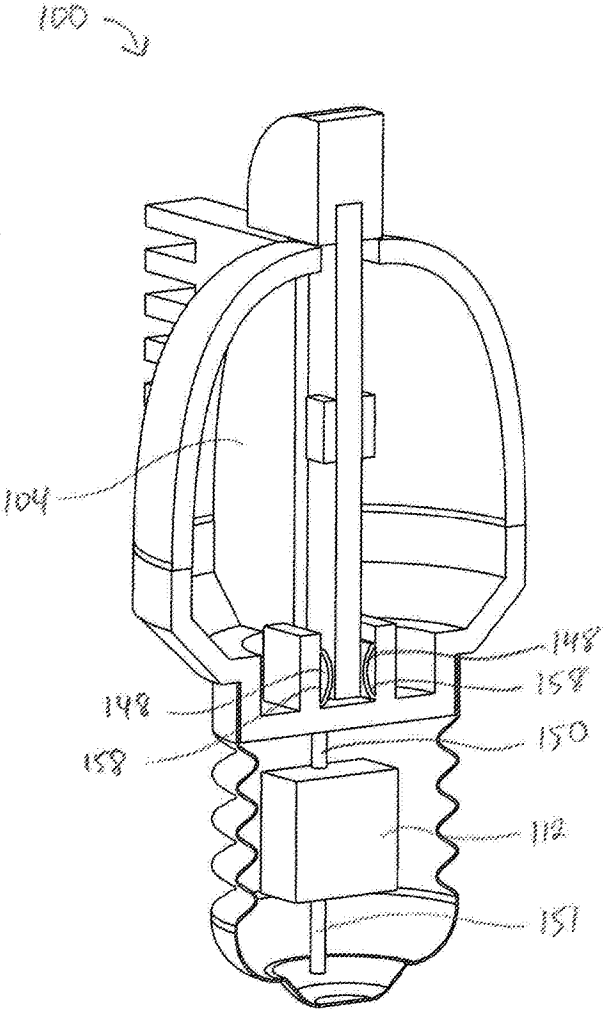
FIG. 10B shows a cross-sectional view of the light source of FIG. 10A along the line F1-F1 in FIG. 10A.
Figure 10A:
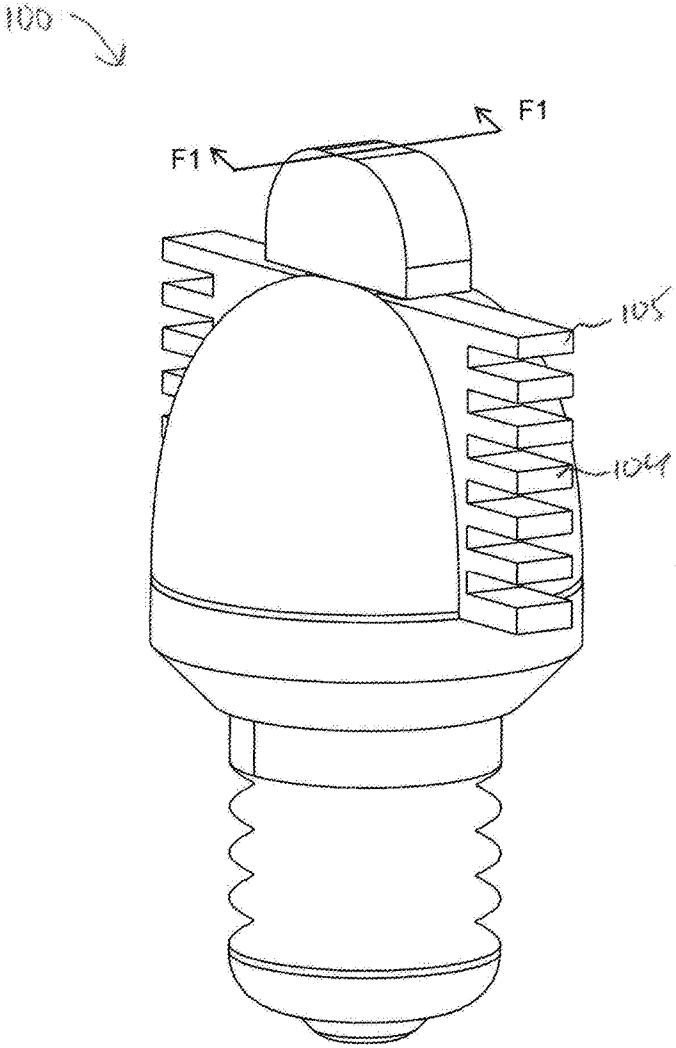
FIG. 10A shows a perspective view of another light source.
Figure 10E:
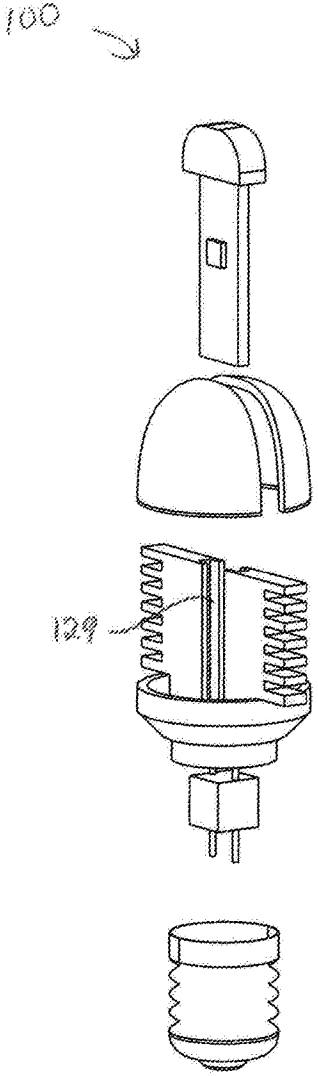
FIG. 10E shows an exploded view of the light source of FIG. 10A.
Figure 10D:
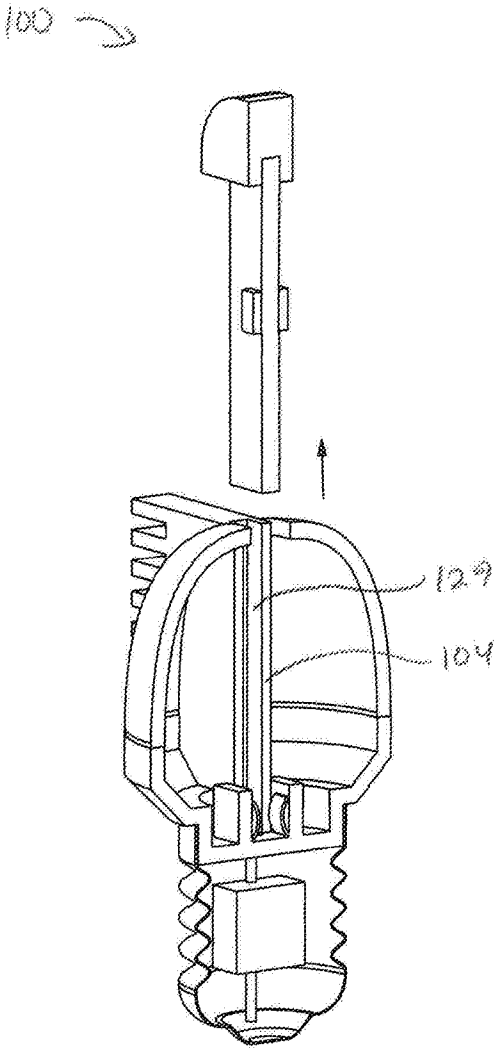
FIG. 10D shows a cross-sectional view of the light source of FIG. 10C along the line F1-F1 in FIG. 10A.
Figure 10C:
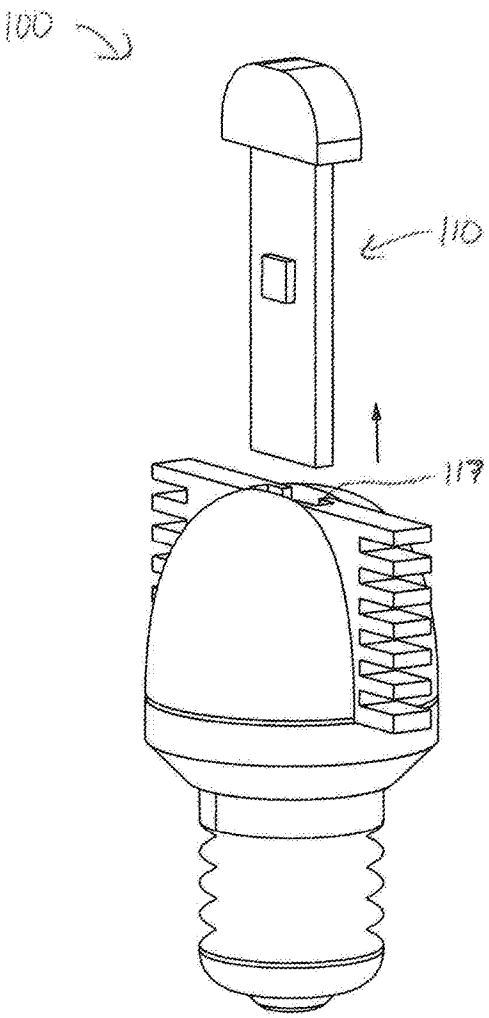
FIG. 10C shows a perspective view of the light source of FIG. 10A with the cartridge removed.
Figure 11B:
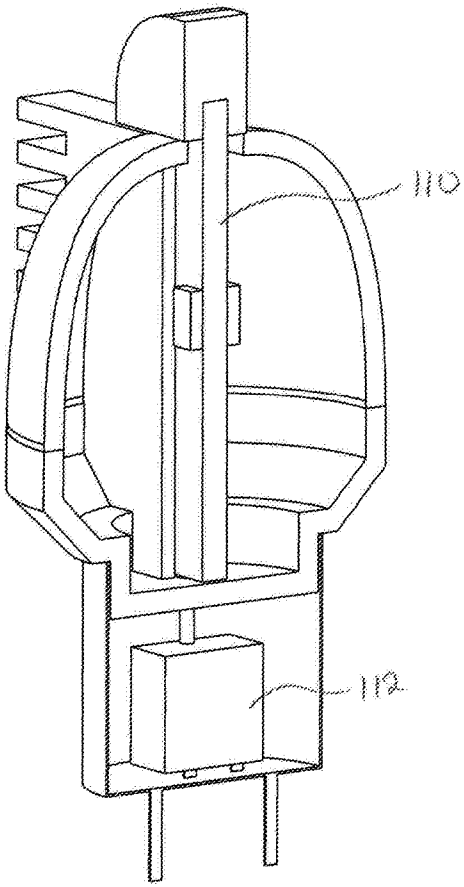
FIG. 11B shows a cross-sectional view of the light source of FIG. 11A along the line F2-F2 in FIG. 11A.
Figure 11A:
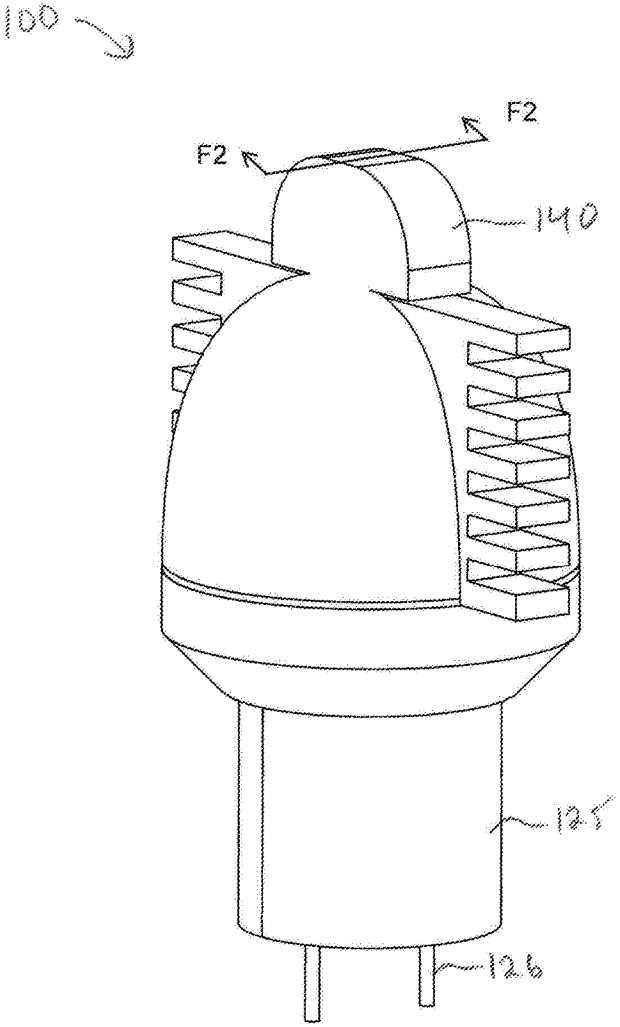
FIG. 11A shows a perspective view of another light source.
Figure 11E:
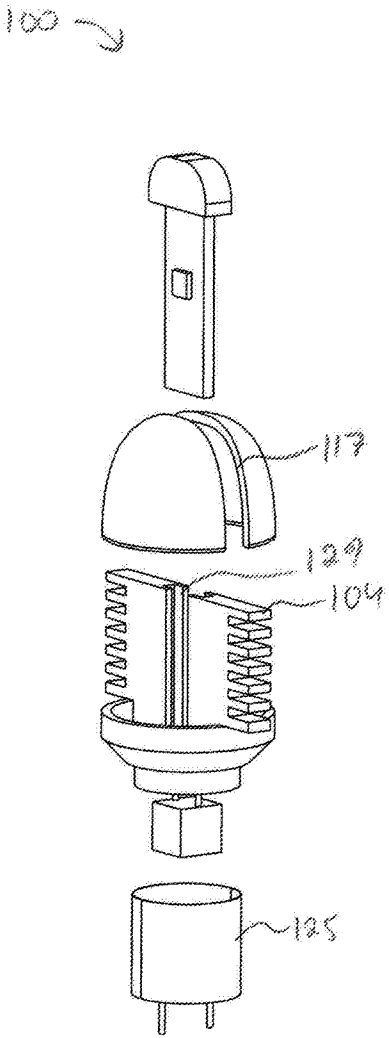
FIG. 11E shows an exploded view of the light source of FIG. 11A.
Figure 11D:
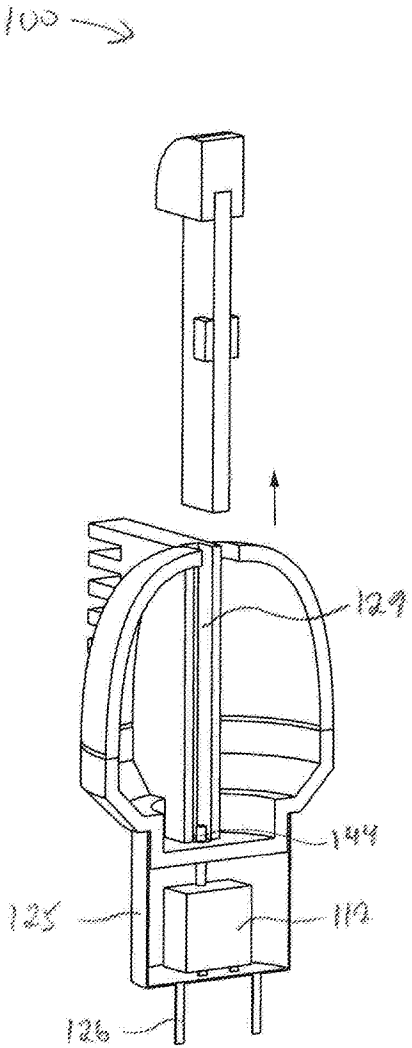
FIG. 11D shows a cross-sectional view of the light source of FIG. 11C along the line F2-F2 in FIG. 11A.
Figure 11C:
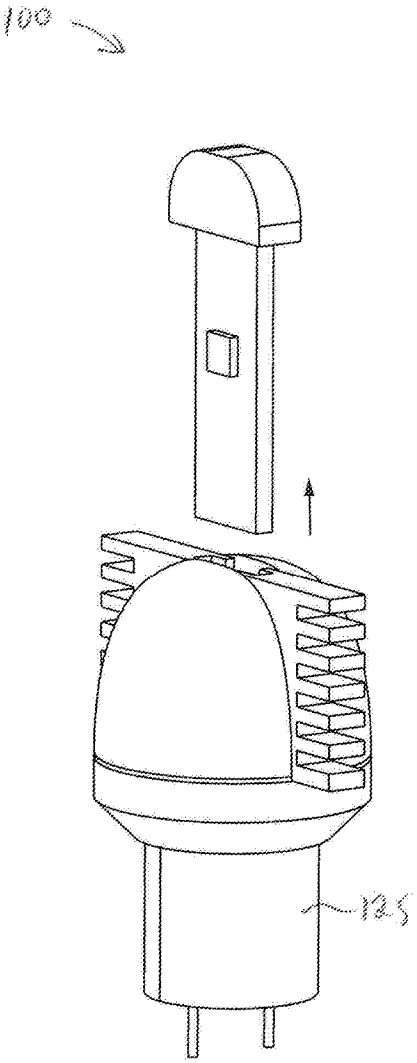
FIG. 11C shows a perspective view of the light source of FIG. 11A with the cartridge removed.
Figure 12B:
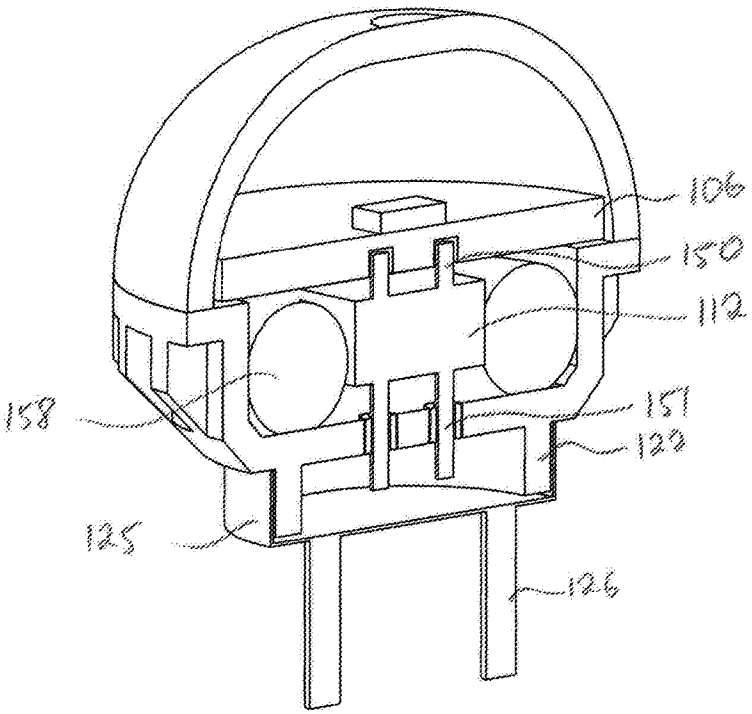
FIG. 12B shows a cross-sectional view of the light source of FIG. 12A along the line G-G in FIG. 12A.
Figure 12A:
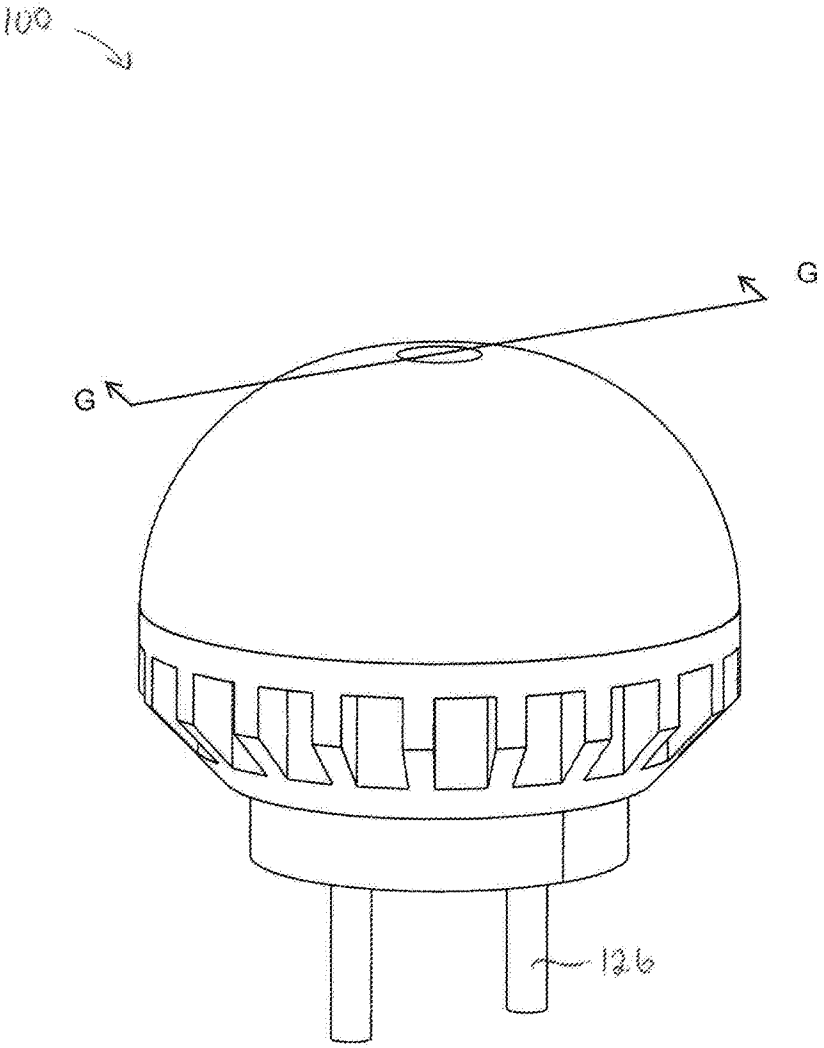
FIG. 12A shows a perspective view of another light source.
Figure 12D:
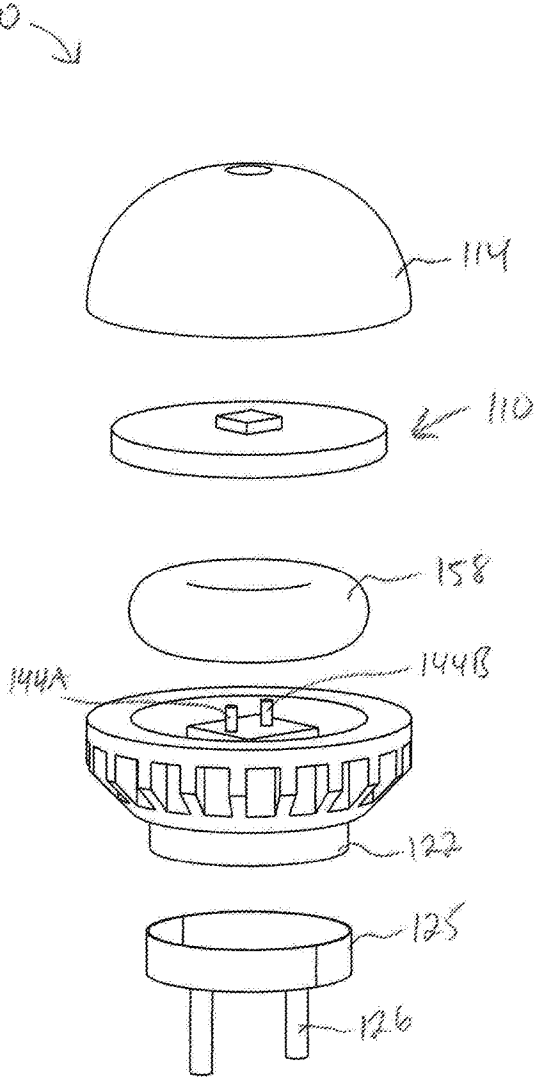
FIG. 12D shows an exploded view of the light source of FIG. 12A.
Figure 12C:
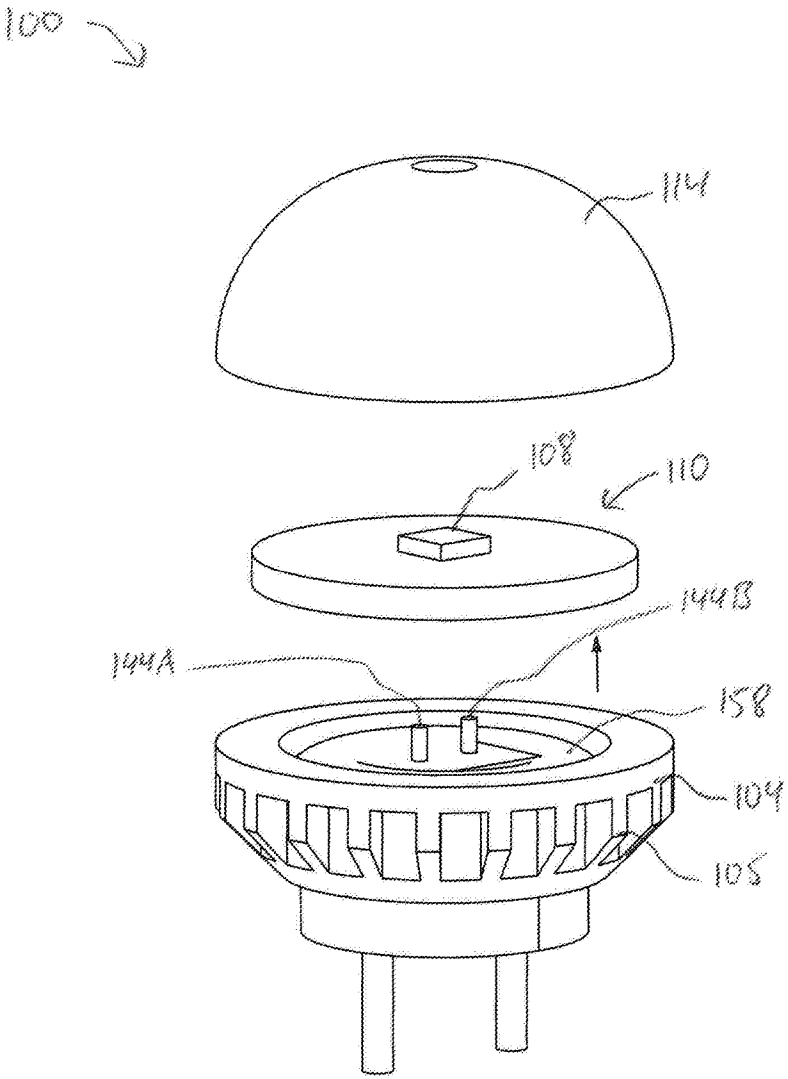
FIG. 12C shows a perspective view of the light source of FIG. 12A with the cartridge removed.
Figure 13B:
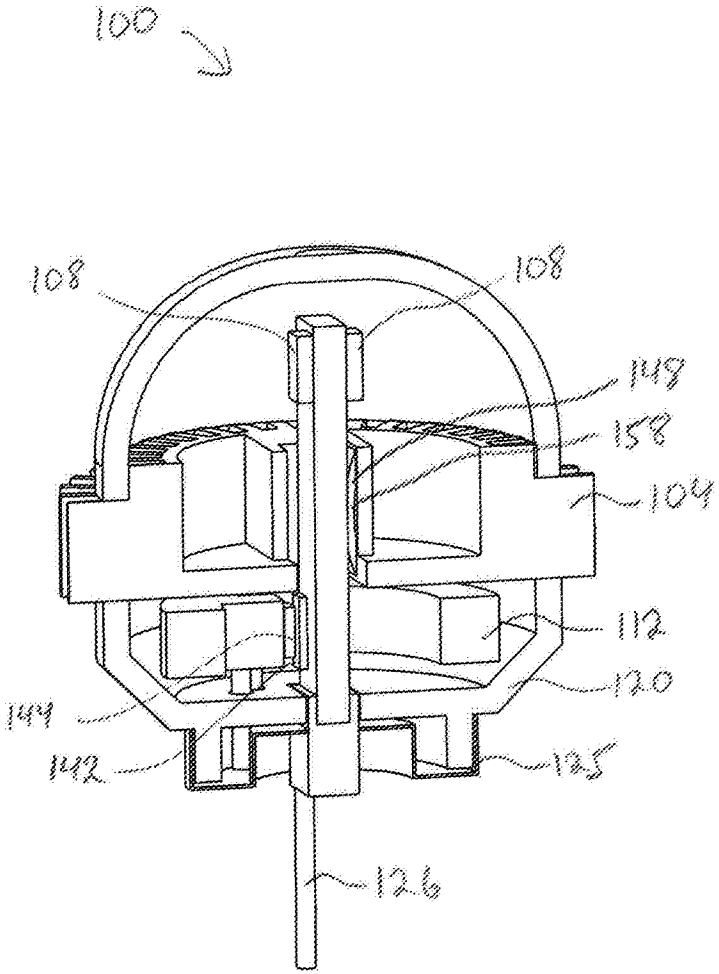
FIG. 13B shows a cross-sectional view of the light source of FIG. 13A along the line H-H in FIG. 13A.
Figure 13A:
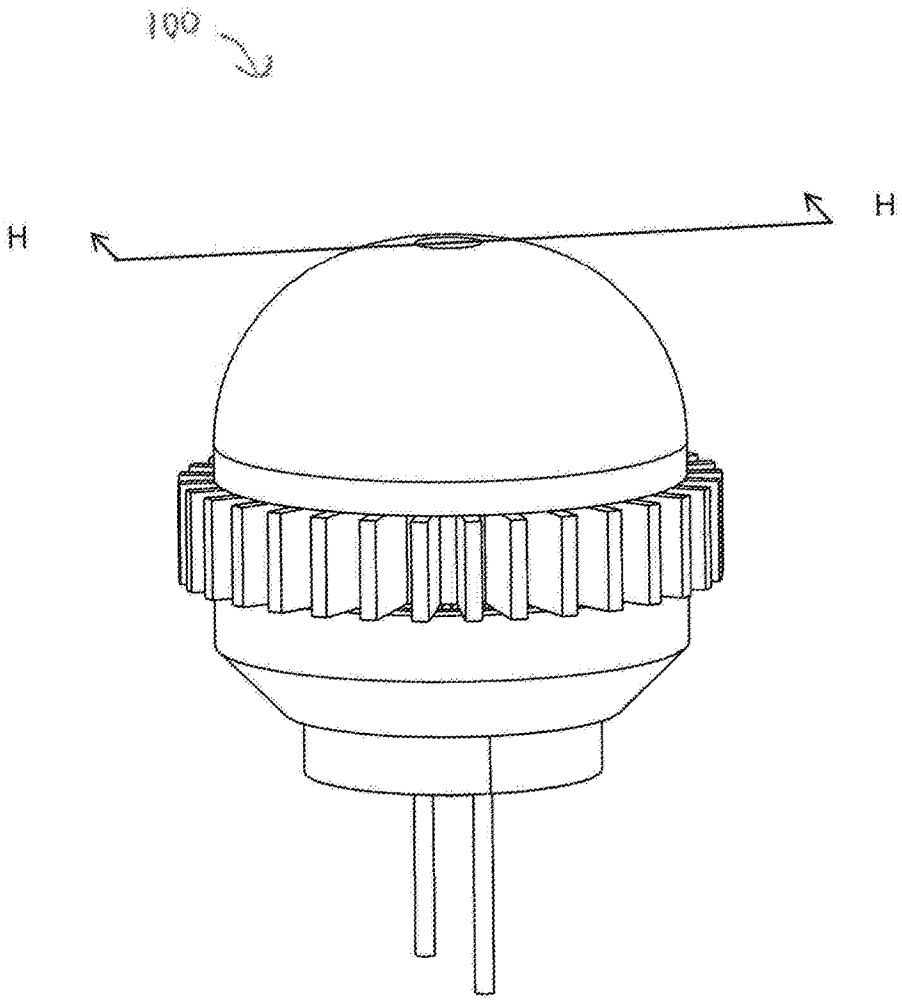
FIG. 13A shows a perspective view of another light source.
Figure 13E:
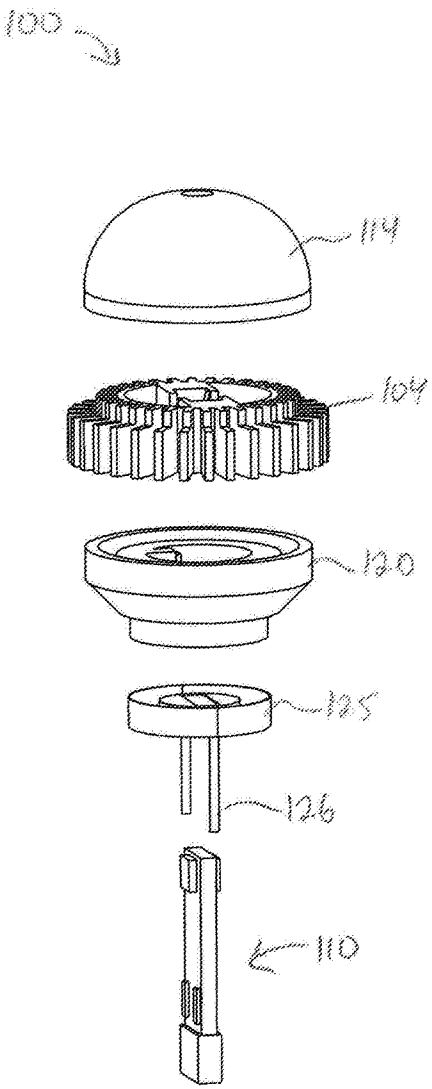
FIG. 13E shows an exploded view of the light source of FIG. 13A.
Figure 13D:
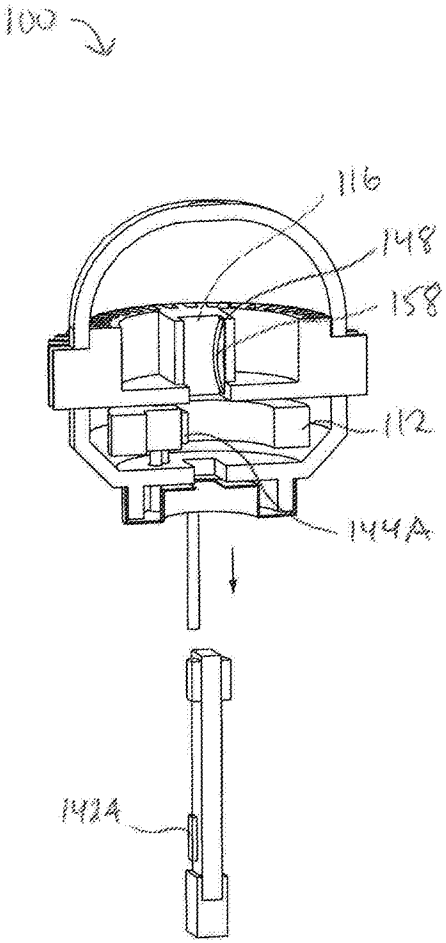
FIG. 13D shows a cross-sectional view of the light source of FIG. 13C along the line H-H in FIG. 13A.
Figure 13C:
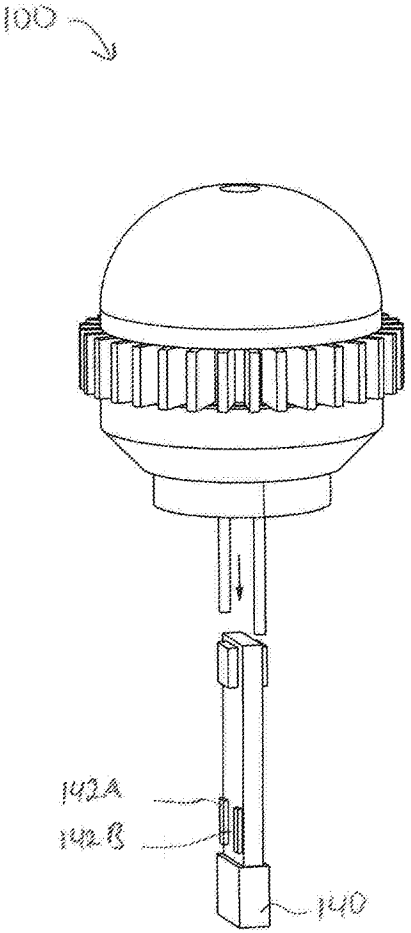
FIG. 13C shows a perspective view of the light source of FIG. 13A with the cartridge removed.

As exemplified in FIG. 3B, the electrical contact members 144 may be pins that are received in the insertion end 130. Alternately, as exemplified in FIG. 6B, electrical contact members 144 may be in the form of a spring member. An advantage of such a design is that the electrical contact members 144 may concurrently electrically connect the cartridge to the light source and also secure or assist in securing the cartridge in position in the light source.

In some embodiments, if the substrate 106 is coated with a thermal conducting layer 145 that forms an electrical conductive member, as described subsequently, the electrical contact members 144 may contact any portion of the substrate 106 to provide an electrical connection to the light emitting member 108.

Backup Light Emitting Members

The following is a description of a light source having one or more backup light emitting members, which may be used by itself or in combination with any one or more other aspects discussed herein. An advantage of this aspect is that, in the event that one or more light emitting members fail on the cartridge, backup light emitting members may allow the light source to continue emitting light. In other words, one or more of the light emitting members may be used as the initial light emitting members, while one or more of reserve light emitting members may be used sequentially or collectively when the one or more first light emitting members fail, thereby extending the lifespan of the light source.

It will be appreciated that the backup light emitting members may be located in multiple positions on a single cartridge. For example, they may be provided at spaced locations on one side of a cartridge. In such a case, the cartridge may be repositioned (e.g., inserted further into a recess or rotated) so as to electrically connect the backup light emitting members for use. Alternately, the light emitting members may be provided on different faces or sides of a cartridge ad the cartridge may be withdrawn from the light source and reinserted n a different orientation to electrically connect the backup light emitting members for use.

For example, as exemplified in FIGS. 14A-14F, in some embodiments, the substrate 106 may have at least first and second light emitting members 108A and 108B. The substrate 106 may be positionable between first and second operable positions. In the first operable position, the first light emitting member 108A is operable to provide illumination and the second light emitting member 108B is inoperable. In the second operable position, the second light emitting member 108B is operable to provide illumination. In the second operable position, the first light emitting member 108A may be inoperable.

In some embodiments, the first light emitting member 108A may be provided on the first side 136 of the substrate while the second light emitting member 108B is provided on the second opposed side 138 of the substrate. The substrate 106 may be positionable in a first orientation in the main body 102 in which the first light emitting member 108A is operable. The substrate 106 may be positionable in a second orientation in the main body 102 in which the second light emitting member 108B is operable.

It will be appreciated that there may be any number of operating positions and any number of light emitting members 108.

It will also be appreciated that there may be a single light emitting member 108 operable in each position, or a plurality of light emitting members 108 operable in each position.

It will be appreciated that the first and second light emitting member 108A and 108B may be positioned anywhere on the substrate 106. For example, the first light emitting member 108A may be near the insertion end 130 while the second light emitting member 108B may be near the outer end 132. When the cartridge 110 is moved from the first operable position to the second operable position, the cartridge 110 may be reoriented such that the second light emitting member 108B is near the insertion end 130 and the first light emitting member 108A is near the outer end 132.

Figure 14B:
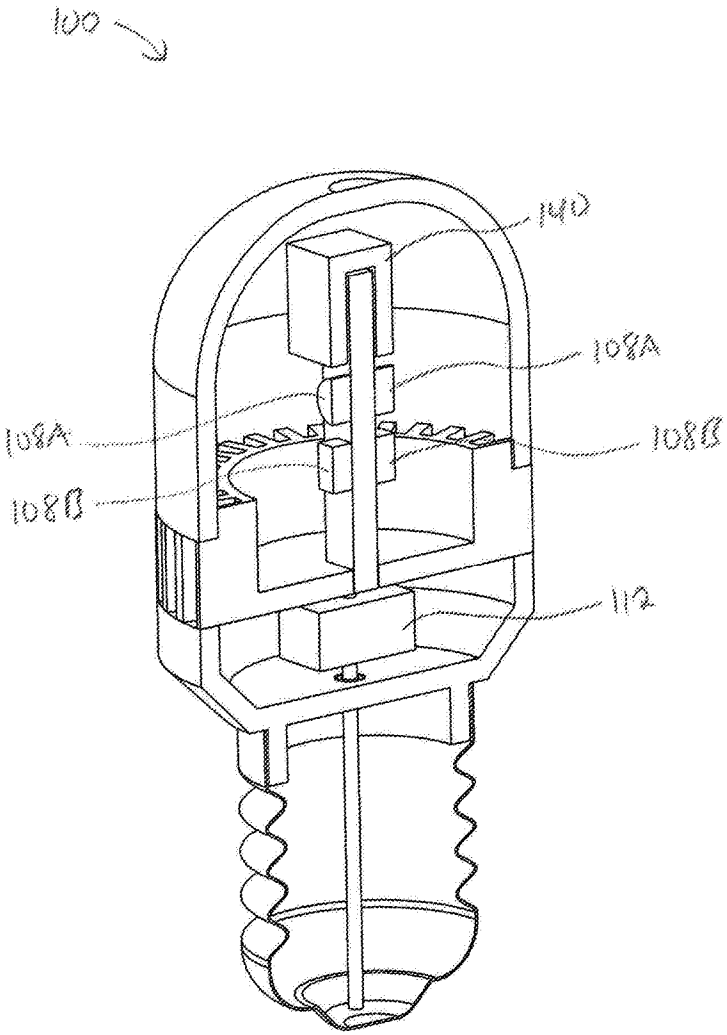
FIG. 14B shows a cross-sectional view of the light source of FIG. 14A along the line I-I in FIG. 14A.
Figure 14A:
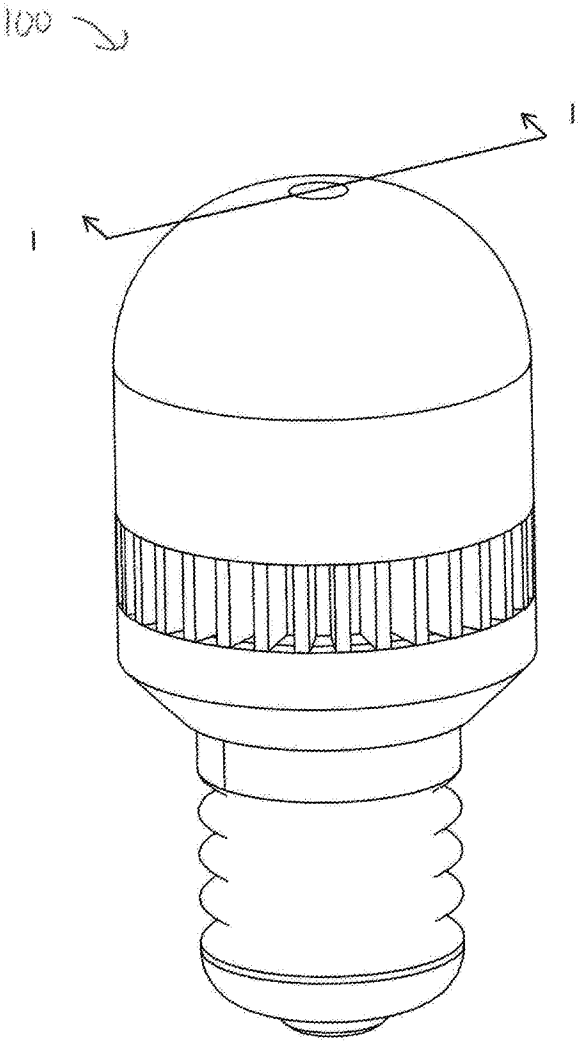
FIG. 14A shows a perspective view of another light source.
Figure 14D:
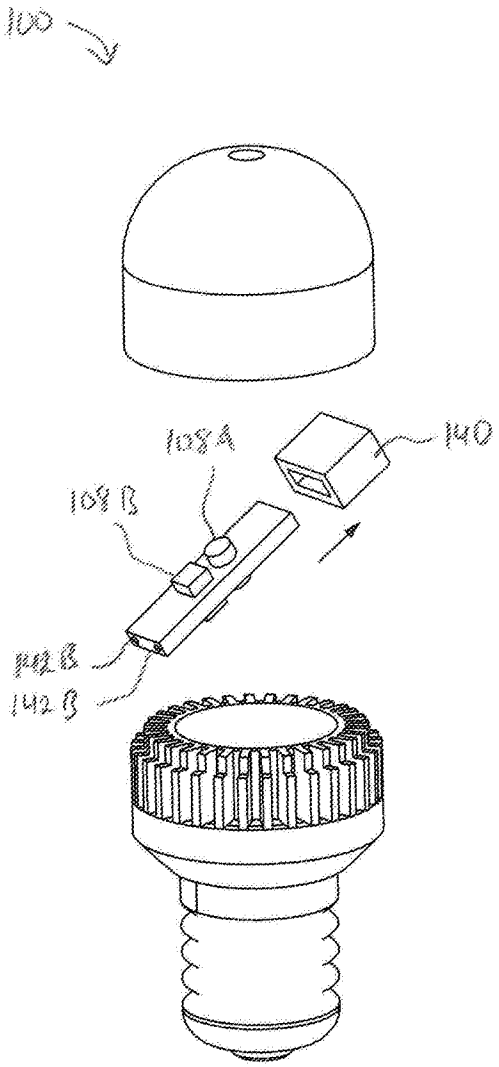
FIG. 14C-14E shows a perspective view of the light source of FIG. 14A with the cartridge being repositioned to position back up light emitting members in an operable position.
Figure 14C:
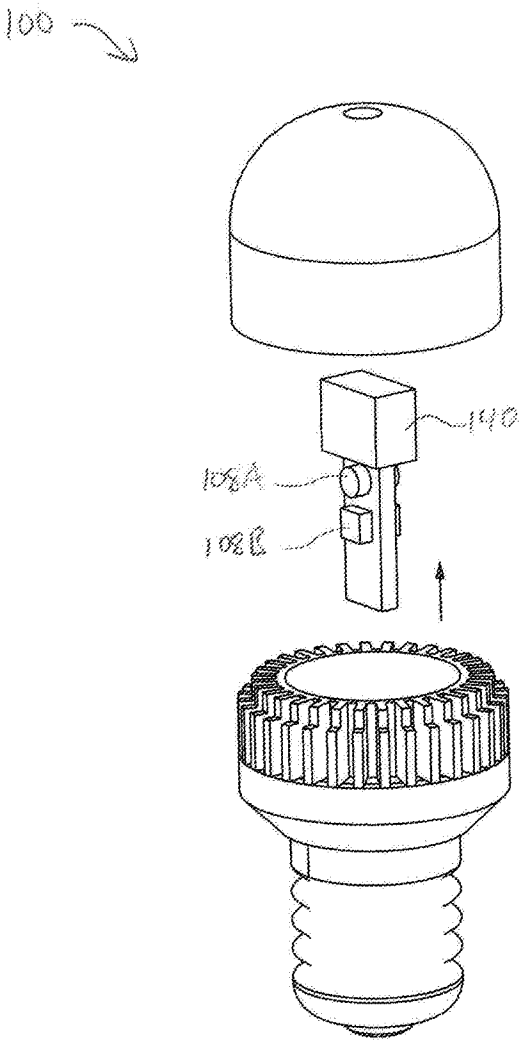
Figure 14F:
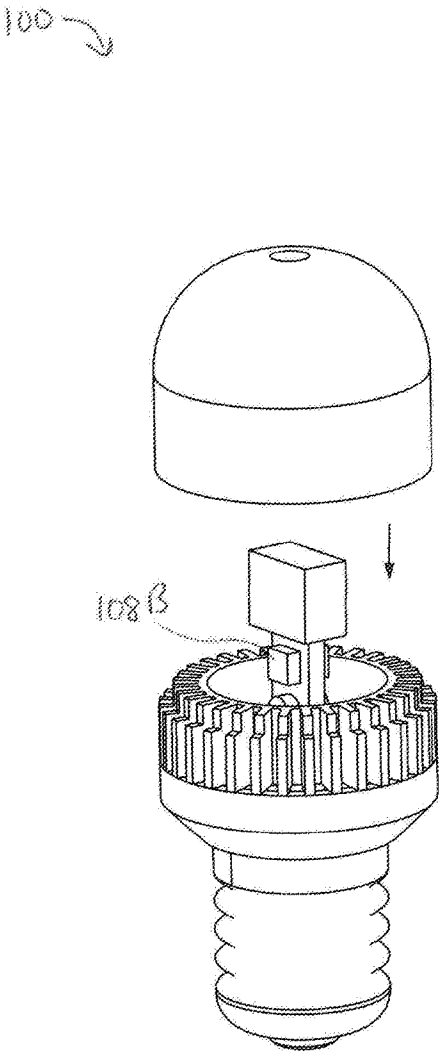
FIG. 14F shows a perspective view of the light source of FIG. 14A with the cartridge reinserted.
Figure 14E:
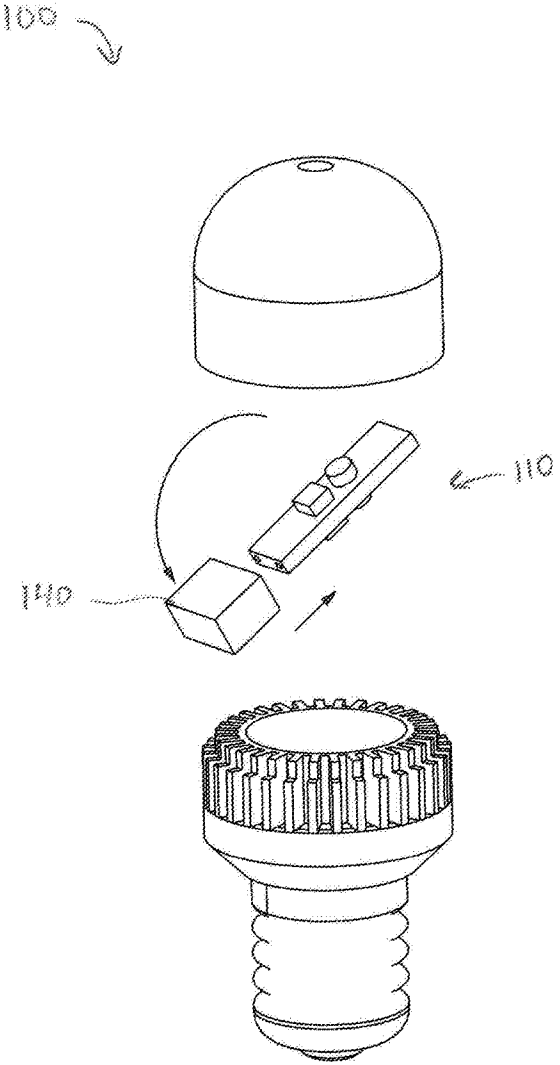
Figure 15B:
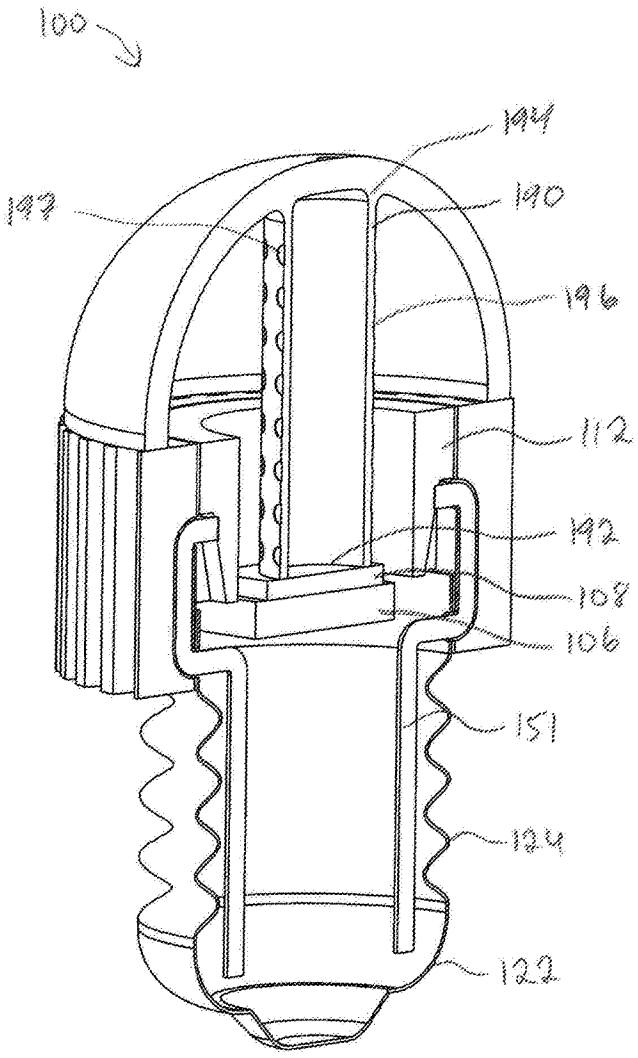
FIG. 15B shows a cross-sectional view of the light source of FIG. 15A along the line J1-J1 in FIG. 15A.
Figure 15A:
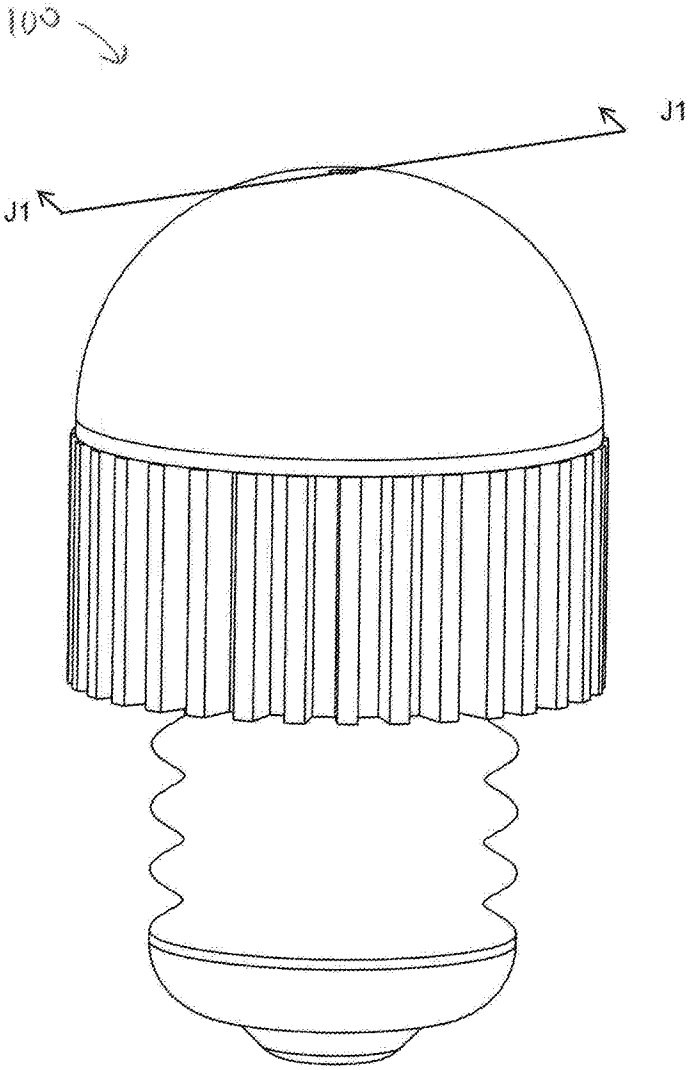
FIG. 15A shows a perspective view of another light source.
Figure 15E:
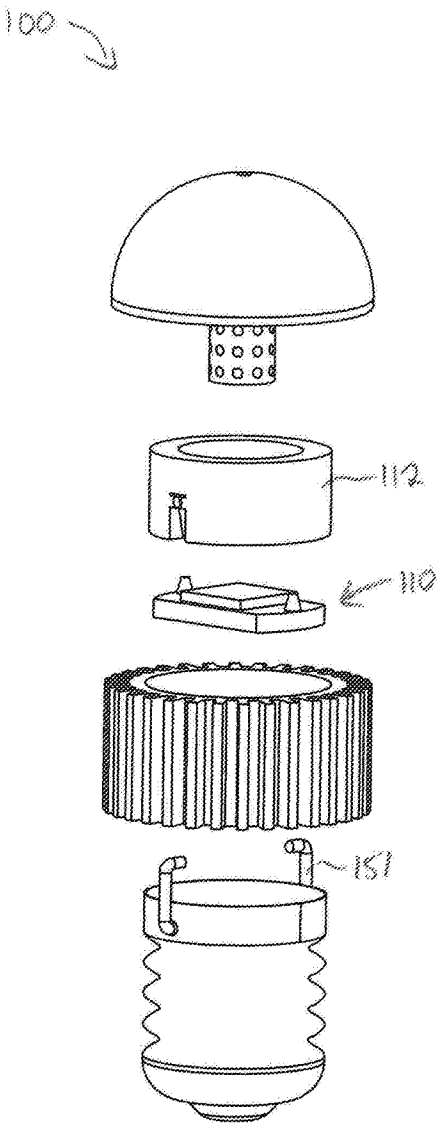
FIG. 15E shows an exploded view of the light source of FIG. 15A.
Figure 15D:
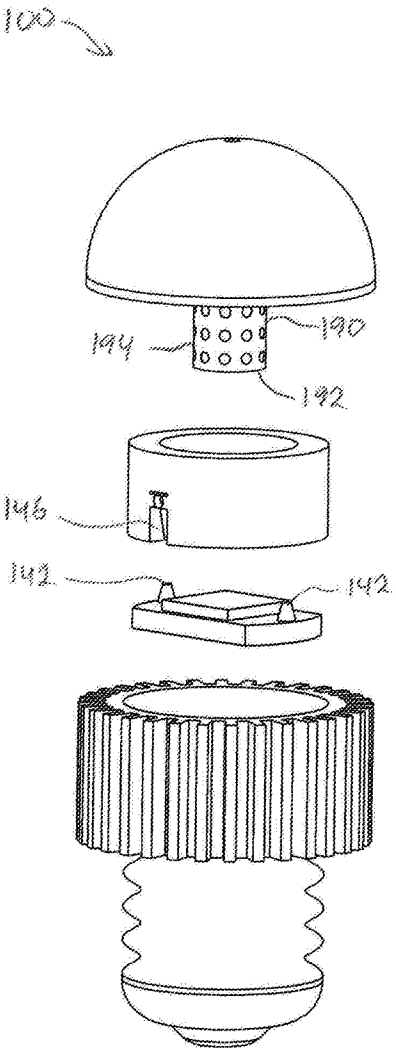
FIG. 15D shows a perspective view of the light source of FIG. 15A with the power supply and the cartridge removed.
Figure 15C:
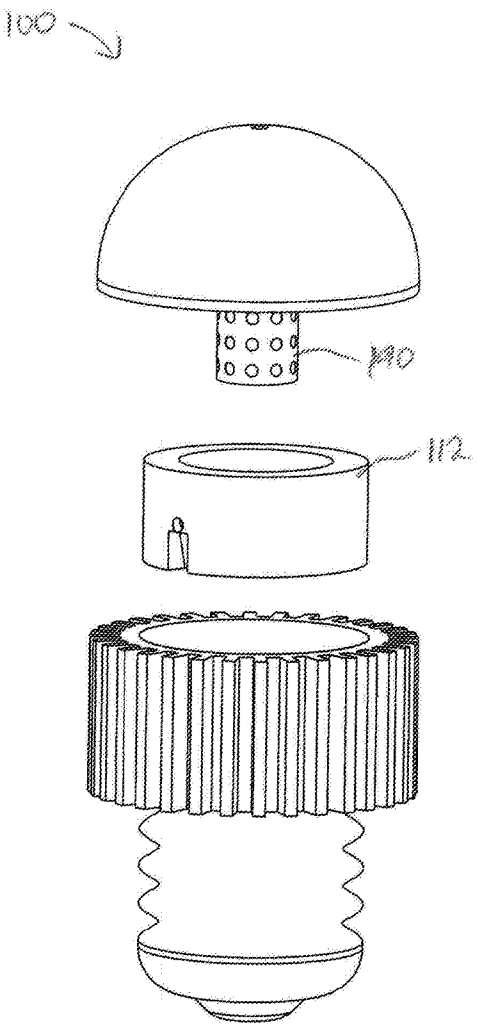
FIG. 15C shows a perspective view of the light source of FIG. 15A with the power supply removed.
Figure 16B:
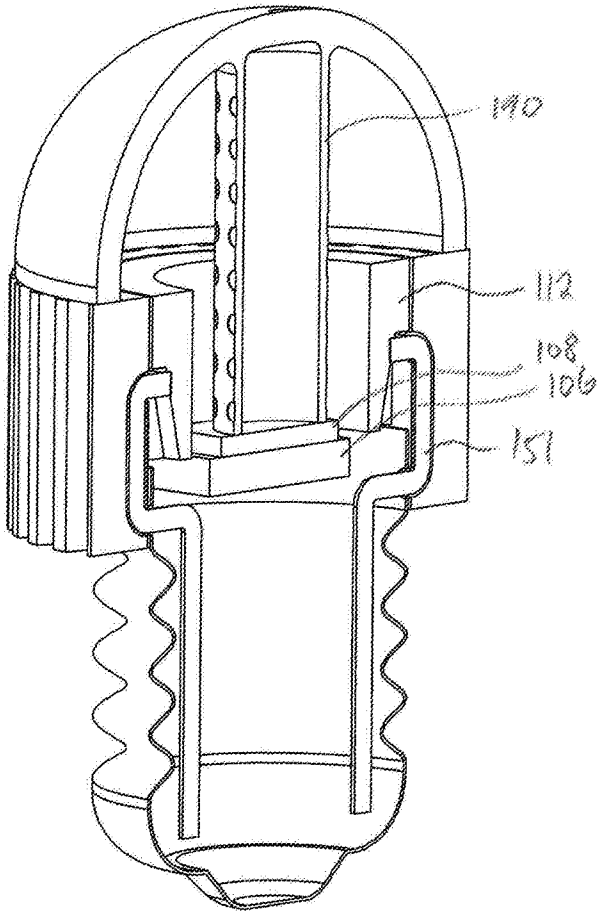
FIG. 16B shows a cross-sectional view of the light source of FIG. 16A along the line J2-J2 in FIG. 16A.
Figure 16A:
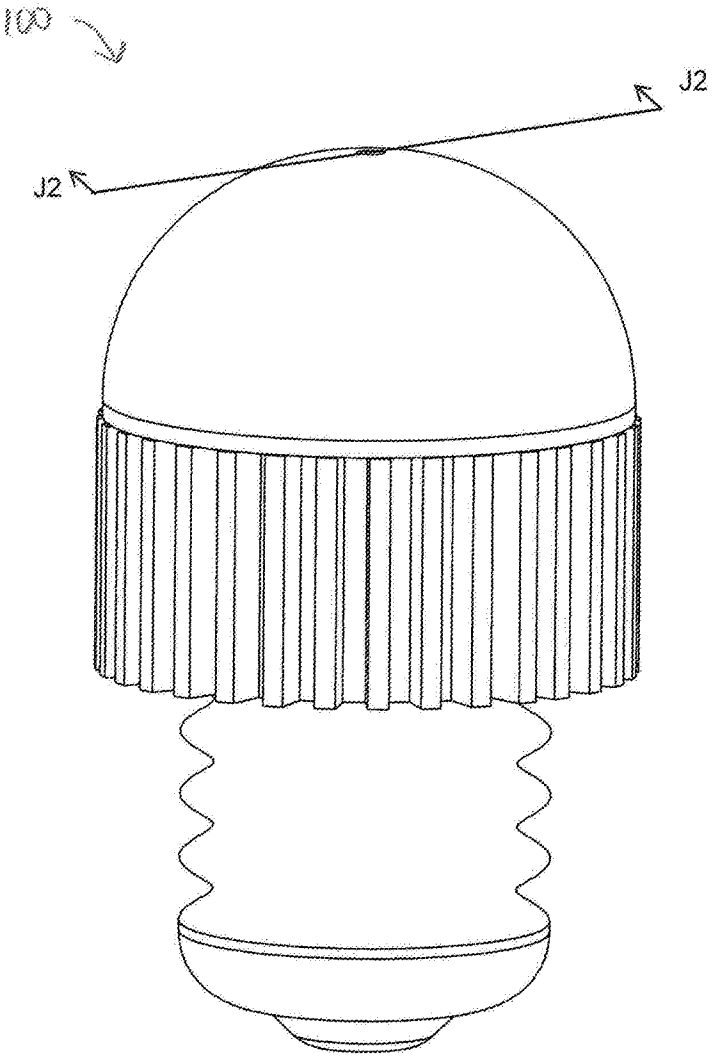
FIG. 16A shows a perspective view of another light source.
Figure 16D:
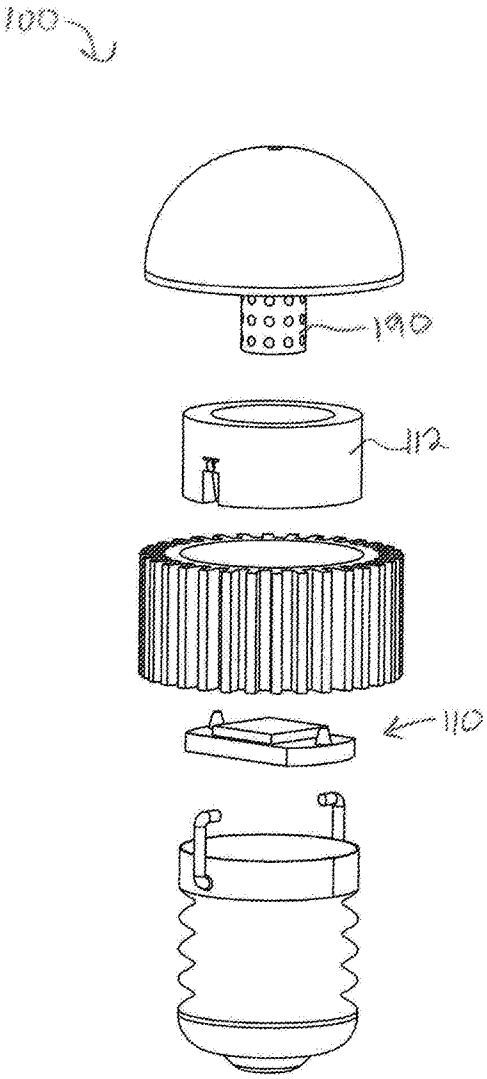
FIG. 16D shows an exploded view of the light source of FIG. 16A.
Figure 16C:
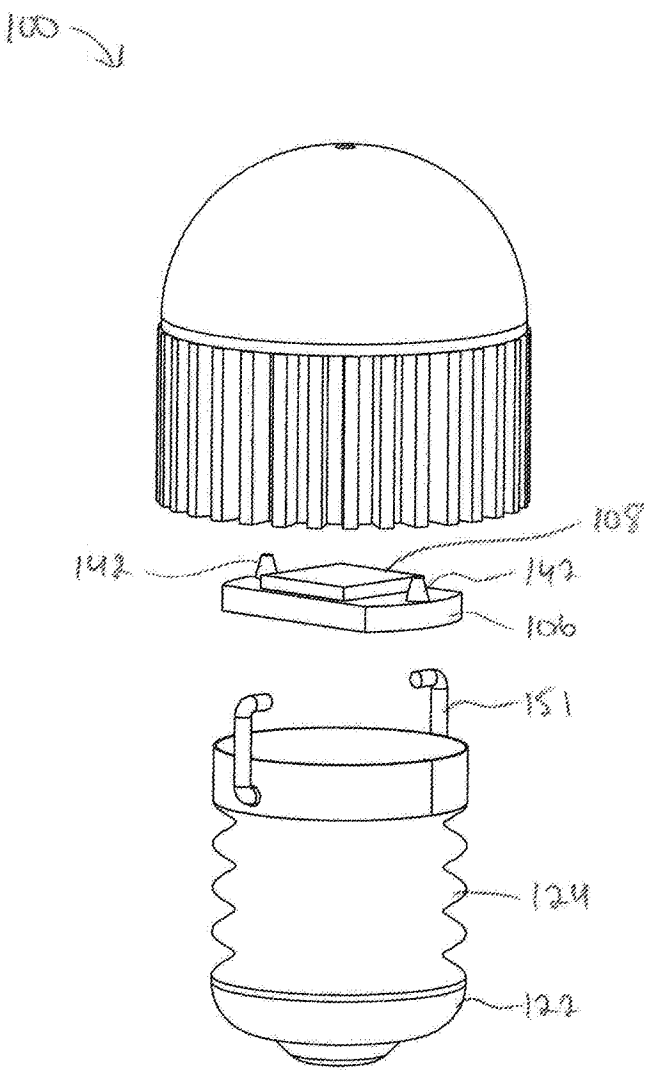
FIG. 16C shows a perspective view of the light source of FIG. 16A with the cartridge removed.
Figure 17C:
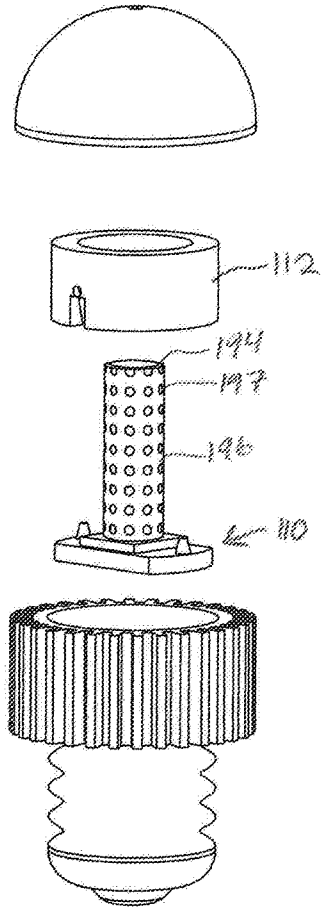
FIG. 17C shows a perspective view of the light source of FIG. 17A with the cartridge, power supply, and light guide removed.
Figure 17B:
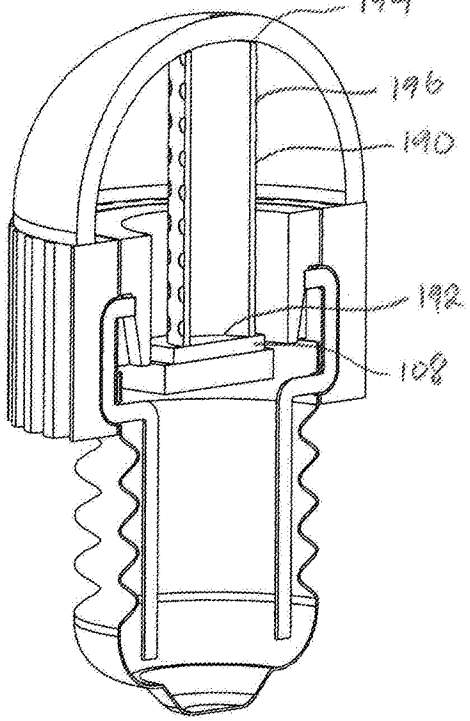
FIG. 17B shows a cross-sectional view of the light source of FIG. 17A along the line J3-J3 in FIG. 17A.
Figure 17A:
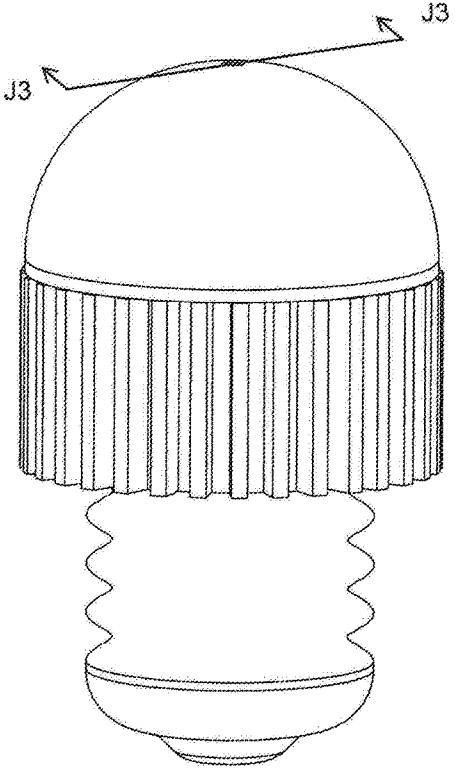
FIG. 17A shows a perspective view of another light source.
Figure 18A:
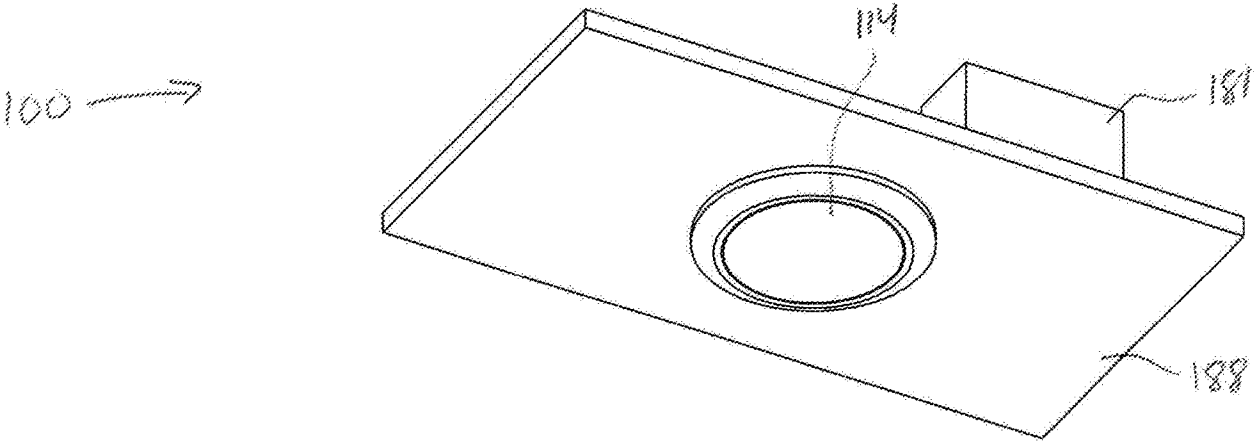
FIG. 18A shows a perspective view from below of another light source.
Figure 18B:
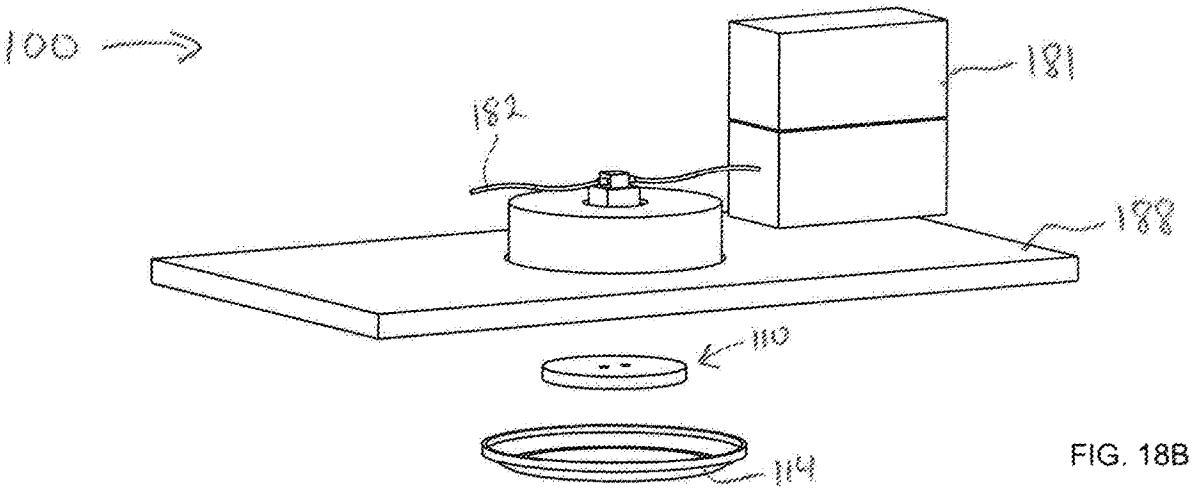
FIG. 18B shows a perspective view of the light source of FIG. 18A with the cartridge and diffuser removed.
Figure 18C:
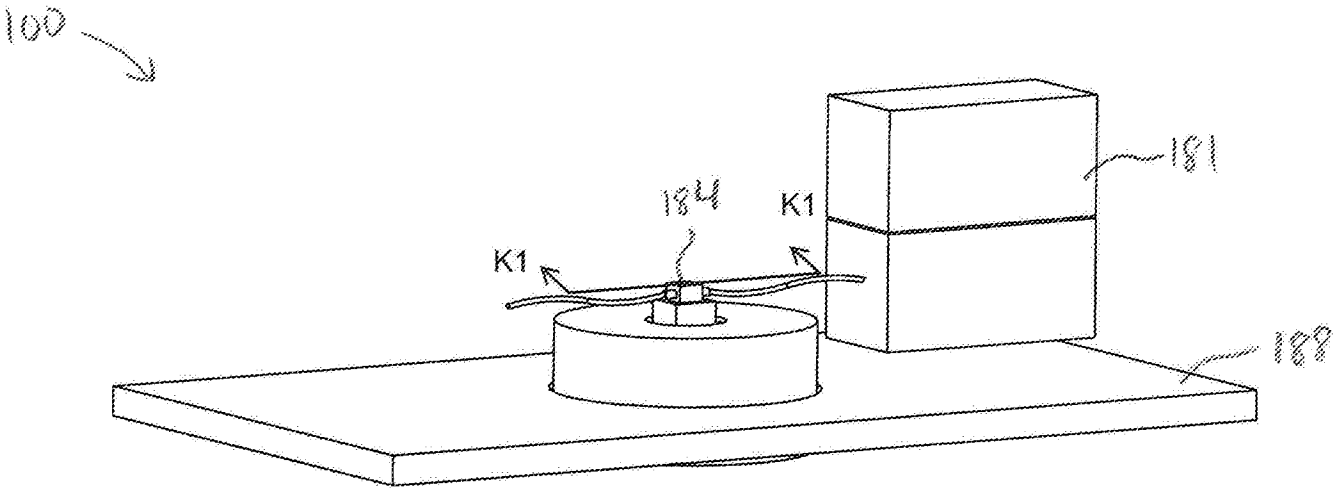
FIG. 18C shows a perspective view from above of the light source of FIG. 18A.
Figure 18D:
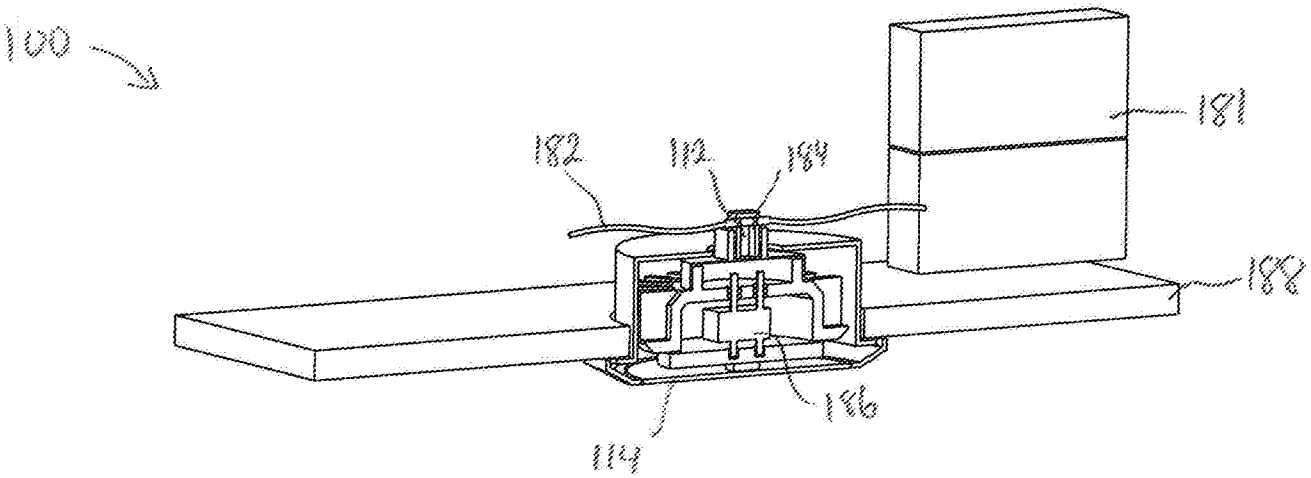
FIG. 18D shows a cross-sectional view of the light source of FIG. 18C along the line K1-K1 in FIG. 18C.
Figure 19A:
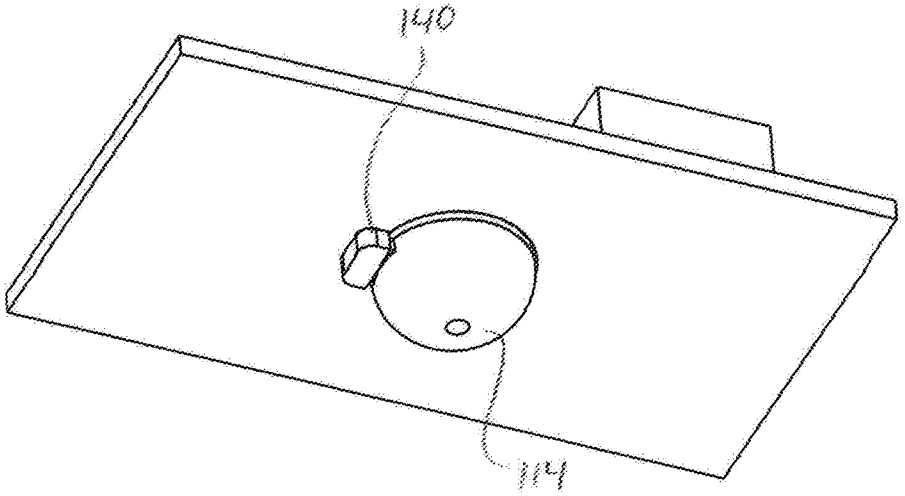
FIG. 19A shows a perspective view from below of another light source.
Figure 19B:
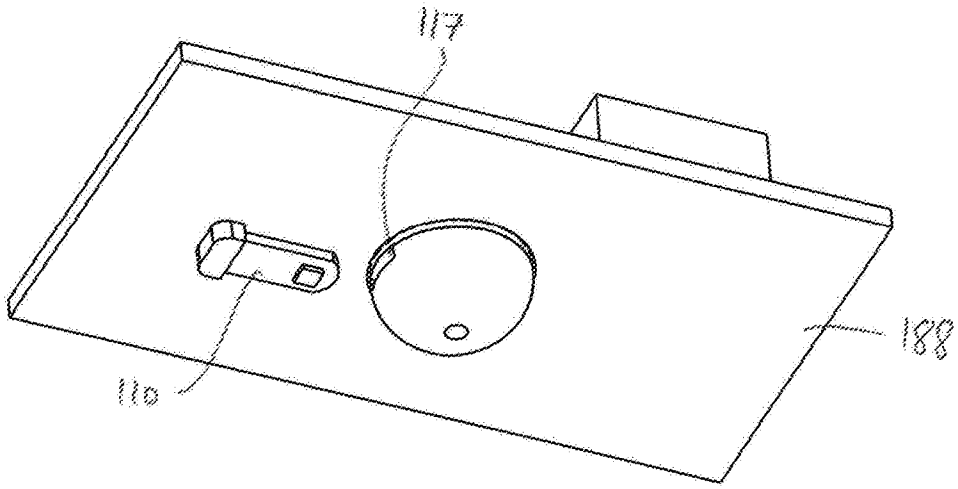
FIG. 19B shows a perspective view of the light source of FIG. 19A with the cartridge removed.
Figure 19C:
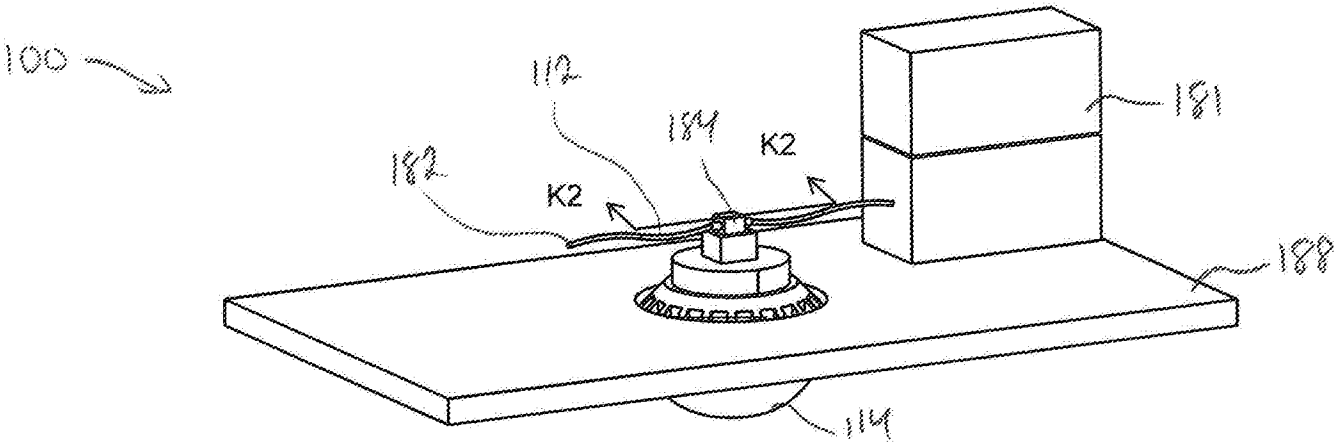
FIG. 19C shows a perspective view from above of the light source of FIG. 19A.
Figure 19D:
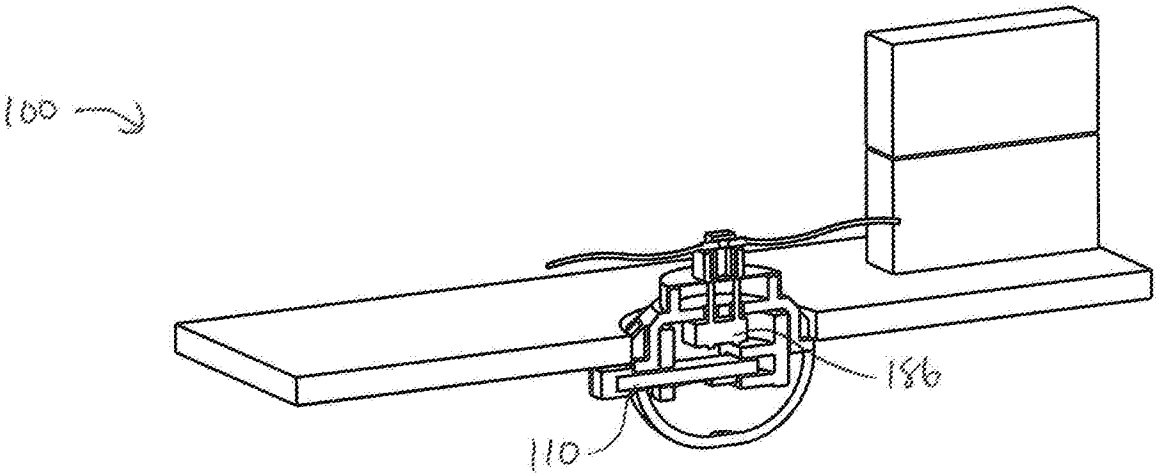
FIG. 19D shows a cross-sectional view of the light source of FIG. 19C along the line K2-K2 in FIG. 19C.
Figure 20A:
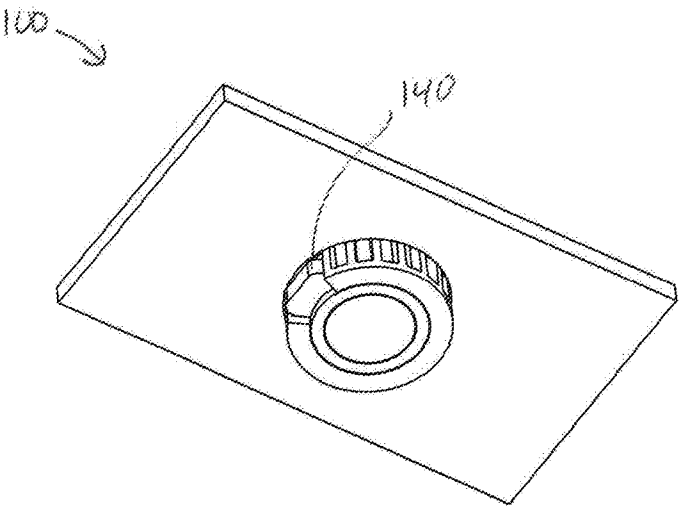
FIG. 20A shows a perspective view from below of another light source.
Figure 20C:
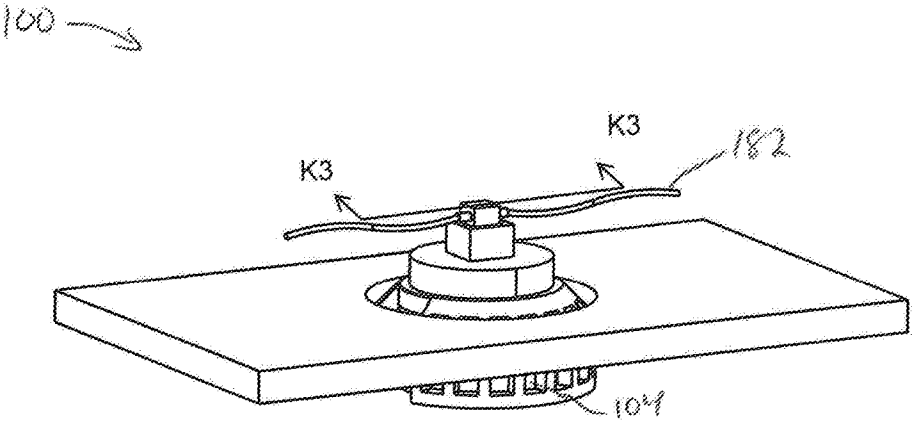
FIG. 20C shows a perspective view from above of the light source of FIG. 20A.
Figure 20B:
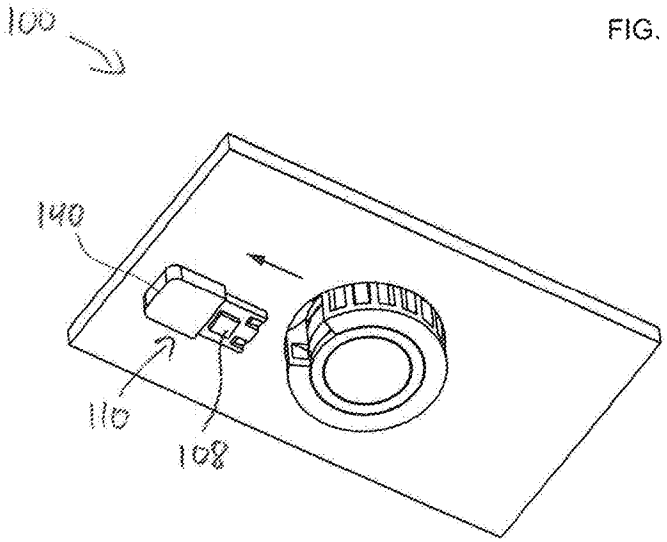
FIG. 20B shows a perspective view of the light source of FIG. 20A with the cartridge removed.
Figure 20D:
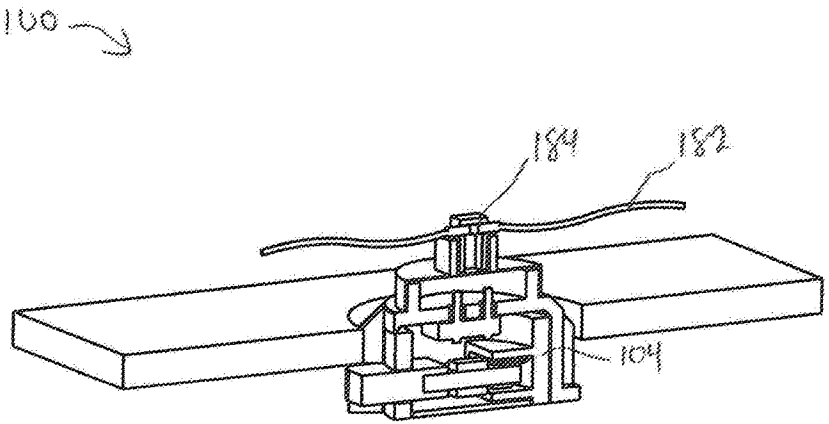
FIG. 20D shows a cross-sectional view of the light source of FIG. 20C along the line K3-K3 in FIG. 20C.
Figure 20F:
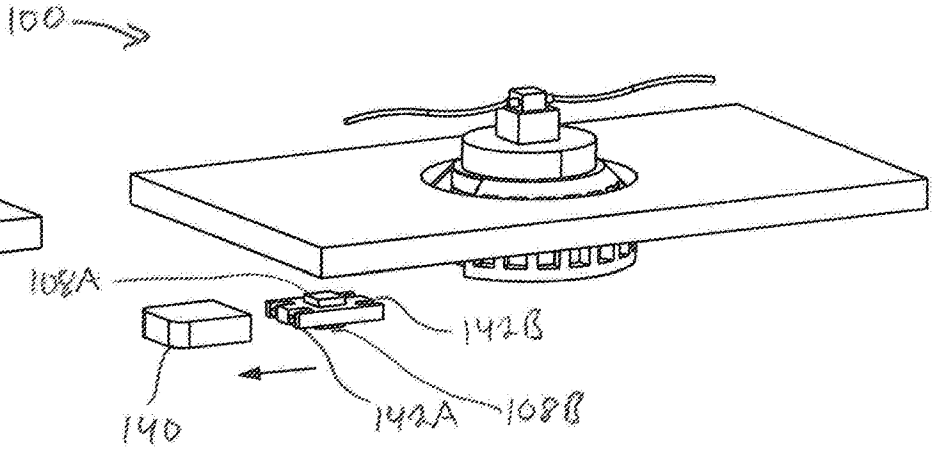
FIG. 20E-20G show perspective views of the light source of FIG. 20A with the cartridge being repositioned to position back up light emitting members in an operable position.
Figure 20E:
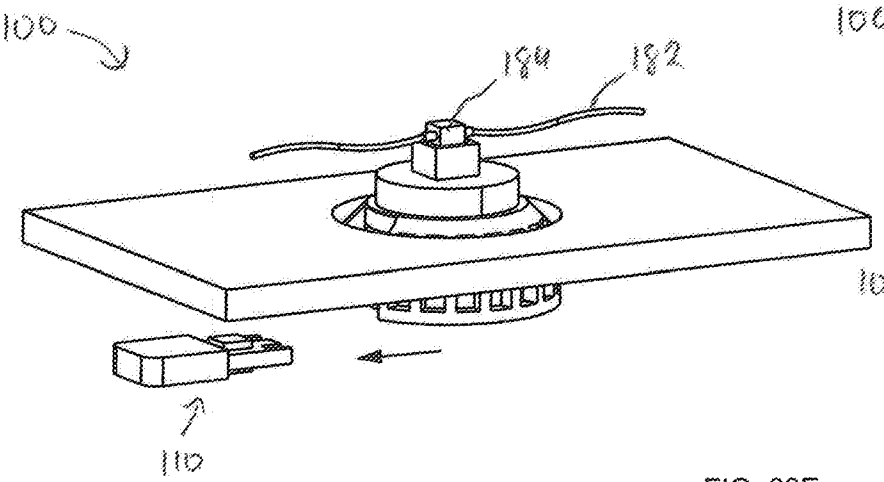
Figure 20G:
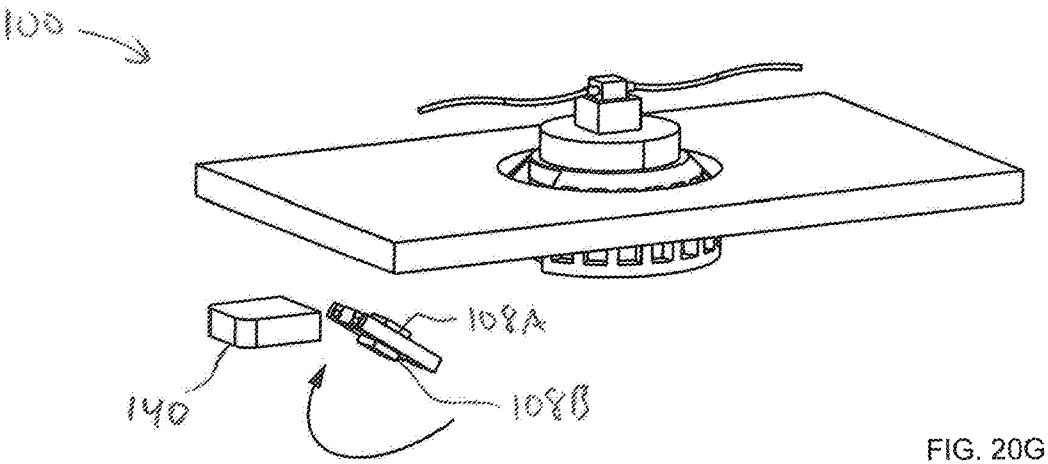
Figure 21A:
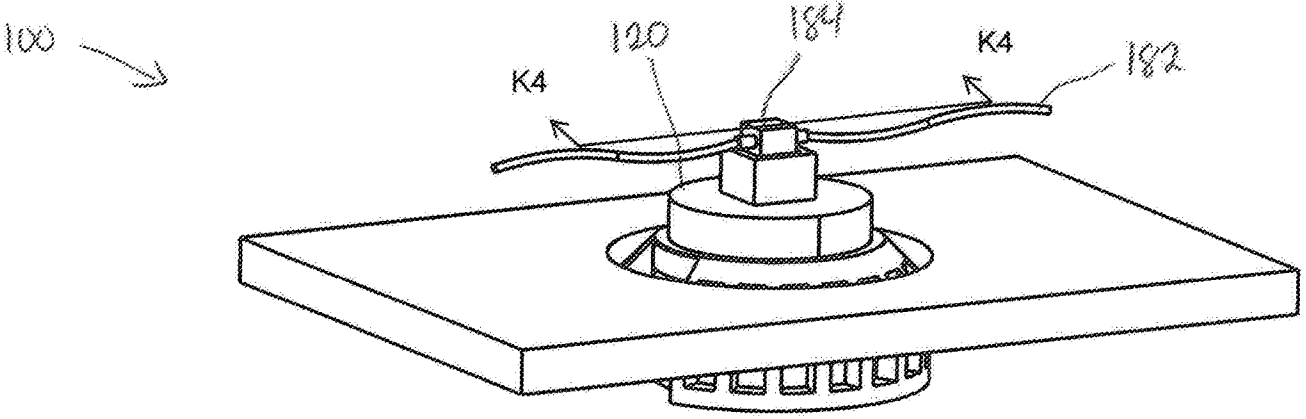
FIG. 21A shows a perspective view of another light source.
Figure 21B:
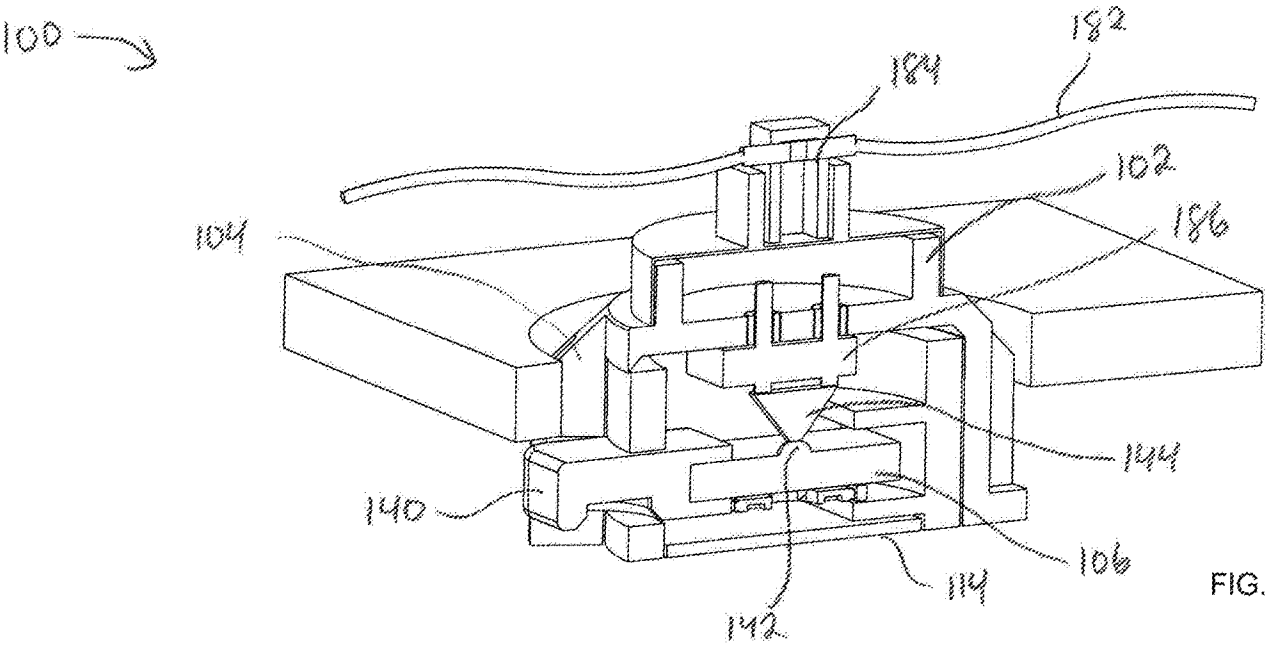
FIG. 21B shows a cross-sectional view of the light source of FIG. 21A along the line K4-K4 in FIG. 21A.
Figure 21C:
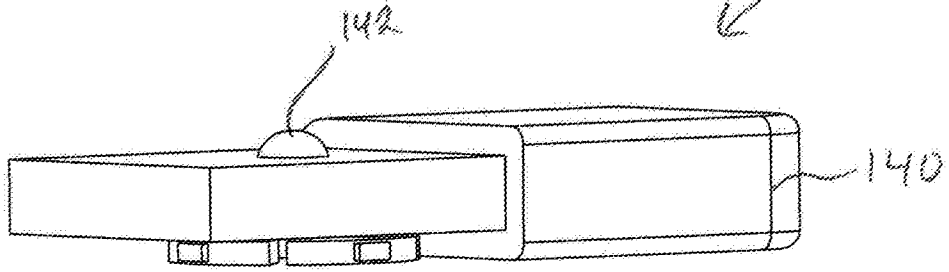
FIG. 21C-21D show perspective views of the cartridge of FIG. 21A.
Figure 21D:
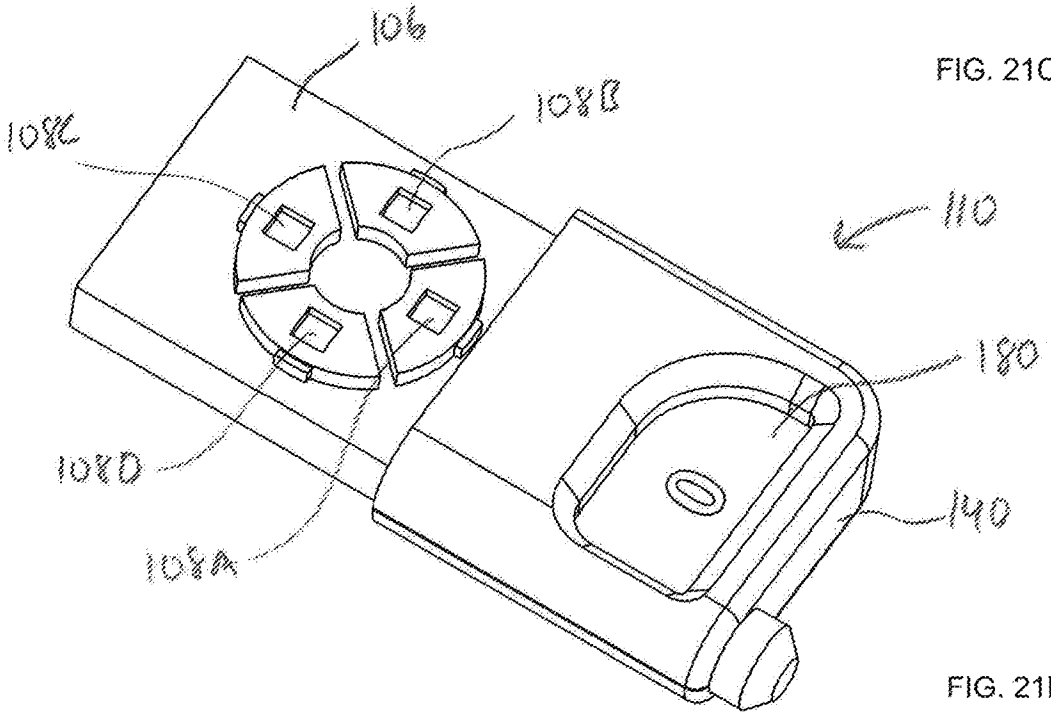
Figure 21F:
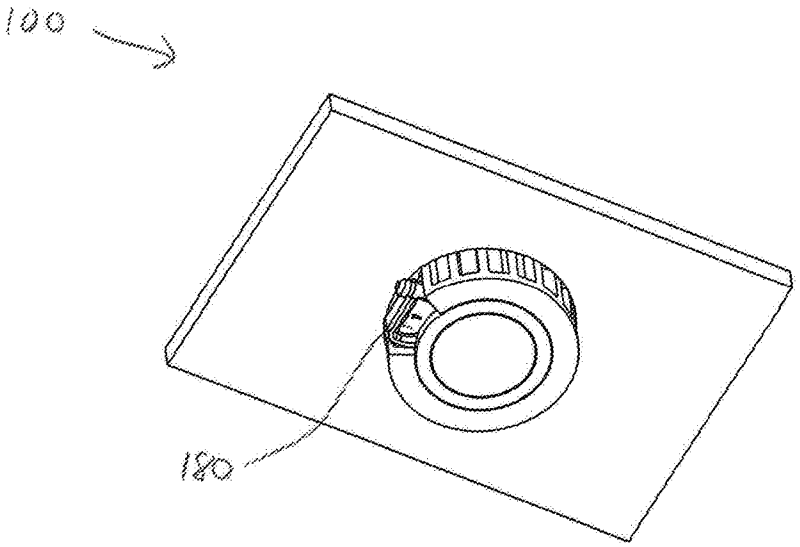
FIG. 21E-21H show perspective views of the light source of FIG. 21A with the cartridge in various operating positions.
Figure 21E:
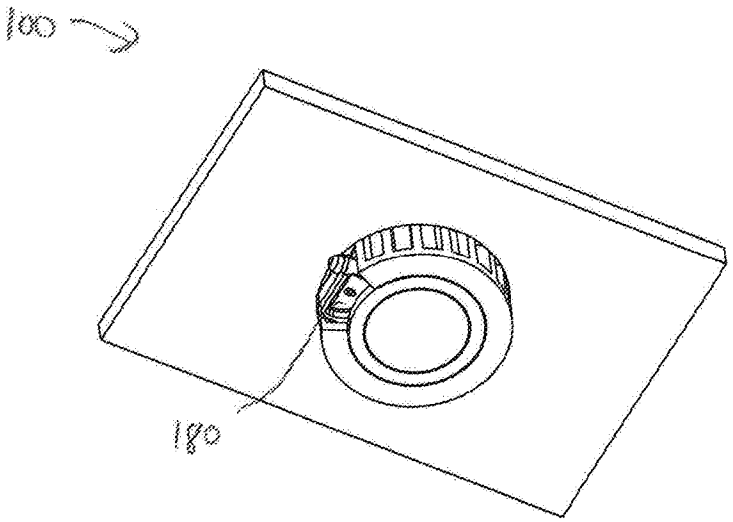
Figure 21H:
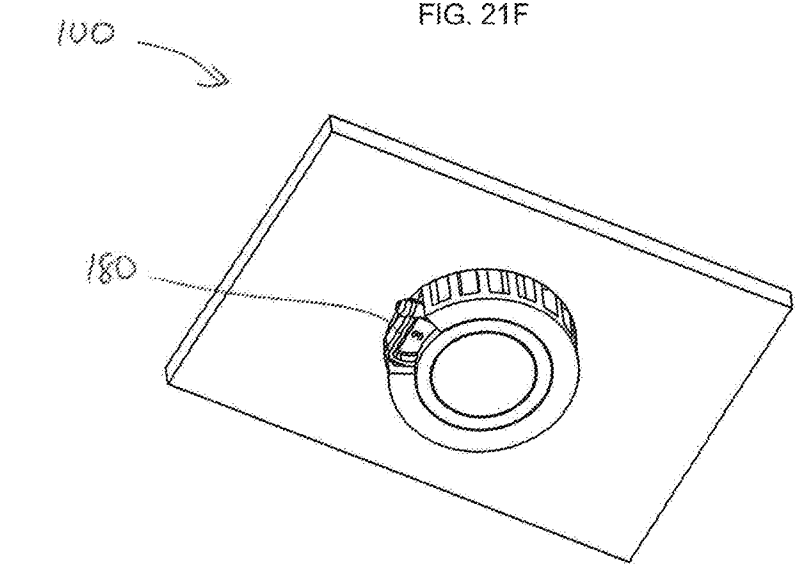
Figure 21G:
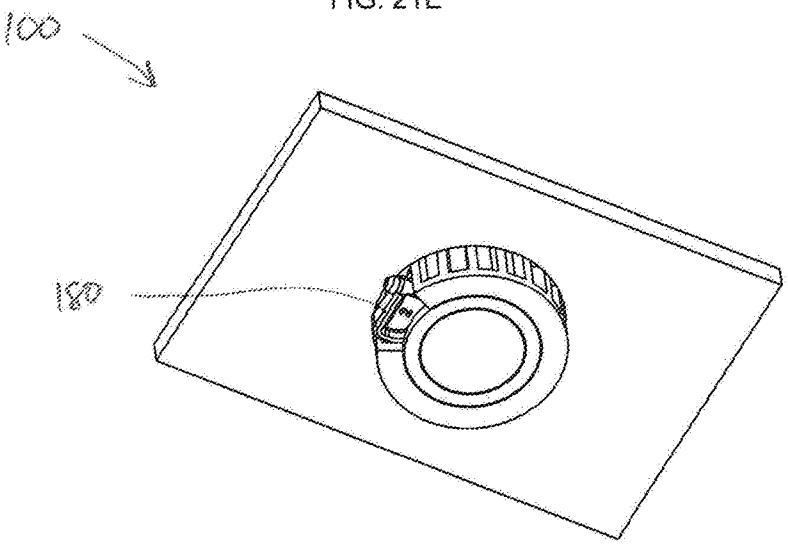
Figure 22A:
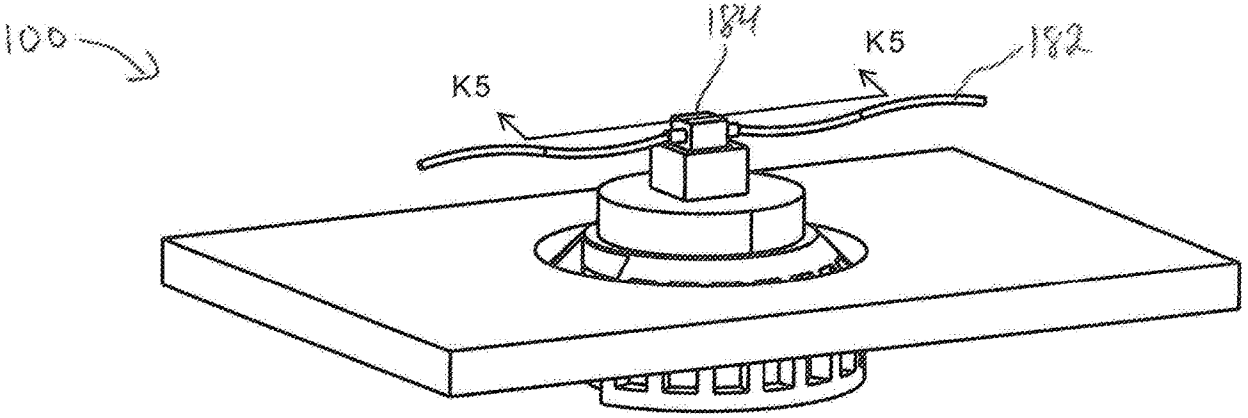
FIG. 22A shows a perspective view of another light source.
Figure 22B:
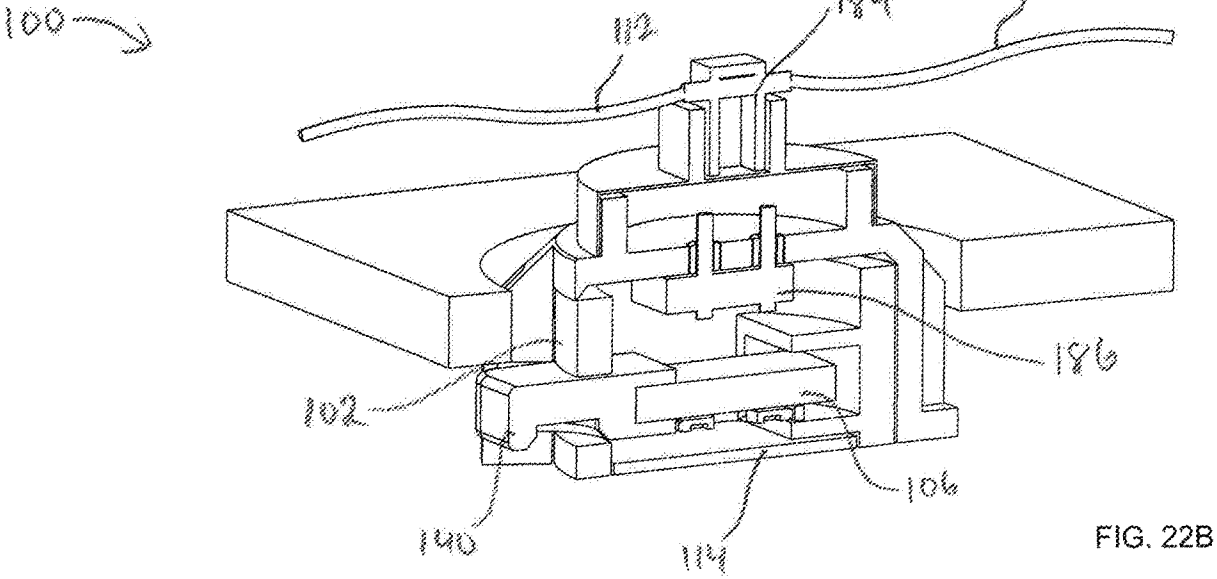
FIG. 22B shows a cross-sectional view of the light source of FIG. 22A along the line K5-K5 in FIG. 22A.
Figure 22C:
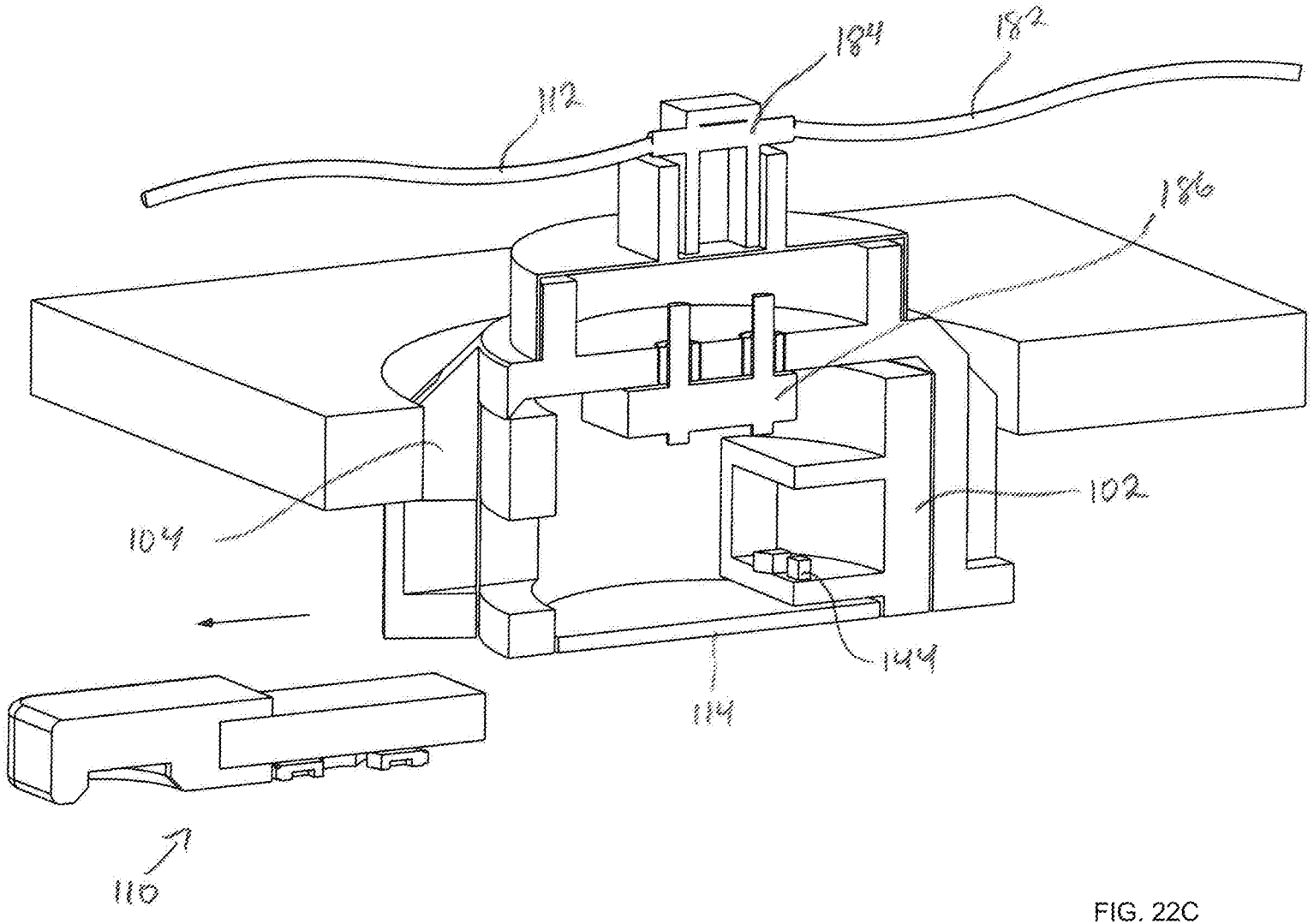
FIG. 22C shows a cross-sectional view of the light source of FIG. 22A along the line K5-K5 in FIG. 22A with the cartridge removed.
Figure 23A:
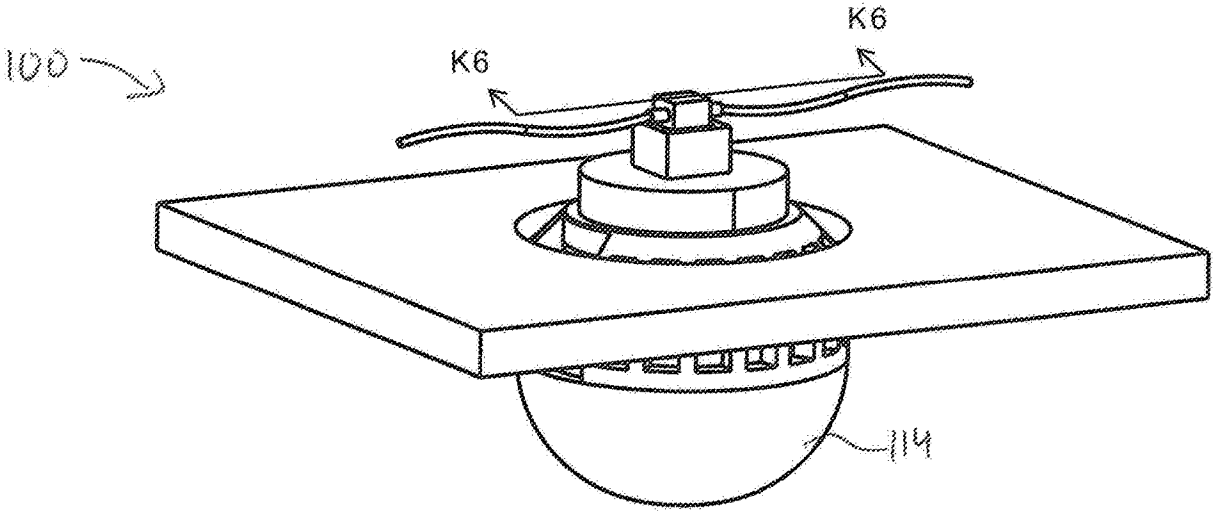
FIG. 23A shows a perspective view of another light source.
Figure 23B:
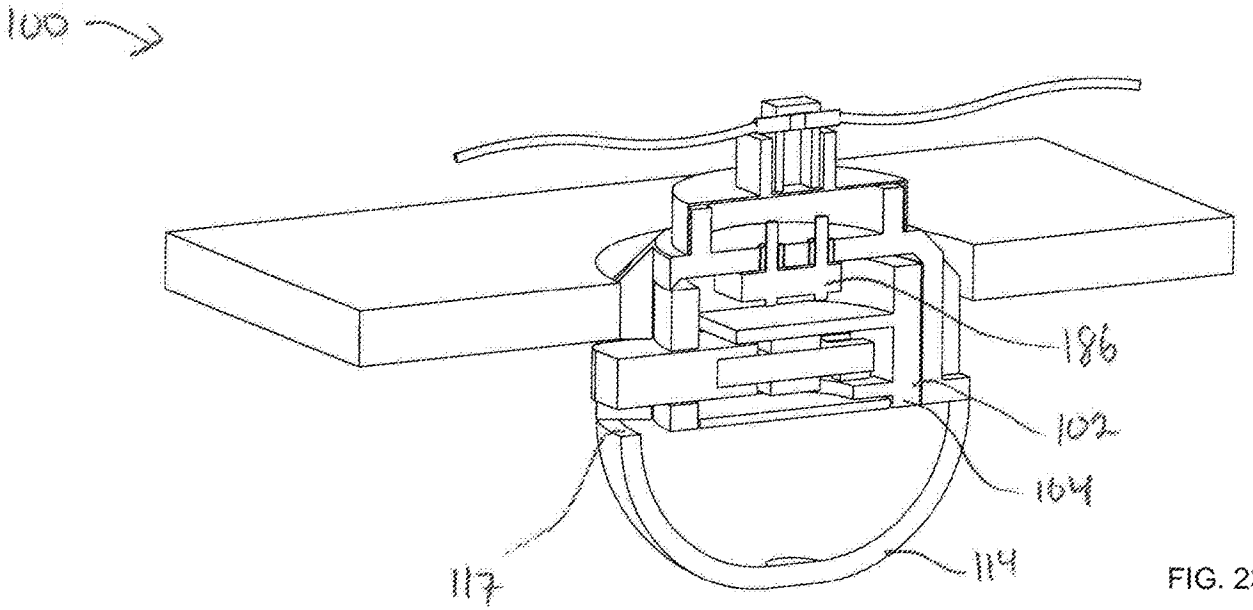
FIG. 23B shows a cross-sectional view of the light source of FIG. 23A along the line K6-K6 in FIG. 23A.
Figure 23D:
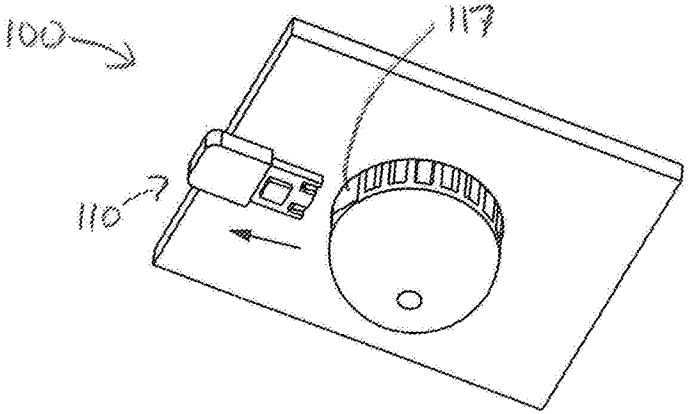
FIG. 23D shows a perspective view from below of the light source of FIG. 23A with the cartridge removed.
Figure 23C:
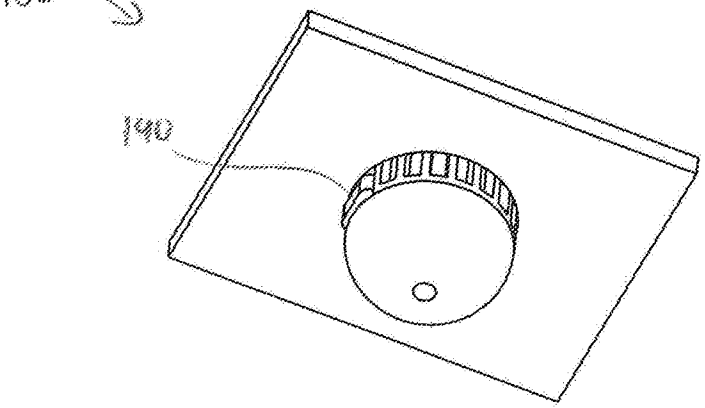
FIG. 23C shows a perspective view from below of the light source of FIG. 23A.
Figure 23E:
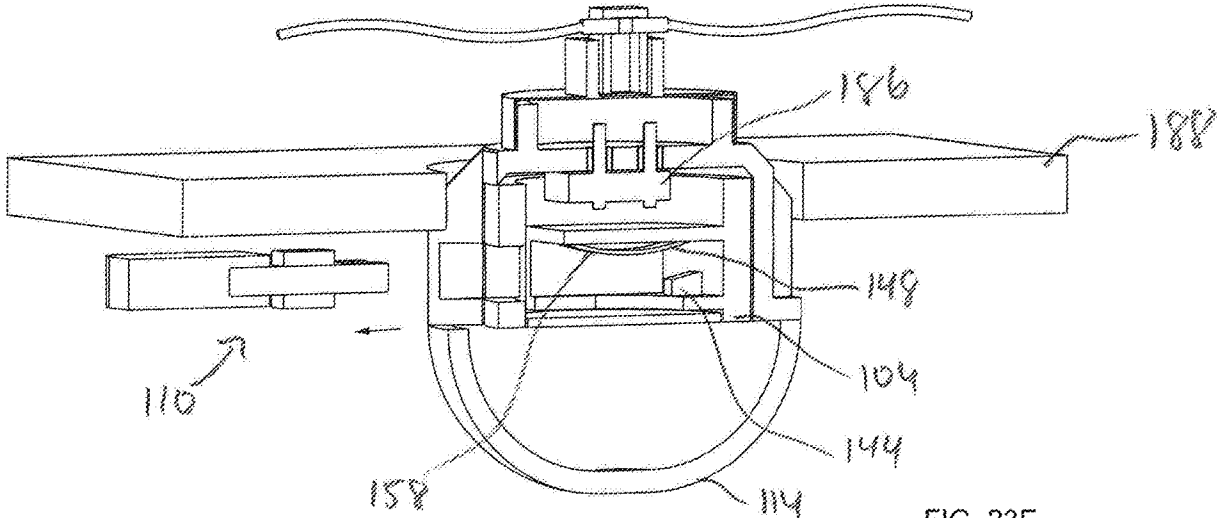
FIG. 23E shows a cross-sectional view of the light source of FIG. 23A along the line K6-K6 in FIG. 23A with the cartridge removed.

As exemplified in FIGS. 14A-14F and 20A-20G, the cartridge 110 has a first light emitting member 108A and a second light emitting member 108B on opposed sides 136, 138 of the substrate. In the first operable position, first substrate contacts 142A are electrically coupled to the electrical contact members 144 such that the first light emitting member 108A is operable while the second light emitting member 108B is inoperable. As exemplified in FIG. 14D, the cartridge 110 may be removed from the light source 100. The handle 140 may be moved from the outer end 132 to the insertion end 130 (see FIG. 14E). The cartridge 110 may then inserted by the outer end 132 into the light source 100 (see FIG. 14F). As shown in FIG. 14F, the cartridge 110 is now in the second operable position. As exemplified, in the second operable position, second substrate contacts 142B may be electrically coupled to the electrical contact members 144 such that the second light emitting member 108B is operable.

In some embodiments, the cartridge 110 may be rotatably mounted in the main body 102 such that the substrate 106 is rotatable from at least a first operable position to a second operable position. As exemplified in FIGS. 21A to 21H, the cartridge 110 has four light emitting members 108A-D and is rotatable between four operable positions. Each light emitting member 108A-D is provided on a section of the cartridge (e.g., a quadrant thereof) and a second substrate contact 142 may be associated with each section (e.g., each quadrant may have a second substrate contact 142). In accordance with this embodiment, the first electrical contact member 144 may remain in electrical connection with the first substrate contact 142 as the cartridge is rotated. In each position as the cartridge is rotated, one of the four second substrate contacts 142 is electrically connected to the second electrical contact member 144 (thereby positioning a light emitting member 108A-108D in position for use) while the other three are electrically disconnected.

Figure 24A:
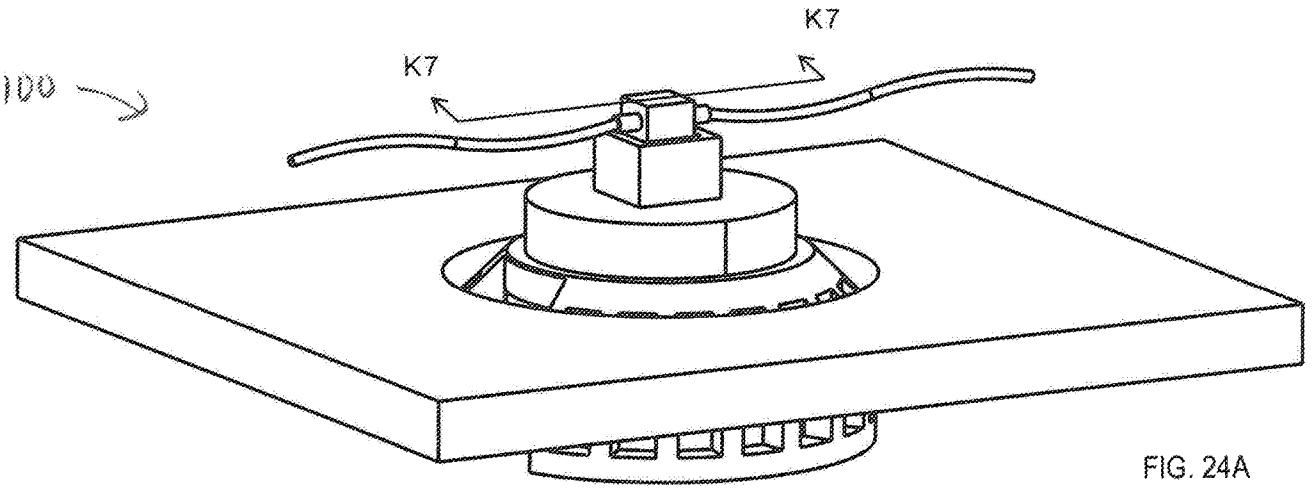
FIG. 24A shows a perspective view of another light source.
Figure 24B:
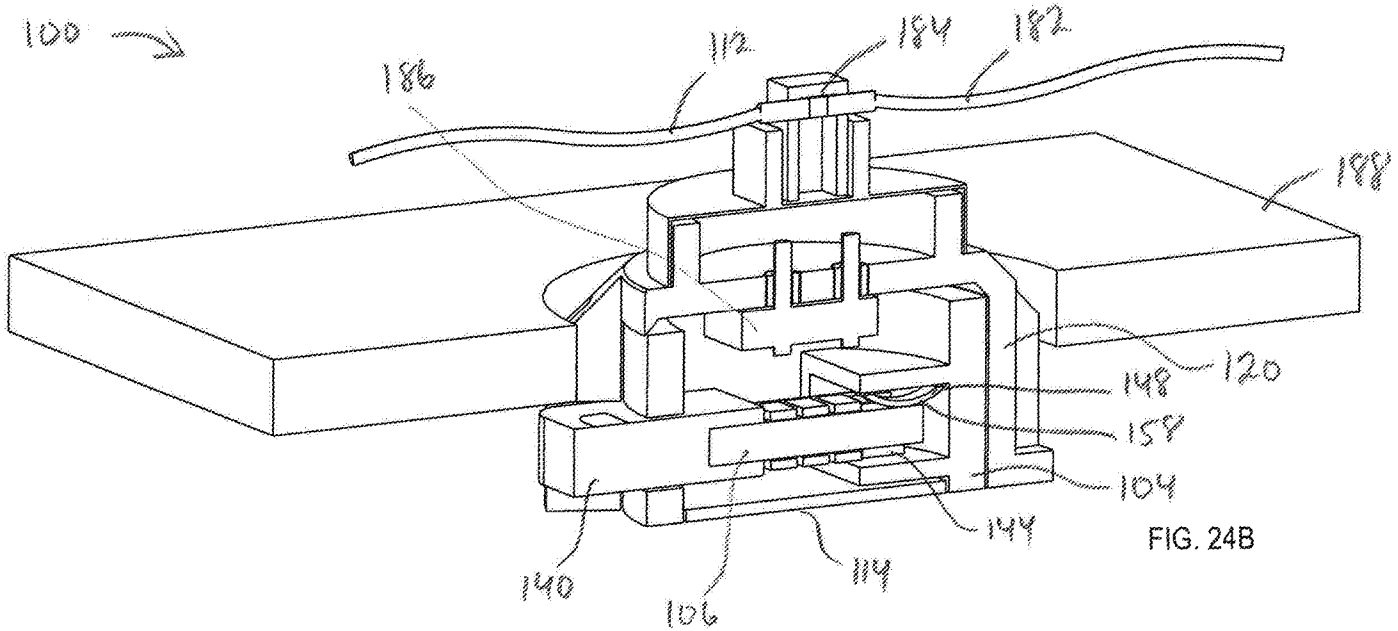
FIG. 24B shows a cross-sectional view of the light source of FIG. 24A along the line K7-K7 in FIG. 24A.
Figure 24C:
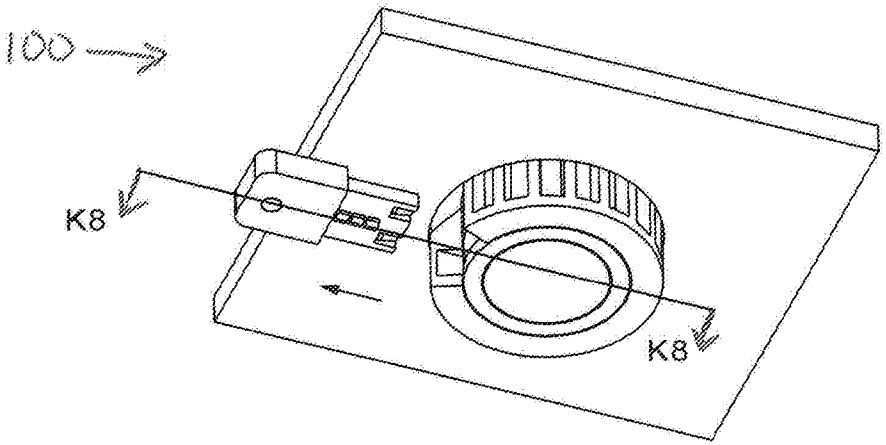
FIG. 24C shows a perspective view of the light source of FIG. 24A with the cartridge removed.
Figure 24D:
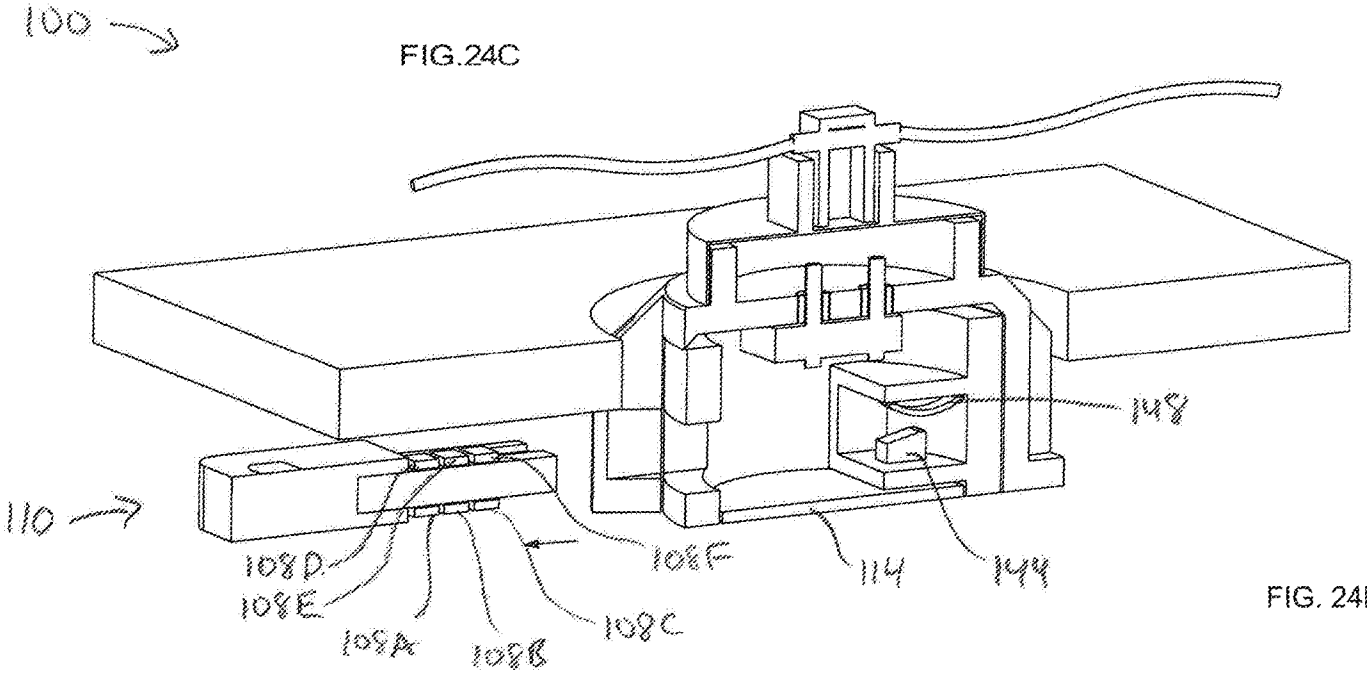
FIG. 24D shows a cross-sectional view of the light source of FIG. 24C along the line K8-K8 in FIG. 24C.
Figure 25C:
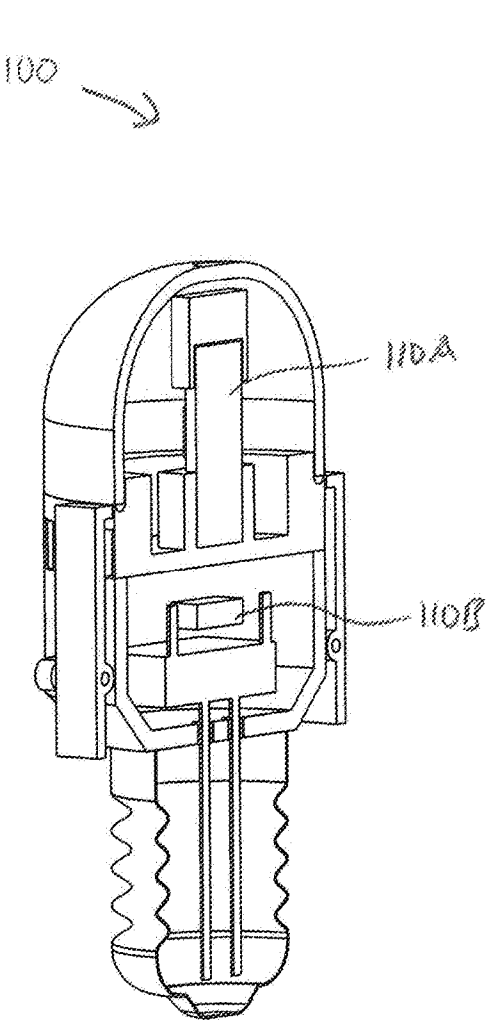
FIG. 25C shows a cross-sectional view of the light source of FIG. 25A along the line L1-L1 in FIG. 25A.
Figure 25B:
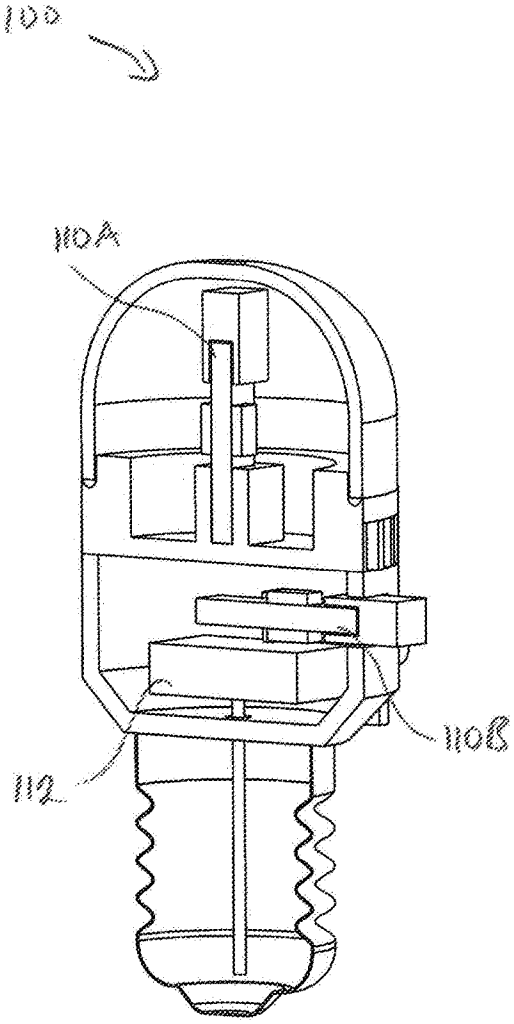
FIG. 25B shows a cross-sectional view of the light source of FIG. 25A along the line L2-L2 in FIG. 25A.
Figure 25A:
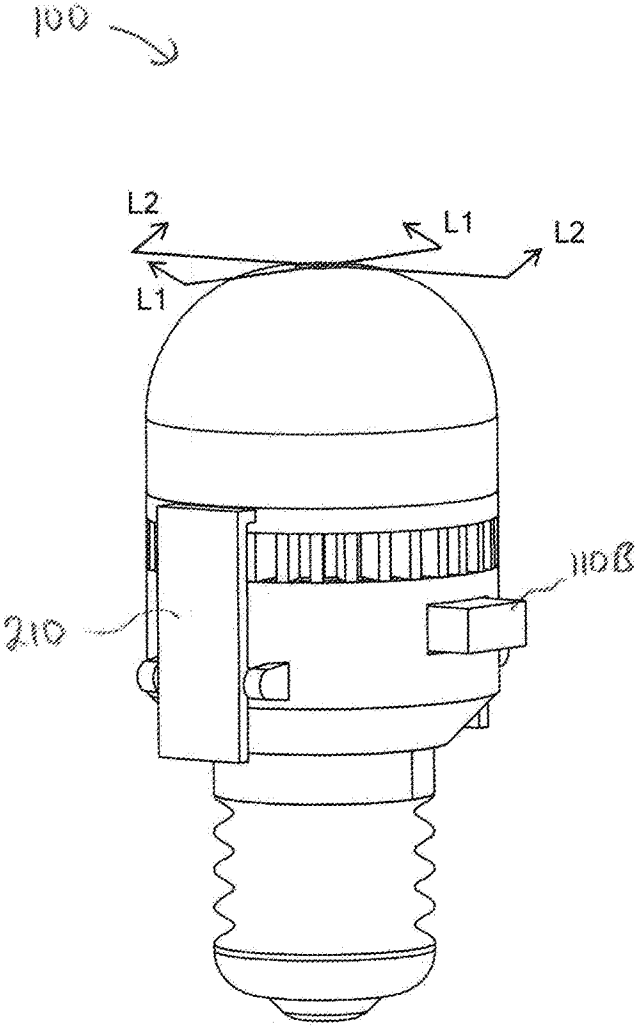
FIG. 25A shows a perspective view of another light source.
Figure 25E:
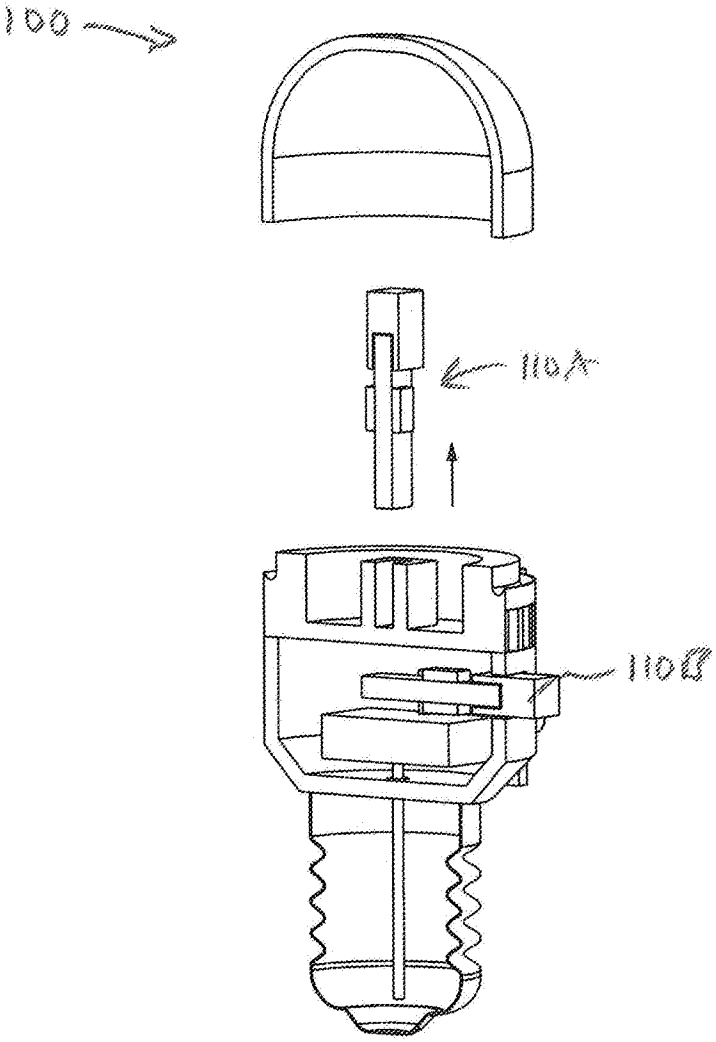
FIG. 25E shows a cross-sectional view of the light source of FIG. 25D along the line L2-L2 in FIG. 25A.
Figure 25D:
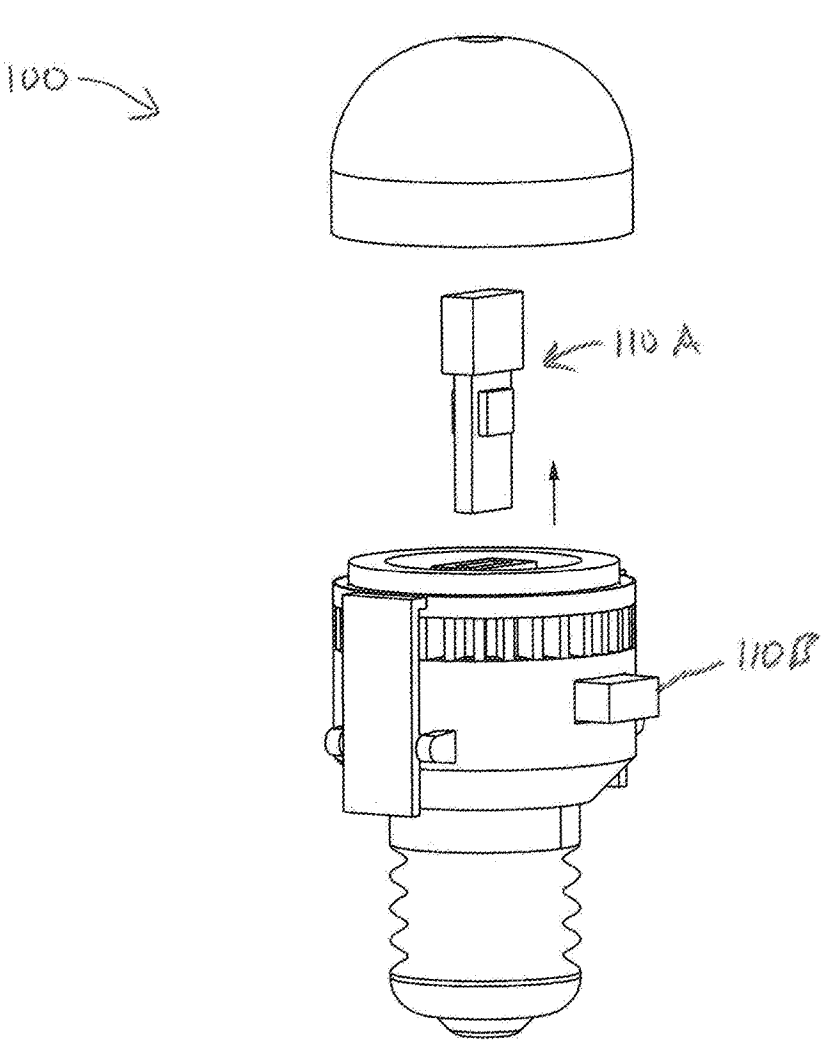
FIG. 25D shows a perspective view of the light source of FIG. 25A with the cartridge removed.
Figures 25F, 25G, 25H:
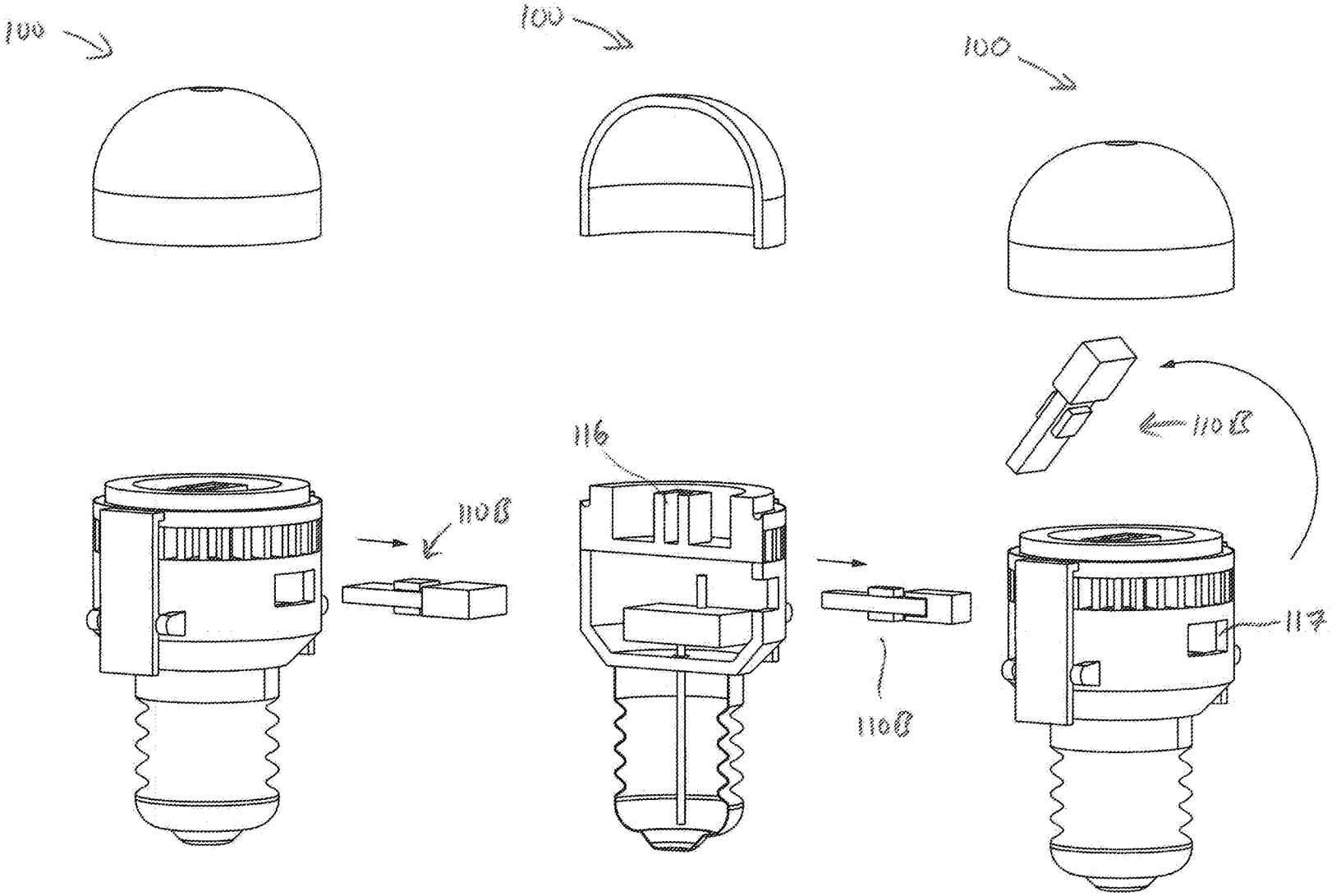
FIGS. 25F and 25H shows a perspective view of the light source of FIG. 25A with the second cartridge removed.
Figure 25J:
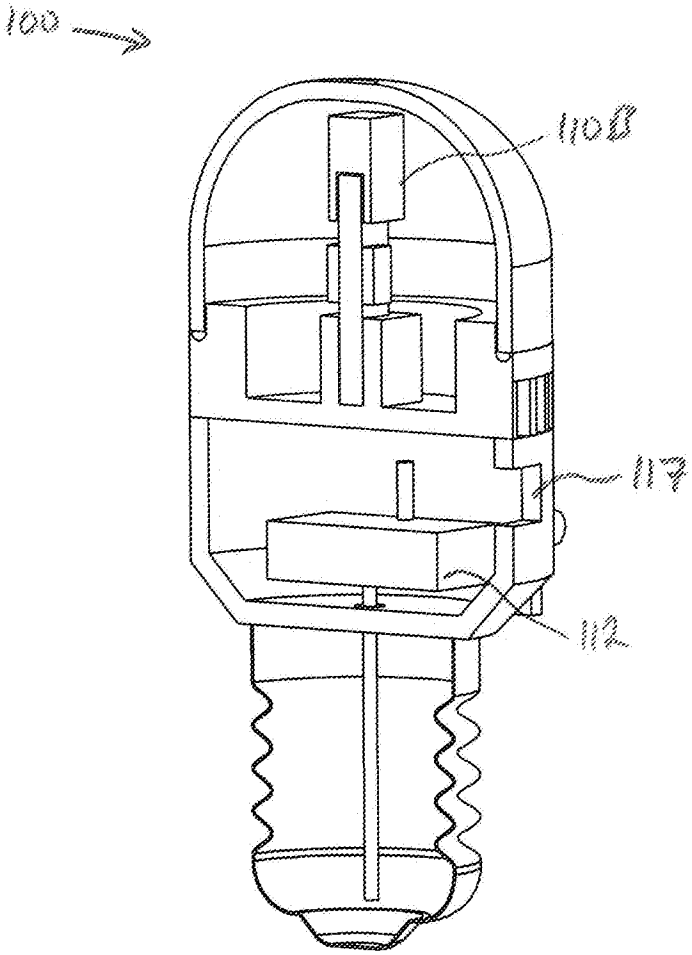
Figure 25I:
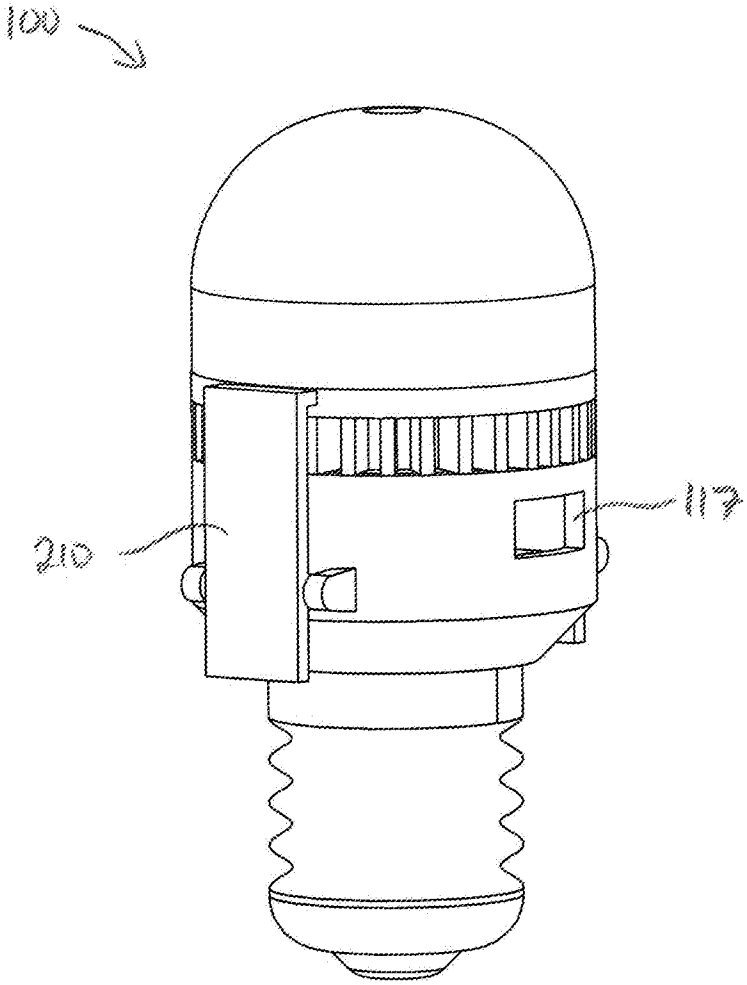
Figure 26B:
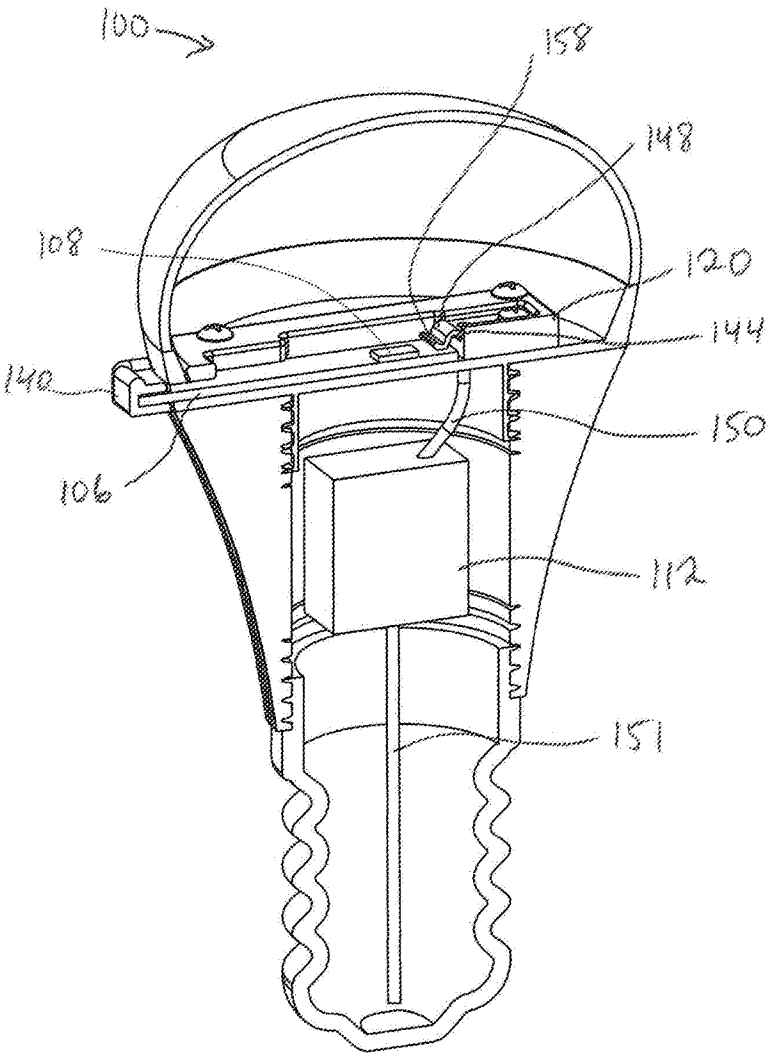
Figure 26A:
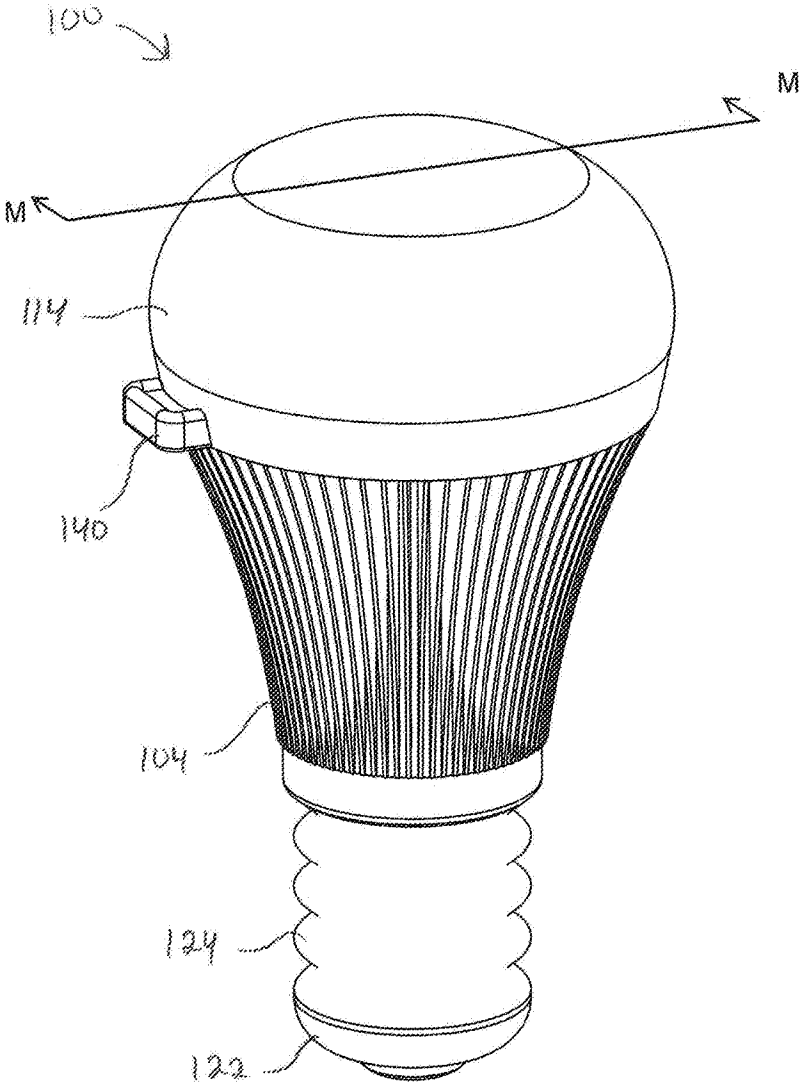
Figure 26D:
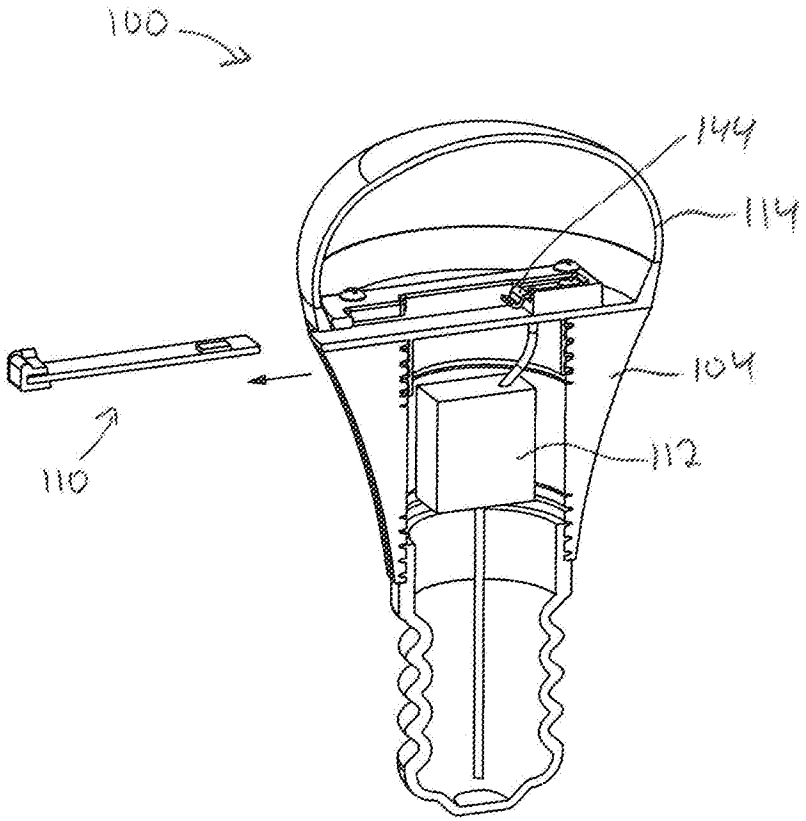
Figure 26C:
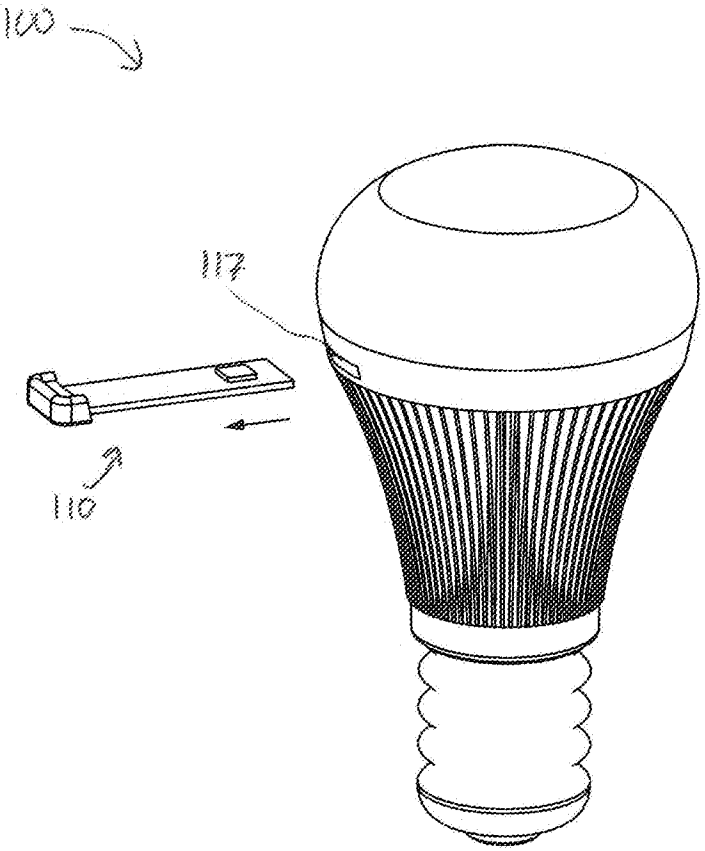
Figure 26F:
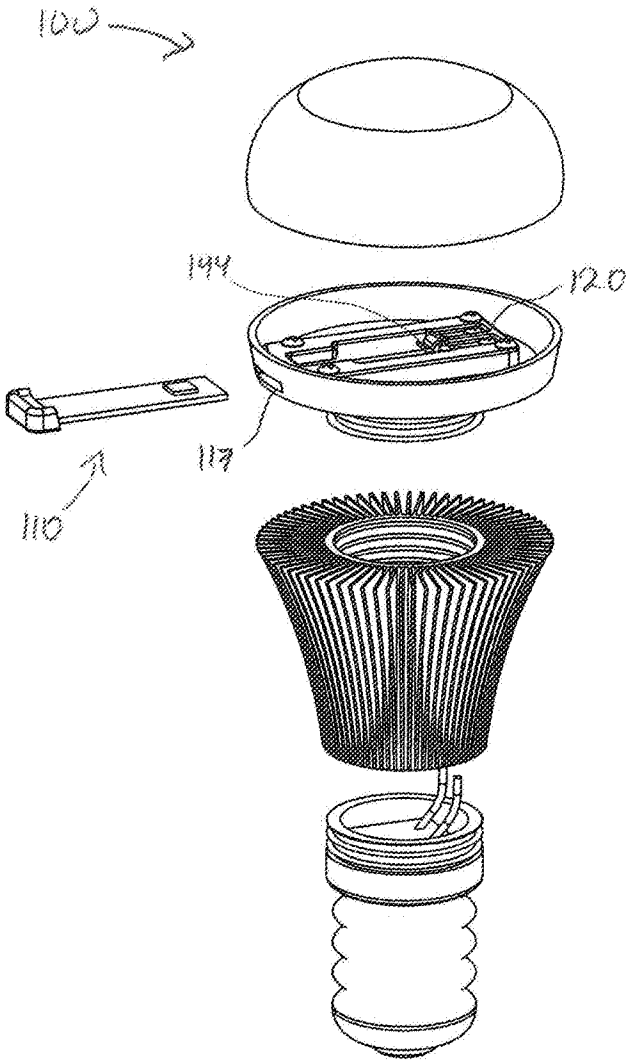
Figure 26E:
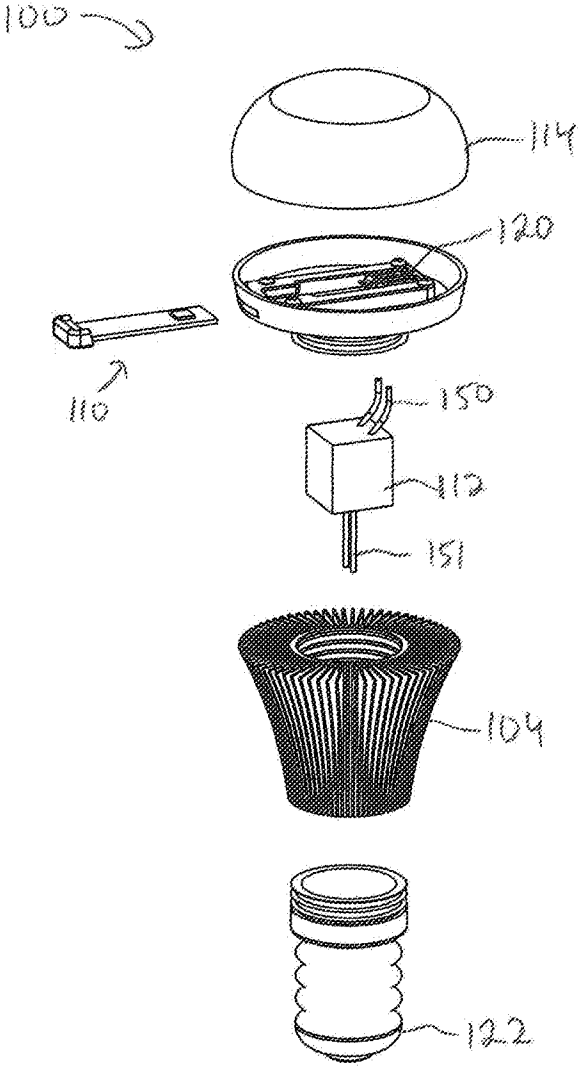

Alternately, or in addition, the cartridge 110 may be slideably insertable into two or more operating positions in the main body 102. Accordingly, cartridge 110 may be slideable from the first operable position to the second operable position. As exemplified in FIGS. 24A-24O, the cartridge 110 slides inwardly from the first operable position (FIGS. 24E and 24H) to the second operable position (FIGS. 24F and 24I) and then further inwardly to the third operable position (FIGS. 24G and 24J).

As exemplified in FIGS. 21A-21H, in any embodiment, the cartridge 110 may include a counter 180. The counter 180 may be used to track the operating position of the cartridge 110. As exemplified, the first position is designated by a "0" on the counter 180, the second position is designated by a "1" on the counter 180, and so forth. Accordingly, a user may be to monitor the number of light emitting members 108 that have been used or are still available for use.

It will be appreciated that the light source 100 may have more than one lighting backup mechanism. For example, the cartridge while in a first orientation may be insertable into two or more positions so as to actuate different light emitting members and it may also be re-orientable so as to actuate one or more alternate backup light emitting members. For example, as exemplified in FIGS. 24A-24O, the cartridge 110 has six operating positions using two backup mechanisms. The cartridge 110 is slideably received in the light source 100 and has three light emitting members 108A-108C on the first side 136 and three light emitting members 108D-108F on the second side 138. The cartridge 110 may be oriented with a first side facing up and sequentially insertable inwardly so as to actuate each of the three light emitting members on one face (operating positions one to three, See FIGS. 24E-F). The cartridge may then be removed and reoriented (flipped) with the opposed side facing upwardly (see FIGS. 24*k*, 24L) and sequentially insertable inwardly so as to actuate each of the three light emitting members on the second side (operating positions four to six, see FIGS. 24M-24O).

Alternately, or in addition, the backup light emitting members may be located on one or more back up cartridges that are stored on the light source (e.g., a backup cartridge could be stored interior to a light source (e.g., in a separate recess) or on an exterior surface of the light source.

As exemplified in FIGS. 25A-25J, the light source 100 has a first cartridge 110A and a second cartridge 1108, each cartridge having first and second light emitting members 108A and 108B respectively. In a first configuration, as exemplified in FIGS. 25A-25C, the first cartridge 110A is positioned in the recess and is operable. Optionally as exemplified, when in the first configuration, the second cartridge 1108 may be in a storage position in a storage recess provided in the light source or the second cartridge 1108 may be positioned on an exterior surface of the main body 102. If cartridge 110A has first and second light emitting members 108A and 108B, then only one light emitting member may be used at a time. Accordingly, as discussed previously, in a first orientation of cartridge 110A, light emitting member 108A may be used and in a second orientation of cartridge 110A, light emitting member 108B may be used. When desired or when all light emitting members of cartridge 110A have failed, cartridge 110A may be removed and replaced by cartridge 1108. To reach the second configuration, the first cartridge 110A may be slidably removed (or, e.g., the light source may be disassembled as discussed previously) from the light source 100 and the second cartridge 1108 may be slideably inserted into the light source 100. Accordingly, As exemplified in FIGS. 25F-25H, cartridge 1108 may be removed from the storage position and inserted into the recess such that cartridge 1108 is operable (see FIGS. 25I-25J). If cartridge 1108 has first and second light emitting members 108A and 108B, then only one light emitting member may be used at a time. Accordingly, as discussed previously, in a first orientation of cartridge 1106, light emitting member 108A may be used and in a second orientation of cartridge 110A, light emitting member 1086 may be used.

It will be appreciated that if a backup cartridge 1106 is provided, then each cartridge 110A, 1106 may have only one light emitting member or all the light emitting members on a cartridge 110A, 1106 may be operable at the same time.

Alternately, or in addition to repositioning light emitting members, a switch may be provided to actuate different light emitting members. Accordingly if one or more light emitting member fails, the switch may be actuated such that one or more alternate light emitting members are operable. For example, the light source 100 may have a switch operable between two positions. In the first position, the first light emitting member 108A may be operable and in the second position the second light emitting member 108B may be operable. It will be appreciated that the switch may be any mechanism capable of electrically connecting light emitting members 108 as part of the operating circuit.

In some embodiments, the switch may automatically be actuated if the first light emitting member 108A malfunctions, thereby causing the second light emitting member 108B to emit light.

In some embodiments, a plurality of light emitting members may be operable in a first operating position and a backup light emitting member may be actuatable (e.g., by repositioning the cartridge 110 or a switch) to be operable if one of the plurality of light emitting members fails. For example, the substrate 106 may have a third light emitting member 108C and the substrate 106 may be positionable in the main body 102 in first and second operable positions. In the first operable position, the first light emitting member 108A and second light emitting member 108B may be operable to provide illumination while the third light emitting member 108C is inoperable. In the second operable position, the third light emitting member 108C may be operable to provide illumination in addition two light emitting members 108A and 108B.

It will be appreciated that the plurality of light emitting members may have varying lighting characteristics. For example, in some embodiments, they may emit different colours of light. Accordingly a first light emitting member 108A may emit a first colour of light and a second light emitting member 108B may emit a second colour of light. Alternately, or in addition, the light emitting members may emit different levels of illumination. For example, a first light emitting member 108A may emit a first level of illumination and a second light emitting members 108B may emit a second level of illumination wherein the second level of illumination is greater than the first level of illumination. For example, the first level of illumination may range from 3 to 6 Watts and the second level of illumination may range from 6 to 10 Watts.

In some embodiments, a switch may control the level of illumination of the light source 100.

Securing the Cartridge to the Light Source

The following is a description of securing a cartridge to a light source, which may be used by itself or in combination with any one or more other aspects discussed herein.

In accordance with this aspect, the securing members used to secure the cartridge to the light source may have one or more additional functions. For example, the securing means may also be electrically conductive, facilitating the electrical connection between the power supply and the cartridge. Alternately the securing means may also be thermally conductive, facilitating the thermal connection between the heat sink and the cartridge. Alternately the securing means may be both electrically and thermally conductive, facilitating the connection between the cartridge and each of the heat sink and the power supply. An advantage of this aspect is that fewer components may be required to facilitate the various connections (mechanical, thermal, electrical) between the cartridge and the light source. The use of fewer components may reduce the likelihood of component failure and may facilitate easier replacement of individual components.

As exemplified in FIGS. 5A-10E, 13A-13E, 19A-24O, and 26A-29C, the electrically conductive body portion 146 may be mounted to the main body 102 such that the substrate 106 is mechanically secured to the main body 102 by the electrically conductive body portion 146. Various mechanical securing mechanisms may be used including a friction fit (e.g., the substrate fits in a recess such that the contact between the sides of the recess and the cartridge secure the cartridge in position, see, e.g., FIG. 5A) and at least one biasing member 148 (see, e.g., FIGS. 13A-13E).

A biasing member may be a spring, a magnet, or any other component capable of exerting a biasing force to secure or assist in securing a cartridge in a recess. Optionally, the biasing member is a mechanical member that is shaped to provide the biasing force. Accordingly, the biasing member may be bow shaped (see, e.g., FIG. 6B). The two opposed ends of such a bow shaped biasing member may be secured to an inner wall of a recess. Optionally, only one end may be secured to, e.g., the inner wall of a recess and the other opposed end may be free floating (see, e.g., FIG. 7B).

Various numbers of biasing members 148 may be used. For example, as exemplified in FIG. 10B, two biasing members that engage opposed sides of a cartridge may be used. Accordingly, a first biasing member 148 may exert a force in a first direction on the substrate 106 and the second biasing member 148 may exert a force in a direction opposite to the first direction on the substrate 106. Alternately, as exemplified in FIG. 7B, a single biasing member 148 may be used. In such a case, the single biasing member may provide a biasing force to position the substrate against an opposed surface (e.g., an inner surface of a recess 116).

The biasing members may be provided at various locations internal of the light source. Optionally, as exemplified in FIGS. 3A-6E, 10A-11E, 13A-14F, 19A-25J, and 27A-29C, the biasing members 148 may be provided in the recess 116.

Optionally, the biasing members 148 may include a guide or cam surface 129 which guides the substrate 106 into a mounted position in the light source. Accordingly, the cam surface may be engageable by the insertion end 130 or cartridge 110 upon insertion of the cartridge 110 into the main body 102. For example, the biasing members 148 may be shaped as a wedge, as exemplified in FIGS. 7A-7E and 9A-9E. As the insertion end 130 contacts the wedge, it slides along the wedge surface 129 until reaching the mounted position within the main body 102.

As exemplified in FIGS. 2A-2D, 6A-6E, 10A-11E, 13A-13E, and 23A-24O, the biasing member 148 may be separate from the electrical contact members 144. In other words, the biasing member 148 may only provide the biasing force.

Alternately, the biasing member may also provide electrical and/or thermal connection of the cartridge to the light source. It will be appreciated that if the biasing members provide electrical connection of the cartridge to the light source, then the biasing members are electrically conductive members. Accordingly, the biasing members may be the electrical contact members 144 and the biasing members (the electrical contact members 144) may contact any portion of the cartridge that is electrically conductive. It will also be appreciated that if the biasing members provide thermal connection of the cartridge to the light source, then the biasing members are thermally conductive members. Accordingly, the biasing members may contact any portion of the cartridge that is thermally conductive.

FIGS. 2A-3F, 6A-6E, 10A-10E, 12A-13E, 20A-20G, 23A-24O, and 27A-29C exemplify embodiments wherein the main body 102 includes thermal contacts 158. The thermal contacts 158 provide a thermal connection between the heat sink 104 and the cartridge 110 when the cartridge is received by the light source 100. If the thermal contacts 158 also function as biasing members, then the thermal contacts 158 may secure the cartridge 110 in the mounted position within the light source 100. In other words, the thermal contacts 158 may form the biasing member 148. Optionally, the recess 116 may be provided in the heat sink and the thermal contacts 158 may extend between the heat sink and the cartridge (e.g., FIG. 2B). As exemplified in FIG. 2B, the thermal contacts 158 may also suction as the biasing member 148.

It will be appreciated that the thermal contacts 158 may be of any shape, form, or material that allows for thermal conduction between the cartridge 110 and the light source 100. For example, the thermal contacts 158 may include, but are not limited to, a metal, a thermally conductive putty, a compressible foam, and an epoxy.

Securing Members Located on Cartridge

The following is a description of securing a cartridge to a light source using securing members that are provided on the cartridge itself, which may be used by itself or in combination with any one or more other aspects discussed herein. An advantage of providing the securing members on the cartridge itself is that, in the event that the cartridge needs to be replaced, the securing members are also replaced. Replacing the securing members at the same time as the cartridge may extend the lifespan of the light source because any wear of the securing members that has occurred will be replaced with the new cartridge.

Securing members provided on the cartridge 110 may be the same as any of the biasing members 148 discussed herein. For example, one or more securing members may be provided on one side of a cartridge. Alternately one or more securing members may be provided on each side of a cartridge. Some or all of the securing members may also provide thermal communication and/or electrical communication between the cartridge and the light source.

As exemplified in FIGS. 31A-23D and 34A-34D, the cartridge 110 has two biasing members 160 which secure or assist in securing the substrate 106 in the mounted position in the main body 102. It will be appreciated that the cartridge biasing member 160 may be positioned anywhere on the cartridge 110. For example, the cartridge biasing member 160 may be on the second side 138 while the light emitting member 108 is on the first side 136, as exemplified in FIGS. 32A-32D. In some embodiments, both the cartridge biasing member 160 and the light emitting member 108 may be on the first side 136, as exemplified in FIGS. 31A-31D.

Optionally, the cartridge biasing member 160 may have an electrically conductive body portion 162. The electrically conductive body portion 162 may be electrically connected to the substrate contacts 142, as exemplified in FIGS. 34A-34D or may function as the substrate contacts 142. The electrically conductive body portion 162 may engage the electrical contact members 144 when the substrate 106 is positioned in the main body 102. Thus, when the light source 100 is connected to a power source, current travels from the electrical contact members 144, through the electrically conductive body portion 162, to the substrate contacts 142 to cause the light emitting member 108 to emit light. In some embodiments, the entire cartridge biasing member 160 may be the electrically conductive body portion 162.

Optionally, the cartridge biasing member 160 may be made of an electrical insulation material. In such embodiments, the cartridge 110 may be connected to the electrical contact member 144 by any other means. For example, the cartridge biasing member(s) 160 may provide a force in one direction so as to bias the cartridge 110 such that the substrate contacts 142 are moved into contact with the electrical contact members 144 when the substrate is positioned in the main body 102.

Optionally, the cartridge biasing member 160 may bias any thermally conductive portion of the cartridge into thermal contact with the heat sink 104 when the substrate is positioned in the main body 102.

Optionally, the cartridge biasing member 160 may be thermally conductive. In such a case, the cartridge biasing member may contact the heat sink when the cartridge is positioned in the light source.

In some embodiments, the cartridge 110 may have a plurality of cartridge biasing members 160. For example, the cartridge 110 may have four cartridge biasing members 160. Increasing the number of cartridge biasing members 160 may improve the contact between the light source 100 and the cartridge 110. For example, the thermal contact between the heat sink 104 and the cartridge 110 may be improved. Furthermore, when the cartridge biasing members 160 are electrically conductive, increasing the number of cartridge biasing members 160 may reduce the electrical resistance between the cartridge 110 and the light source 100. Reducing the electrical resistance may reduce the thermal energy produced by the current travelling through the cartridge biasing members 160 into the light source 100. Additionally, reducing the resistance may result in a reduced power loss across the cartridge biasing members 160.

Similarly, over time, the electrical contact members 144 may anneal at a contact point between the cartridge biasing members 160 and the electrical contact members 144 due to the thermal energy transmitted through the cartridge biasing members 160. Additionally, the contact point may be damaged over time by the ionic flow between the light emitting member 108 and the electrical contact members 144. Degradation of the electrical contact members 144 caused by annealing and/or ionic flow may increase the power loss between the cartridge 110 and the light source 100.

Accordingly, in some embodiments, the electrical contact members 144 may be an electrical contact strip. The electrical contact strip may be located in any position in the light source 100 such that the cartridge biasing member 160 can electrically connect to the light source 100. An advantage of having an electrical contact strip is that the cartridge biasing member 160 is able to electrically connect to the light source 100 at multiple locations along the electrical contact strip.

For example, cartridge biasing members 160 may be located at different positions along the cartridge 110 such that different cartridge biasing members 160 contact different positions of the electrical contact strip 144. For example, the positions may be designated 1-10. At the first position, the cartridge biasing member 160 may contact the electrical contact strip 144 at a first end of the contact strip. At the fifth position, the cartridge biasing member 160 may contact the electrical contact strip 144 near the middle of the electrical contact strip. At the tenth position, the cartridge biasing member 160 may contact the electrical contact strip at a second end of the contact strip.

During the lifetime of the light source 100, the cartridge 110 may be replaced multiple times. Each time the cartridge 110 is replaced, a user may replace the first cartridge 110 with a new cartridge 110 that has cartridge biasing members 160 located at a different position than the first cartridge 110. For example, one cartridge 110 may have cartridge biasing members 160 located to engage strip 144 at location 1 whereas a second cartridge 110 may have cartridge biasing members 160 located to engage strip 144 at location 2, a third cartridge 110 may have cartridge biasing members 160 located to engage strip 144 at location 3, etc. The packaging of the replacement cartridges or the replacement cartridge may have a label of the like indicating the contact position of the cartridge biasing members. Thus, each time the cartridge 110 is replaced, the contact point on the electrical contact strip 144 may be changed. In such a case, the new contact point will have a fresh surface that has not been degraded by prior use. Using a new contact point may thereby reduce the amount of power lost over time.

Cartridge with a Thermal Conducting Layer

The following is a description of thermally connecting a cartridge to a heat sink in a light source, which may be used by itself or in combination with any one or more other aspects discussed herein.

In accordance with this aspect, a cartridge may have a thermal conducting layer. An advantage of this design is that, when the cartridge is located within the light source, the contact surface area between the heat sink and the cartridge may be increased, thereby improving the thermal communication between the cartridge and the heat sink. Alternately, or in addition, the thermal conducting layer may allow for the electrical contact members used for connecting the cartridge to the power supply to also perform thermal conduction between the cartridge and the heat sink.

The light source may be thermally connected to the thermal conducting layer of the cartridge 110 by thermal contact members 158 and/or the securing members and/or the electrical contact members if the securing members and/or the electrical contact members are thermally conductive.

For example, the substrate 106 may be made of a non-conductive material and may be provided with a thermal conducting layer 145, as exemplified in FIGS. 30A-34D. The thermal conducting layer 145 may be on any portion or all of an outer surface of the substrate 106. Optionally, the thermal conducting layer 145 may be provided on two opposed surfaces of the substrate 106. For example, thermal conducting layer 145 may be provided on each of the first and second longitudinally extending surfaces 136, 138. In will be appreciated that the entire outer surface of the substrate 106 may be coated in the thermal conducting layer 145.

Optionally, as exemplified in FIGS. 7A-9E, the substrate 106 may have fins 107 for facilitating heat transfer from the substrate 106 out of the light source 100.

It will be appreciated that, optionally, the thermal conducting layer 145 may also be an electrical conductive layer. The substrate 106 may be coated with the electrical conductive member such that power supplied to the electrical conductive member is transmitted to the at least one light emitting member 108, thereby causing the light emitting member 108 to emit light. In other words, if thermal conducting layer is an electrical conductive material, the thermal conducting layer may act as the substrate contact 142. For example, in some embodiments, the thermal conducting layer 145 may be made of at least one of aluminum and copper.

Optionally, the thermal conducting layer 145 may be coated with a gold coating.

It will be appreciated that, in some embodiments, the electrically conductive coating may be a separate coating from the thermal conducting layer 145.

Electrical Leads Extend Through Heat Sink

The following is a description of a light source having electrical leads that extend through a heat sink, which may be used by itself or in combination with any one or more other aspects discussed herein. An advantage of electrically connecting the cartridge to the power supply through the heat sink is that the surface area of the heat sink may be expanded. For example, the head sink may extend the entire width of the light source and thereby form part of the outer surface of the light source. This enables the heat sink to dissipate heat at a higher rate. If the electrical connection to the light fixture (the base end 122) is located at an opposed end to the diffuser and the cartridge is provided on the diffuser side of the heat sink, then electrical leads may extend through the heat sink to electrically connect the cartridge to the light source.

As exemplified in FIGS. 1A-4C, 11A-12D, 14A-14F, 18A-18D, and 25A-25J, the heat sink has first and second opposed sides 152, 154. The power supply 112 is positioned between the power connector 122 of the housing 120 and the first side 152 of the heat sink 104. The diffuser is provided on the second opposed side 154 of the heat sink. The heat sink extends the entire width of the light source. Accordingly, optionally, each of the power connector 122 and/or the diffuser 114 may be attached or removably attached to the heat sink.

The heat sink 104 has at least one opening 156 through which the electrical leads 150 (e.g., wires or conductive rods) may extend. Accordingly, in order to provide power to a cartridge 110 provided on the diffuser side of the heat sink, electrical leads 150 may extend through the heat sink. The electrical leads 150 may extend from the power supply 112 to the electrical contact members 144, thereby electrically connecting the substrate 106 to the power supply 112 when the cartridge 110 is in the mounted position.

It will be appreciated that the electrical leads 150 may extend at least partially through the heat sink 104. As exemplified in FIGS. 1A-4C, 11A-12D, 14A-14F, 18A-18D, and 25A-25J, the electrical leads 150 extend through the heat sink 104 such that the electrical contact members 144 are provided on the second opposed side 154 of the heat sink 104. As shown, the substrate 106 may be seated on or in the heat sink 104.

Optionally, the electrical contact members 144 and electrical leads 150 may provide a securing means to mount the substrate 106 to the main body 102.

Optionally, the power supply 112 may be directly connected to the base end 122 or the light source 100 may have secondary electrical leads 151, which extend from the base end 122 to the power supply 112, as exemplified in FIGS.

1A-17C, and 25A-26F. Thus, the base end 122 is electrically connected to the power supply 112 by the secondary electrical leads 151.

In some embodiments, instead of a screw socket 124 as is typically used for an incandescent light bulb, the light source may have pins 126 (see, e.g., FIGS. 11A-13E) which are electrically connectable to a light fixture. In such a case, for example, the housing 120 may include a wall 125 that forms the base end 122. The secondary electrical leads 151 may electrically connect to the wall 125 and the wall 125 may have pins 126. Alternately, the pins 126 may extend to the power supply 112.

Light Emitting Member is Mounted at an Angle

The following is a description of a light source having at least one light emitting member mounted at an angle within the light source, which may be used by itself or in combination with any one or more other aspects discussed herein. An advantage of this aspect is that the light emitted from the light source may be more evenly distributed.

In accordance with this aspect, one or more, and optionally all, of the light emitting members may be oriented at an angle to central axis 118. For example, all or a portion of the cartridge 110 may extend at an angle to central axis 118. Alternately all or a portion of the cartridge 110 having the light emitting members 108 may extend at an angle to central axis 118.

Accordingly, a portion 170 of the substrate 106 having one or more light emitting members 108 may be angled. If cartridge 110 has light emitting members on more than one side, then each side which has light emitting members may extend at an angle to central axis 118.

It will be appreciated that the cartridge 110 may be any shape and size. For example, as described above, the cartridge 110 may be a generally axially extending body having a generally constant cross-sectional shape in a plane transverse to the central axis 118, e.g., generally rectangular or cylindrical shape.

As exemplified in FIGS. 3A-4C, cartridge 110 has a wedge shaped light emitting end (the outer end 132 that comprises portion 170) and insertion end 130 is generally planar and comprises a generally planar insertion end 176 which is receivable in recess 116. The wedge shaped light emitting end extends outwardly and inwardly from a first inward end 172 to a second outward end 174 and has light emitting member 108. The inward end 172 is positioned closer to the base end 122 than the second outward end 174 of the portion 170.

The inward end 172 is positioned further from the central axis 118 than the second outward end 174 such that the light emitting member 108 is mounted on a face that extends in a plane that is at an angle from the central axis 118, and may therefore be referred to as an angled portion 170. As exemplified in FIGS. 3A-4C, the wedge shaped light emitting end has two angled portions 170 each having a light emitting member 108.

An included angle 178 is located between the angled portion 170 and the central axis 118. The angle 178 may be any acute angle from the central axis 118. For example, the included angle 178 may range from about 10° to about 80°, 20° to about 70° or 30° to about 60°.

Remote Power Supply

The following is a description of a light source having a remote power supply, which may be used by itself or in combination with any one or more other aspects discussed herein. An advantage of this design is that the power connection from a central remote power supply to individual light sources may use low voltage wires, allowing a user to install the light sources and/or additional light sources without the need for an electrician. Similarly, additional light sources and/or their housings may be installed without the need for an electrician.

As described previously, a light source 100 may be electrically connected to a power source by screwing in a socket 124 or plugging in pins 126. Also, as previously discussed, a light source 100 may also have a power supply 112 provided internally therein.

As exemplified in FIGS. 18A-24O and 27A-29C, the light source is connected to a remote or external power supply 181 by wires 182. The central power supply 181 may be a remote central power supply 181 connectable to a source of current (e.g., household AC current).

Power supply 181 may provide current suitable for the light emitting members 108. The central power supply 181 may provide AC or DC current. In some embodiments, the cartridge 110 may include a diode to convert AC current to DC current. Optionally, the power supply 181 provides low voltage DC current suitable for an LED. In such a case, light source 100 need not have a power supply. Accordingly, the light emitting members 108 may be connected directly to wires 182 without an intervening power supply. An advantage of this design is that the light source may be simplified as a power supply and additional wiring is not required. A further advantage is that the wires 182 may be low voltage wires and may optionally be Ethernet cables.

As exemplified in FIGS. 18A-24O, the light source 100 and/or the wires 182 may include push-in wire connectors 184. The push-in wire connectors 184 may allow for the light source 100 to be quickly and easily coupled to the central power source 181 by wires 182.

It will be appreciated that a single remote power supply 181 may provide power to a plurality of light sources 100. The plurality of light sources 100 may be connectable to the remote central power 181 supply by the low voltage wires 182.

Some or all of the light sources 100 in the plurality of light sources 100 may be configured to be connectable in parallel. Some or all of the light sources 100 in the plurality of light sources 100 may be configured to be connectable in series. Alternately, some may be connected in series and some in parallel.

Optionally, the light source 100 may have a backup internal power source 186, as exemplified in FIGS. 18A-24O. The backup power 186 source may be a battery. The backup power source 186 may be a rechargeable battery.

It will be appreciated that the plurality of light sources 100 may be grouped as a lighting system kit. The kit may include the plurality of light sources 100 and a central power supply connectable to a source of AC current. Each light source 100 may be connectable to the remote central power source by low voltage wires. In some embodiments, the lighting system kit may include one or more cartridges 110.

Light Source with a Light Guide

The following is a description of a light source having a light guide, which may be used by itself or in combination with any one or more other aspects discussed herein. An advantage of using a light guide is that replacement of a cartridge within the light source may be performed in a more accessible fashion, while providing light from a location distal to the cartridge location. For example, the cartridge may be located at ground level while the light is emitted at an elevation or a hard to reach location, thereby allowing the cartridge to be easily replaced without the use of equipment such as a cherry picker.

As exemplified in FIGS. 15A-17C and 27A-29C the light source 100 may include a light guide 190. The light guide 190 may allow for light emitted from the light emitting member 108 to be transmitted more broadly (see, e.g., FIGS. 15A-17C and 28A-29C) or at a greater distance (see, e.g., FIGS. 27A-27C) than light emitted from the light emitting member 108 alone.

Figures 27A, 27B, 27C:
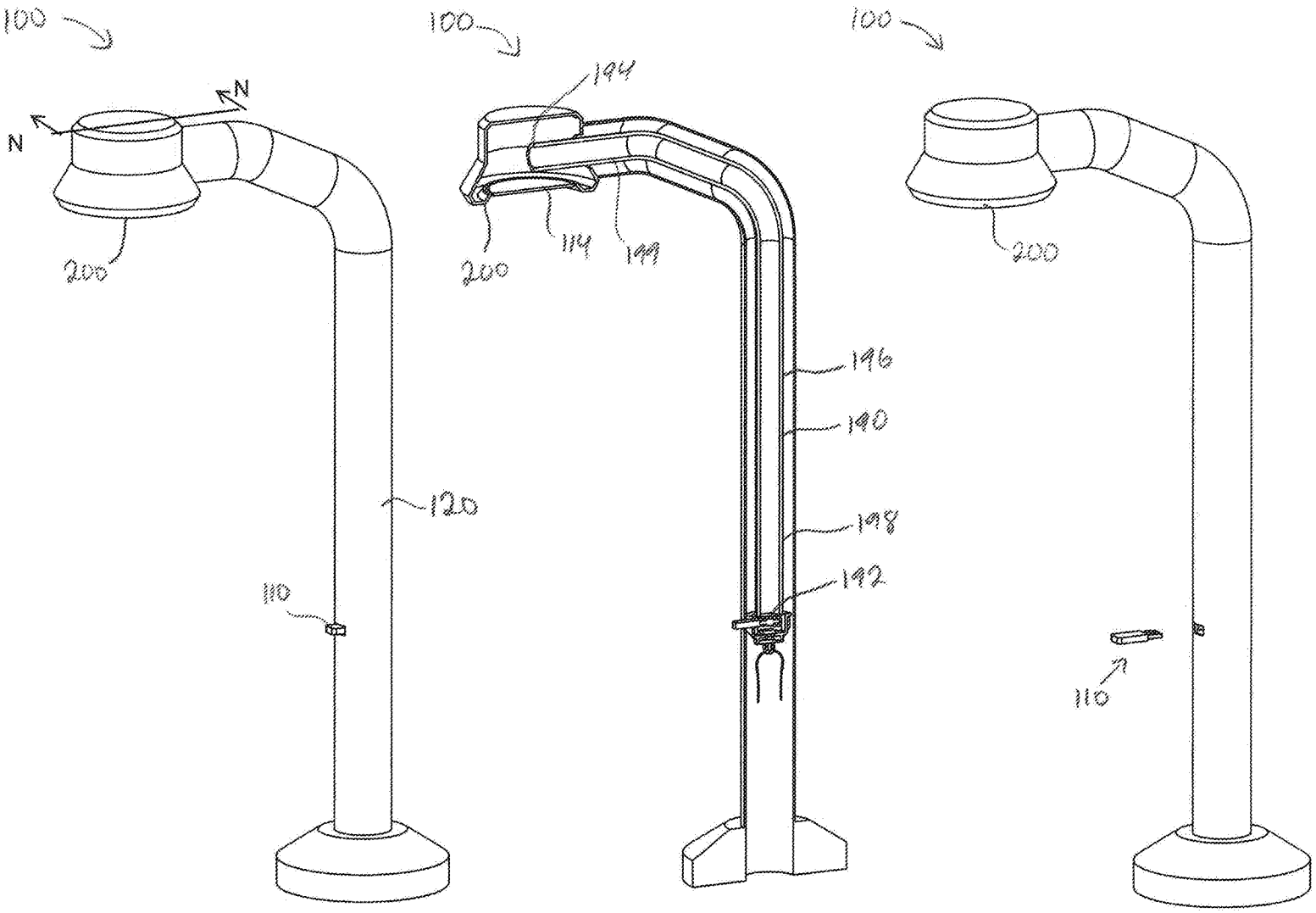

FIGS. 15A-17C exemplify the use of a light guide in a replacement light bulb. FIGS. 27A-27C exemplify the use of a light guide in, e.g., a street light, a desk light or a floor lamp. FIGS. 28A-29C exemplify the use of a light guide as the light source itself.

As exemplified in FIGS. 15A-17C, the light guide 190 may have a first end 192, a second end 194, and a body 196 disposed between the first and second ends 192, 194. The first end 192 of the light guide 190 may abut the light emitting member 108. The light guide 190 may be of any design known for a light guide. As exemplified in FIGS. 15A-17C, the light guide 190 may have a plurality of light emitting regions 197 for allowing light to be emitting from the light guide 190 as the light travels through the light guide from the first end 192 to the second end 194. Alternately, or in addition, light may exit from the second end 194. As exemplified in the embodiment of FIGS. 27A-27C, light is optionally emitted only from the second end 194.

In some embodiments, the light guide 190 may be fixed to the main body 102. As exemplified in FIGS. 15A-16D, the light guide 190 may be mounted to the diffuser 114. In some embodiments, the light guide 190 may be separately removable from the main body 102, as exemplified in FIGS. 17A-17C.

It will be appreciated that the light guide 190 may be rigid or flexible and may be any shape and size. For example, as exemplified in FIG. 27B, the light guide 190 may be curved.

As exemplified in FIGS. 27A-27C, the light source 100 may be a street light having a housing 120, e.g., a hollow pole. The housing 120 has a base end 122 an opposed upper light emitting end 121. The base end may be of any design which is securable on or in the ground. The light emitting end 121 may be located within a head 200. Head 200 may be any design known in the street lighting arts.

As exemplified, a cartridge 110 is receivable in the base end 122. As exemplified, a light guide 190 extends from the substrate 106 to the head 200.

The light guide 190 may have a lower portion 198 that extends axially in the pole 120 and an upper portion 199 that extends away from the pole 120. As exemplified, the upper portion 199 may be curved.

The cartridge may be insertable into the housing at any elevation. Optionally, the cartridge is insertable into the housing at an elevation which enables a person to be situated on the ground and not, e.g., standing on an aerial work platform such as a cherry picker. Accordingly, the cartridge may be insertable in a recess provided within 6 feet or within 5 feet (e.g., 2-5, 2-4 feet above the ground) of the ground when the housing is installed.

In some embodiments, as described above, the housing 120 may have an openable portion. The openable portion of the street light 100 may be securable in a closed position by a lock to prevent unauthorized removal of the cartridge.

When the street light 100 is turned on, light is emitted from the light emitting member 108 and travels through the lower portion 198, through the upper portion 199, and into the head 200. Light is then emitted from the light emitting end 121 of the head 200.

In some embodiments, the light source 100 may be a shelf light or a shelf itself. The light source 100 may have a rectangular prism shaped light guide 190, as exemplified in FIGS. 28A-28C. As shown, a portion of the outer surface of the light guide 190 contains portions 197 for emitting light. In some embodiments, the shelf light 100 may have a rectangular prism shaped diffuser 114, as exemplified in FIGS. 29A-29C.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A light bulb comprising:

(a) a substrate having a light emitting member provided thereon, the substrate has an insertion end, a longitudinally opposed outer end and a body portion extending longitudinally between the insertion end and the outer end, the body portion has first and second longitudinally extending sides; and, (b) a main body in which the substrate is removably received, the main body comprising a heat sink and electrical contact members, the main body has a recess in which the insertion end of the substrate is slideably receivable, and the heat sink has an opening in which the body portion of the substrate is positioned when the insertion end of the substrate is inserted into the recess, the opening comprising a first sidewall portion and an opposed second sidewall portion, wherein the substrate is moveable from a fully inserted in use position in which the substrate is secured in position in the main body and a withdrawn position in which the substrate has been withdrawn from the light bulb and the substrate is slideably insertable into the in use position, and wherein, when the substrate is in the fully inserted in use position, the first longitudinally extending side faces the first sidewall portion and is in thermal communication with the first sidewall portion and the second longitudinally extending side faces the second sidewall portion and is in thermal communication with the second sidewall portion, and wherein the electrical contact members comprise an electrically conductive body portion that is mounted to the main body and the electrically conductive body portion mechanically secures the substrate in position in the fully inserted in use position.

2. The light bulb of claim 1 wherein the electrically conductive body portion comprises a biasing member which engages the substrate.

3. The light bulb of claim 1 wherein the electrical contact members comprises a first electrical contact member which contacts a first side of the substrate and a second electrical contact member that contacts an opposed side of the substrate.

4. The light bulb of claim 1 wherein the electrical contact members comprise first and second electrical contact members, the first electrical contact member exerts a force in a first direction on the substrate and the second electrical contact member exerts a force in a direction opposite to the first direction on the substrate.

5. The light bulb of claim 1 wherein the insertion end is a lead end when the substrate is inserted into the main body and the electrical contact members comprise a cam surface engageable by the insertion end upon insertion of the substrate into the main body.

6. The light bulb of claim 1 wherein at least a portion of the electrical contact members are provided in the recess.

7. The light bulb of claim 6 wherein the recess is provided in the heat sink.

8. The light bulb of claim 6 wherein the electrical contact members comprise a guide surface which guides the substrate into the recess.

9. The light bulb of claim 1 wherein the heat sink has a recess in which the substrate is slideably receivable.

10. The light bulb of claim 1 wherein the electrical contact members thermally connect the substrate with the heat sink.

11. The light bulb of claim 10 wherein the substrate is made of a non-conductive material and is coated with a thermal conducting layer.

12. The light bulb of claim 1 wherein the substrate comprises a printed circuit board.

13. The light bulb of claim 1 wherein the main body comprises a housing having a base connectable to a source of current, a diffuser and a slot in which the substrate is slideably receivable.

14. The light bulb of claim 1 wherein the body portion has first and second longitudinally extending surfaces on different sides of the body portion and a light emitting member is provided on each of the first and second longitudinally extending surfaces.

15. The light bulb of claim 1 wherein the outer portion of the heat sink has fins that extend generally axially.

16. The light bulb of claim 1 wherein the substrate is insertable into the main body in a direction that is generally transverse to the axial direction.

17. The light bulb of claim 16 wherein the outer portion of the heat sink has fins that extend generally axially.

18. The light bulb of claim 1, wherein the main body further comprises an insertion end that is electrically connectable to a light housing, an outer light emitting end that is spaced from the insertion end in an axial direction, and a mid-portion located between the insertion end and the outer light emitting end, the mid-portion having an exterior surface which comprises an outer portion of the heat sink.

19. The light bulb of claim 18 wherein the substrate is insertable into the main body in a direction that is generally transverse to the axial direction.

20. A light bulb comprising:

(a) a substrate having a light emitting member provided thereon, the substrate has an insertion end, a longitudinally opposed outer end and a body portion extending longitudinally between the insertion end and the outer end, the body portion has first and second longitudinally extending sides; and, (b) a main body comprising a heat sink and having a recess in which the insertion end of the substrate is slideably receivable, the heat sink has an opening comprising a first sidewall portion and an opposed second sidewall portion, wherein the substrate is moveable from a fully inserted in use position in which the substrate is secured in position in the main body and a withdrawn position in which the substrate has been withdrawn from the light bulb and the substrate is slideably insertable into the in use position, and wherein, when the substrate is in the fully inserted in use position, the first longitudinally extending side faces the first sidewall portion and is in thermal communication with the first sidewall portion and the second longitudinally extending side faces the second sidewall portion and is in thermal communication with the second sidewall portion.

21. The light bulb of claim 20 wherein the substrate is insertable into the main body in a direction that is generally transverse to the axial direction.

* * * * *